US012678686B2

(12) United States Patent
Zhang et al.

(10) Patent No.: US 12,678,686 B2
(45) **Date of Patent: *Jul. 14, 2026**

(54) JIGSAW PUZZLE TABLE

(71) Applicant: Shenzhen Shi Hu Lian Heng Tong Trading Co. Ltd., Shenzhen (CN)

(72) Inventors: Meng Zhang, Shenzhen (CN); Xiaoling Che, Dangyang (CN)

(73) Assignee: Shenzhen Shi Hu Lian Heng Tong Trading Co. Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/938,325

(22) Filed: Nov. 6, 2024

(65) Prior Publication Data

US 2025/0058210 A1 Feb. 20, 2025

Related U.S. Application Data

(63) Continuation-in-part of application No. 18/736,862, filed on Jun. 7, 2024, now Pat. No. 12,220,648, which (Continued)

(30) Foreign Application Priority Data

| | | |
|---|---|---|
| Sep. 26, 2021 | (CN) | 202111131554.1 |
| Sep. 26, 2021 | (CN) | 202122334815.1 |
| Jan. 28, 2022 | (CN) | 202210103787.9 |
| Oct. 28, 2022 | (CN) | 202230717091.6 |
| Jun. 13, 2023 | (CN) | 202330364018.X |
| May 8, 2024 | (CN) | 202420991164.4 |

(Continued)

(51) Int. Cl.
*A63F 9/10* (2006.01)

(52) U.S. Cl.
CPC ..... *A63F 9/1044* (2013.01); *A63F 2009/105* (2013.01)

(58) Field of Classification Search
CPC .. A63F 9/1044; A63F 2009/105; A47B 25/00; A47B 23/042

(Continued)

(56) References Cited

U.S. PATENT DOCUMENTS

| | | | | |
|---|---|---|---|---|
| 129,870 A * | 7/1872 | Stahn | ..... | A47B 27/02 108/10 |
| 702,749 A * | 6/1902 | Smith | ..... | A47B 27/02 108/10 |

(Continued)

*Primary Examiner* — Jose V Chen

(57) ABSTRACT

A jigsaw puzzle table includes a board assembly comprising a puzzle plate an adjusting structure coupled with the puzzle board, a supporting assembly coupled with the adjusting structure. The adjusting structure is capable of supporting the board assembly in either a horizontal state or an inclined state, and capable of enabling the board assembly to switch between the horizontal state and the inclined state. The jigsaw puzzle table further includes a supporting assembly having an upper part with a receiving channel, a supporting leg, and a connecting part connecting the supporting leg and the upper part. The connecting part includes a guiding portion inserted into the receiving channel and sandwiched between the upper part and the supporting leg, and an inner channel surrounded by the guiding portion. The supporting leg is inserted into the inner channel for adjusting a height of the jigsaw puzzle table.

28 Claims, 61 Drawing Sheets

Related U.S. Application Data is a continuation of application No. 18/235,896, filed on Aug. 21, 2023, now Pat. No. 12,048,885, and a continuation of application No. 18/235,416, filed on Aug. 18, 2023, now Pat. No. 12,059,631, and a continuation-in-part of application No. 18/541,685, filed on Dec. 15, 2023, now Pat. No. 12,042,740, and a continuation-in-part of application No. 17/829,359, filed on Jun. 1, 2022, now Pat. No. 12,104,744, application No. 18/938,325, filed on Nov. 6, 2024 is a continuation-in-part of application No. 18/740,863, filed on Jun. 12, 2024, now Pat. No. 12,226,708, which is a continuation-in-part of application No. 18/222,990, filed on Jul. 17, 2023, which is a continuation-in-part of application No. 29/824,951, filed on Jan. 28, 2022, now Pat. No. Des. 1,009,177, and a continuation-in-part of application No. 17/720,682, filed on Apr. 14, 2022, now abandoned, and a continuation-in-part of application No. 29/818,457, filed on Dec. 9, 2021, now Pat. No. Des. 1,029,113, and a continuation-in-part of application No. 29/859,220, filed on Nov. 8, 2022, now Pat. No. Des. 1,004,709, application No. 18/938,325, filed on Nov. 6, 2024 is a continuation-in-part of application No. 18/817,289, filed on Aug. 28, 2024, which is a continuation of application No. 17/829,359, filed on Jun. 1, 2022, now Pat. No. 12,104,744, and a continuation of application No. 18/732,602, filed on Jun. 3, 2024, now Pat. No. 12,186,676, which is a continuation of application No. 18/541,685, filed on Dec. 15, 2023, now Pat. No. 12,042,740, which is a continuation of application No. 17/505,587, filed on Oct. 19, 2021, now Pat. No. 11,890,551, said application No. 18/235,896 is a continuation-in-part of application No. 17/505,587, filed on Oct. 19, 2021, now Pat. No. 11,890,551, said application No. 18/235,416 is a continuation-in-part of application No. 17/505,587, filed on Oct. 19, 2021, now Pat. No. 11,890,551, said application No. 18/235,896 is a continuation-in-part of application No. 17/829,359, filed on Jun. 1, 2022, now Pat. No. 12,104,744, said application No. 18/235,416 is a continuation-in-part of application No. 17/829,359, filed on Jun. 1, 2022, now Pat. No. 12,104,744, said application No. 18/817,289 is a continuation-in-part of application No. 18/736,862, filed on Jun. 7, 2024, now Pat. No. 12,220,648, and a continuation of application No. 18/222,990, filed on Jul. 17, 2023, and a continuation of application No. 18/740,863, filed on Jun. 12, 2024, now Pat. No. 12,226,708, application No. 18/938,325, filed on Nov. 6, 2024 is a continuation-in-part of application No. 18/817,240, filed on Aug. 28, 2024, which is a continuation of application No. 18/740,863, filed on Jun. 12, 2024, now Pat. No. 12,226,708, and a continuation of application No. 18/736,862, filed on Jun. 7, 2024, now Pat. No. 12,220,648, application No. 18/938,325, filed on Nov. 6, 2024 is a continuation-in-part of application No. 18/916,412, filed on Oct. 15, 2024, which is a continuation-in-part of application No. 18/736,862, filed on Jun. 7, 2024, now Pat. No. 12,220,648, and a continuation-in-part of application No. 18/740,863, filed on Jun. 12, 2024, now Pat. No. 12,226,708, and a continuation-in-part of application No. 18/817,289, filed on Aug. 28, 2024, and a continuation-in-part of application No. 18/817,240, filed on Aug. 28, 2024.

(30) Foreign Application Priority Data

| | | |
|---|---|---|
| May 8, 2024 | (CN) | 202430265926.8 |
| Sep. 26, 2024 | (CN) | 202422359068.0 |
| Oct. 23, 2024 | (CN) | 202430668605.2 |

(58) Field of Classification Search
USPC ..... 108/5, 59, 10, 94, 22; 248/349.1
See application file for complete search history.

(56) References Cited

U.S. PATENT DOCUMENTS

| | | | | | |
|---|---|---|---|---|---|
| 3,140,559 | A * | 7/1964 | Grow | A47B 27/06 | 108/6 |
| 4,865,325 | A * | 9/1989 | Stolz | A63F 9/1044 | 273/157 R |
| 5,479,867 | A * | 1/1996 | Blevins | A47B 49/00 | 108/22 |
| 6,045,108 | A * | 4/2000 | Cziraky | A45C 9/00 | 248/461 |
| 6,154,956 | A * | 12/2000 | Frohardt | B23Q 1/015 | 108/142 |
| 6,463,946 | B1 * | 10/2002 | Wu | F16M 13/02 | 211/163 |
| 6,868,754 | B2 * | 3/2005 | Eix | A47G 33/04 | 108/22 |
| 7,798,071 | B2 * | 9/2010 | Ishikawa | F16C 19/502 | 248/349.1 |
| 8,322,290 | B1 * | 12/2012 | Mignano | A47B 23/043 | 248/456 |
| 9,044,688 | B1 * | 6/2015 | Janay | B65D 25/22 | |
| 11,388,990 | B1 * | 7/2022 | Watkins | A63F 9/1044 | |
| 2002/0023995 | A1 * | 2/2002 | Yoshida | B60N 2/14 | 248/349.1 |
| 2009/0031926 | A1 * | 2/2009 | Goda | F16M 11/18 | 108/22 |
| 2009/0045311 | A1 * | 2/2009 | Seyedin | F16M 11/08 | 248/349.1 |
| 2021/0170267 | A1 * | 6/2021 | Malki | A63F 9/1044 | |

* cited by examiner

JIGSAW PUZZLE TABLE

TECHNICAL FIELD

The present invention relates to the field of puzzle game accessories, and in particular to a jigsaw puzzle table with a rotating assembly, wherein the jigsaw puzzle table is movable with respect to one or more users through the rotating assembly for allowing the user to move the jigsaw puzzle table for assembling the puzzle pieces thereon at different planar directions, such that the user does not need to physically travel from side to side of the jigsaw puzzle table.

BACKGROUND

The jigsaw puzzle, as a puzzle game, is essential in intellectual development for children. Due to the jigsaw puzzle being interesting, the jigsaw puzzle is also popular among adults. When playing the jigsaw puzzle, a user needs to carefully identify puzzle pieces to find similarities between the puzzle pieces to splice the puzzle pieces together. In order to enable the user to splice the puzzle pieces, the jigsaw puzzle table is released to the market. However, the jigsaw puzzle table in the art has a fixed height, and the height may not be adjusted according to a height of the user. Therefore, the user whose height does not match the height of the jigsaw puzzle table may not use the jigsaw puzzle table comfortably, having a poor usage experience.

When a user challenges a larger scale jigsaw puzzle, it is necessary to prepare a jigsaw puzzle table with sufficient bearing area. However, the arm length of the user is often insufficient to reach the entire game area, and the viewing angle range of the user is not enough to pay attention to the entire game area. As a result, the user often needs to move the position of the puzzle during the game process.

A need exists for a tool that retains all the unfinished pieces and while allowing the user to conveniently user the puzzle. It is to the provision of such a tool that the present invention is primarily directed.

SUMMARY OF THE DISCLOSURE

The invention is advantageous in that it provides a jigsaw puzzle table for allowing a user to conveniently play a plurality of puzzle pieces.

The present invention provides the jigsaw puzzle table comprises a board assembly comprising a puzzle plate for assembling a plurality of puzzle pieces, an adjusting structure coupled with the puzzle board for supporting the board assembly and adjusting a posture of the board assembly relative to the user, a supporting assembly coupled with the adjusting structure for supporting the adjusting structure and the board assembly. The adjusting structure is capable of supporting the board assembly in either a horizontal state or an inclined state, and capable of enabling the board assembly to switch between the horizontal state and the inclined state.

Optionally, the supporting assembly comprises a connecting shaft and a supporting leg supporting the connecting shaft, the adjusting structure is movably connected to the connecting shaft for driving the board assembly to switch between the horizontal state and the inclined state.

Optionally, the adjusting structure comprises a mounting hole fitted over an outer circumference of the connecting shaft, thereby allowing the adjusting structure to rotate around the connecting shaft.

Optionally, the supporting leg is substantially perpendicular to the connecting shaft.

Optionally, the supporting assembly further comprises an extending arm extending from the supporting leg and connected to the connecting shaft.

Optionally, the supporting leg, the extending arm and the connecting shaft are substantially perpendicular to each other.

Optionally, a size of the mounting hole is adjustable.

Optionally, the adjusting structure further comprises an adjusting gap communicated with the mounting hole for dividing the adjusting structure into a first part and a second part; and an adjusting unit connected to both the first part and the second part for adjusting the height of the adjusting gap, thereby adjusting the size of the mounting hole.

Optionally, the adjusting gap extends from an outer circumference of the adjusting structure to the mounting hole.

Optionally, the adjusting unit comprises a fastening portion, a first connecting hole formed in the first part and cooperated with the fastening portion, and a second connecting hole formed in the second part and cooperated with the fastening portion, the fastening portion is inserted into the first connecting hole, the adjusting gap and the second hole for adjusting the height of the adjusting gap.

Optionally, the adjusting unit comprises a fastening portion, a first connecting hole formed in the first part and cooperated with the fastening portion, and a nut formed on the second part and cooperated with the fastening portion, the fastening portion is inserted into the first connecting hole, the adjusting gap and the nut for adjusting the height of the adjusting gap.

Optionally, the adjusting structure comprises a supporting portion located below the board assembly for supporting the board assembly and an adjusting portion fixed below the supporting portion, with the mounting hole formed in the adjusting portion.

Optionally, the supporting leg comprises an upper body protruded relative to the connecting shaft, the supporting portion comprises a first side and a second side opposite to the first side, the adjusting portion is fixed to the first side of the supporting portion, and the second side is detachably mounted on the upper body.

Optionally, the adjusting portion comprises a main portion connected to the connecting shaft and a fastening portion located above the main portion and coupled with the supporting portion.

Optionally, the board assembly comprises a puzzle board and a rotating assembly sandwiched between the puzzle board and the supporting portion for driving the puzzle plate to rotate.

Optionally, the supporting portion further comprises an installation opening completely drilled through it; the rotating assembly comprises a coupling unit fixed on the puzzle board; the coupling unit is visible through the installation opening.

Optionally, the puzzle board comprises a lateral locking hole, a longer edge and a shorter edge connected to the longer edge; the jigsaw puzzle table further comprises a rotating locking portion detachably connected to the lateral locking hole for fixing the shorter edge in front of the user.

The present invention further provides the jigsaw puzzle table comprises a board assembly comprising a puzzle plate for assembling a plurality of puzzle pieces, and a supporting assembly coupled with the board assembly for supporting the board assembly and comprising an upper part having a receiving channel, a supporting leg, and a connecting part connecting the supporting leg and the upper part. The connecting part comprises a guiding portion inserted into the receiving channel and sandwiched between the upper part and the supporting leg, and an inner channel surrounded by the guiding portion; and the supporting leg is inserted into the inner channel.

Optionally, the inner channel is communicated with the receiving channel, the supporting leg is inserted into the receiving channel via the inner channel.

Optionally, the connecting part further comprises a flanging part extending from the guiding portion and mounted on the upper part for covering the receiving channel, the inner channel is completely drilled through the flanging part.

Optionally, the jigsaw puzzle table comprises a positioning fastener connected to the upper part to fasten the supporting legs with the upper part, wherein the positioning fastener is configured to secure the supporting leg and the upper part to fix a height of the board assembly supported by the supporting leg and the upper part; the positioning fastener is further configured to release the security between the supporting leg and the upper part to enable the supporting leg and the upper part to be at least partially movable relative to each other to adjust the supported height.

Optionally, the jigsaw puzzle table comprises an adjusting structure coupled with the puzzle board for adjusting a posture of the board assembly relative to a user; the adjusting structure is capable of supporting the board assembly in either a horizontal state or an inclined state, and capable of enabling the board assembly to switch between the horizontal state and the inclined state.

Optionally, the adjusting structure comprises a supporting portion located below the board assembly for supporting the board assembly; and an adjusting portion coupled with the supporting portion and supported by the supporting assembly.

Optionally, the supporting assembly further comprises a connecting shaft supported by the supporting leg, the adjusting structure comprises a mounting hole fitted over an outer circumference of the connecting shaft, thereby allowing the adjusting structure to rotate around the connecting shaft.

Still further objects and advantages will become apparent from a consideration of the ensuing description and drawings. These and other objectives, features, and advantages of the present invention will become apparent from the following detailed description, the accompanying drawings, and the appended claims.

DETAILED DESCRIPTION

Figure 1:
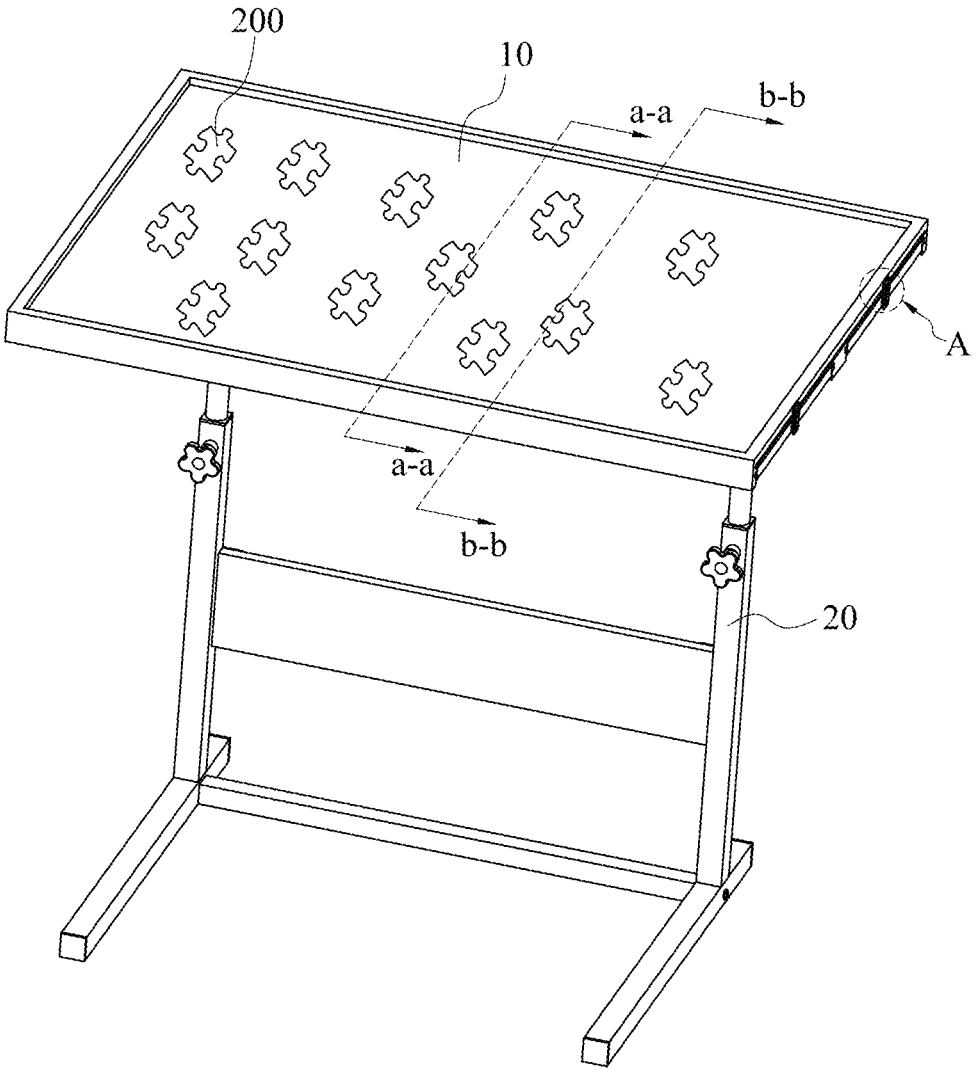
FIG. 1 is an illustrative isometric view of a jigsaw puzzle table according to a first embodiment of the present invention.
Figure 2:
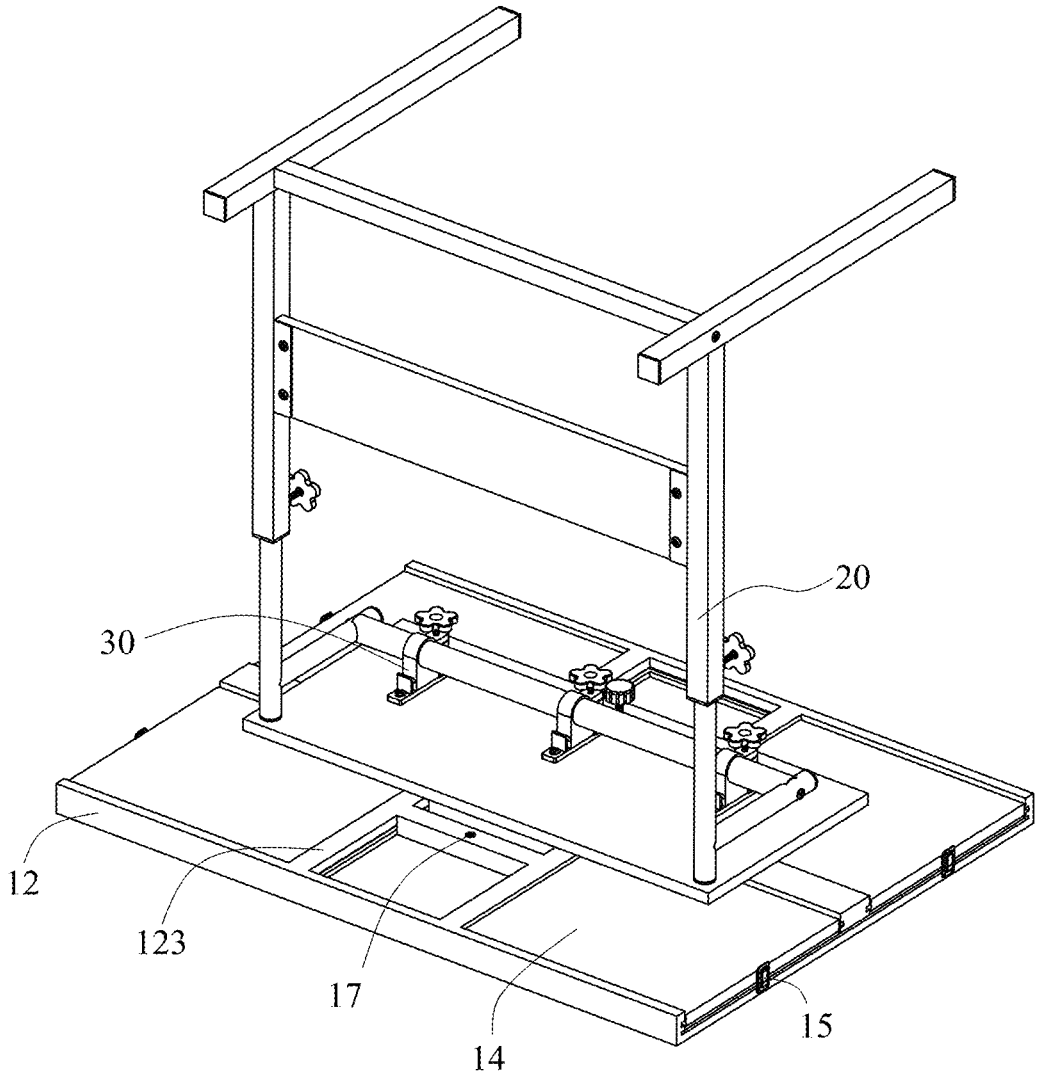
FIG. 2 is an illustrative isometric view of the jigsaw puzzle table shown in FIG. 1, viewed from a different angle.
Figure 3:
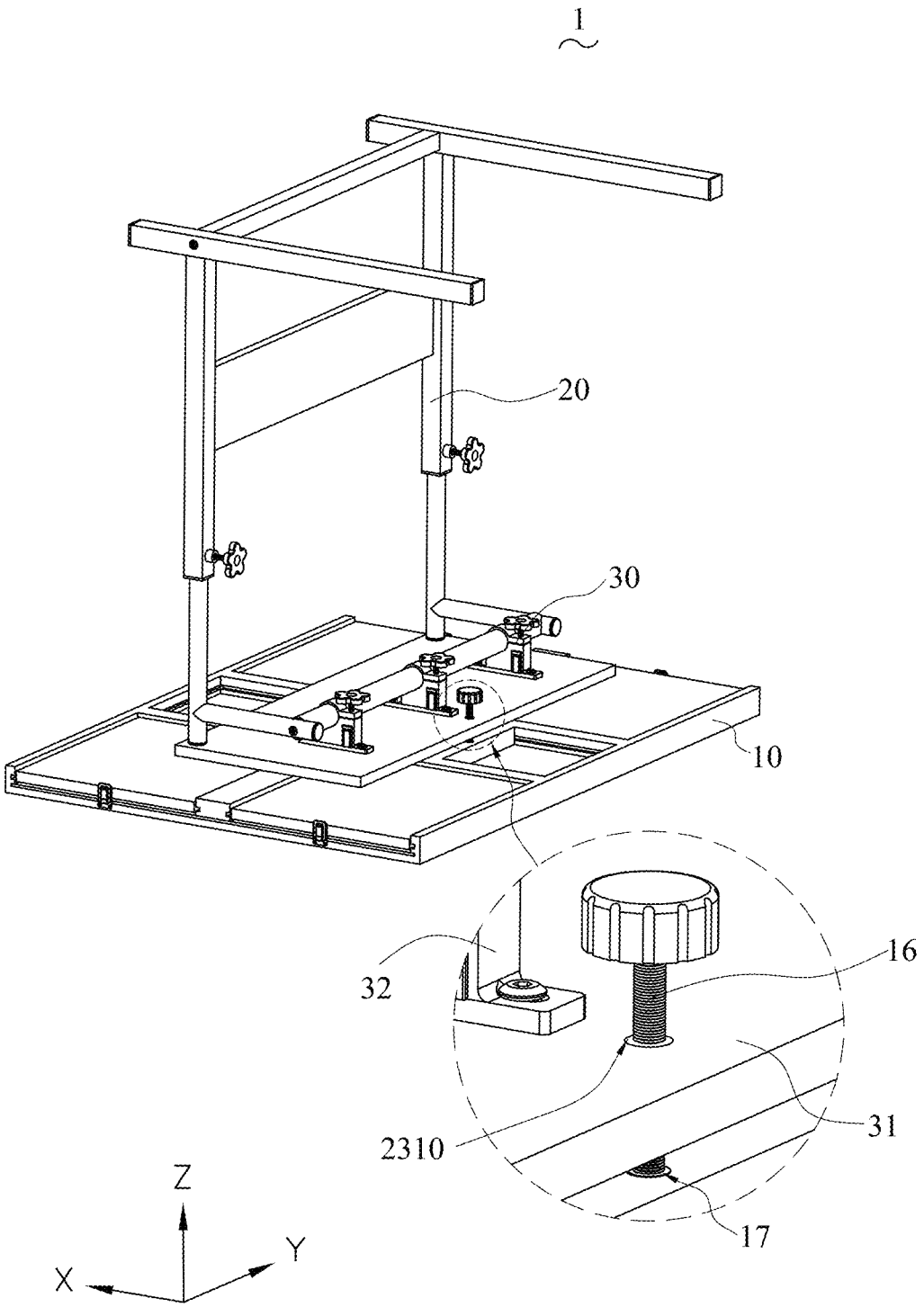
FIG. 3 is an illustrative isometric view of the jigsaw puzzle table shown in FIG. 1, viewed from a third angle.
Figure 4:
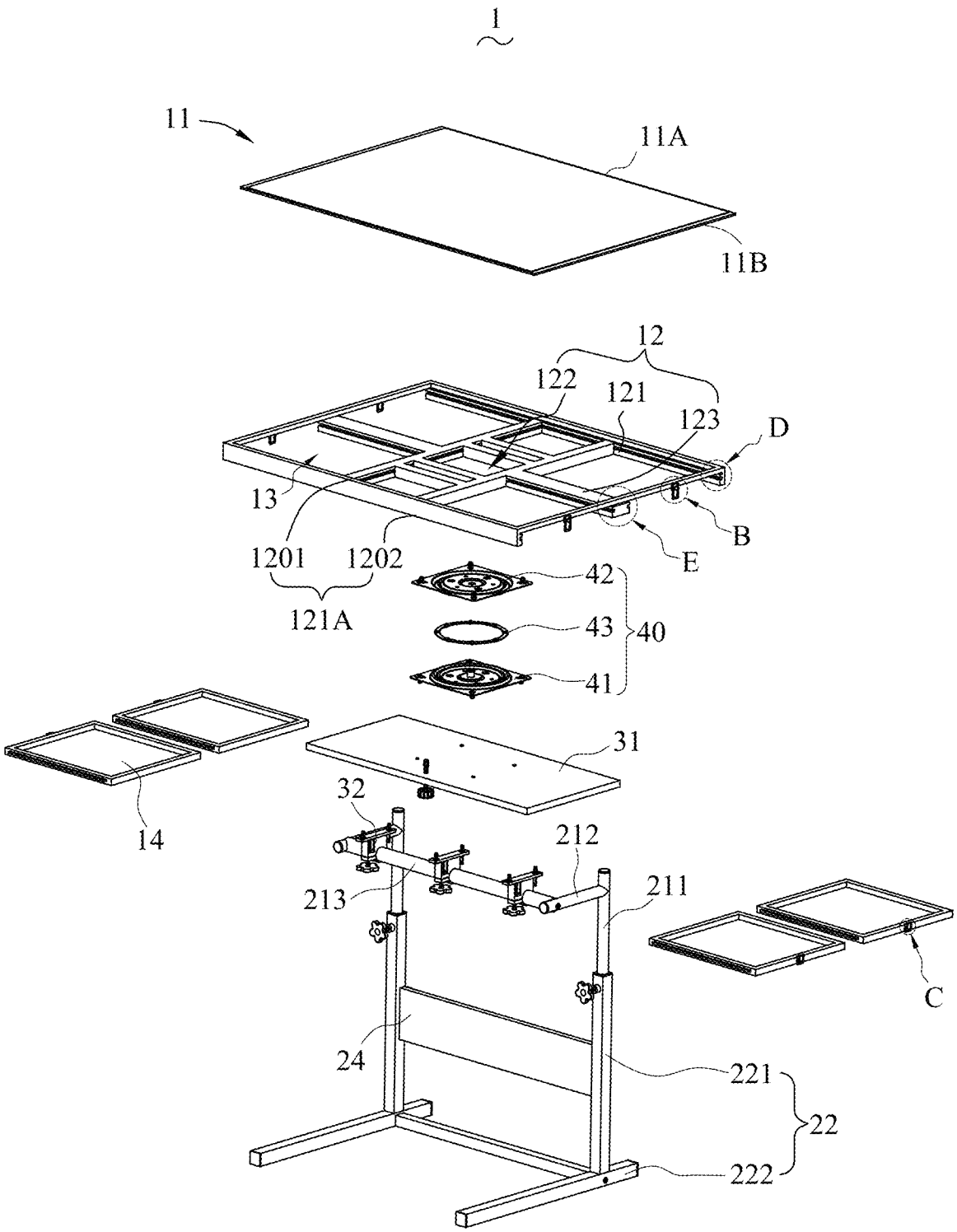
FIG. 4 is an exploded perspective view of the jigsaw puzzle table shown in FIG. 1.
Figure 5:
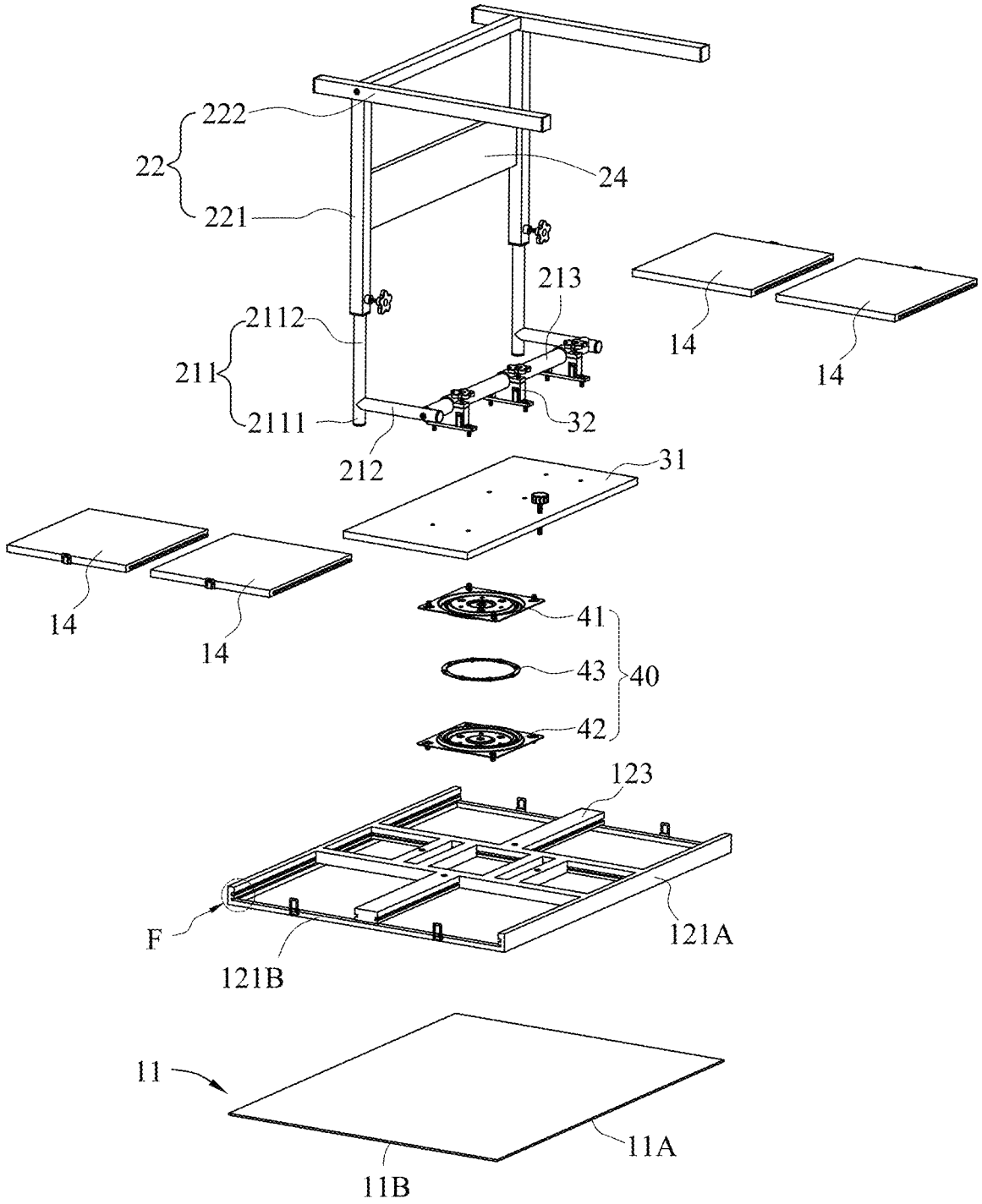
FIG. 5 is an exploded perspective view of the jigsaw puzzle table shown in FIG. 1, viewed from a different angle.
Figure 6:
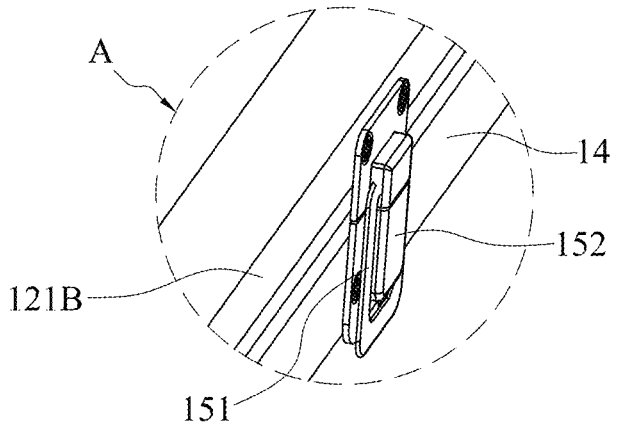
FIG. 6 is an enlarged view of Part A in FIG. 1.
Figure 7:
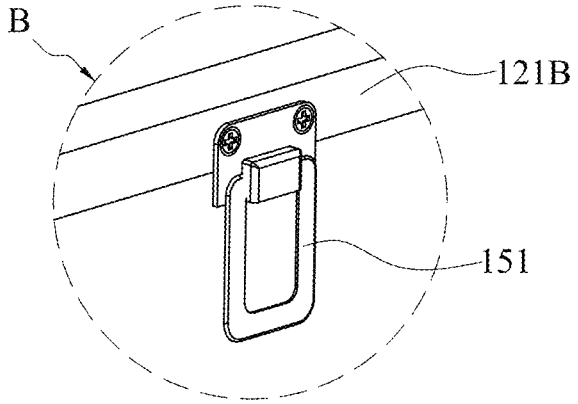
FIG. 7 is an enlarged view of Part B in FIG. 4.
Figure 8:
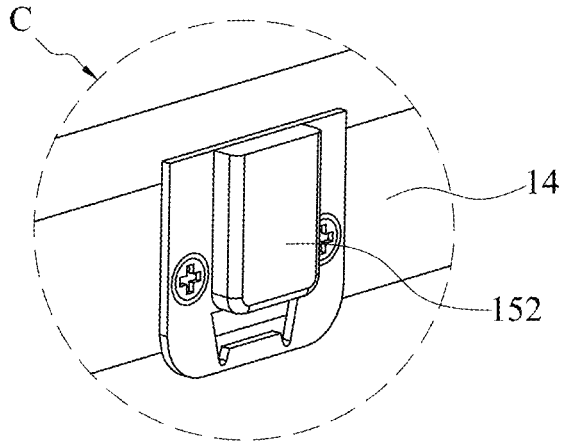
FIG. 8 is an enlarged view of Part C in FIG. 4.
Figure 9:
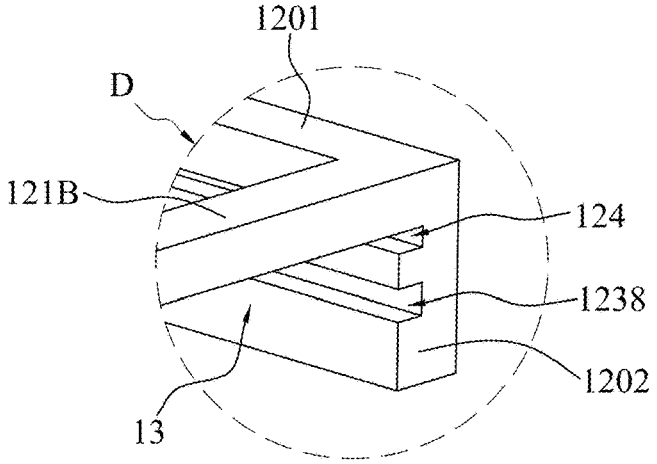
FIG. 9 is an enlarged view of Part D in FIG. 4.
Figure 10:
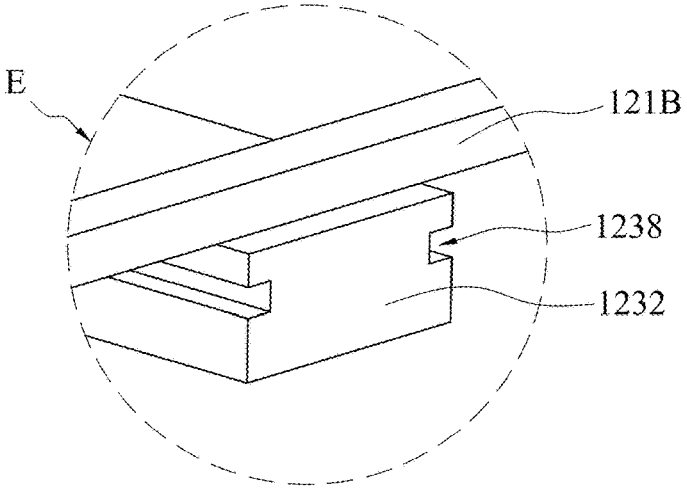
FIG. 10 is an enlarged view of Part E in FIG. 4.
Figure 11:
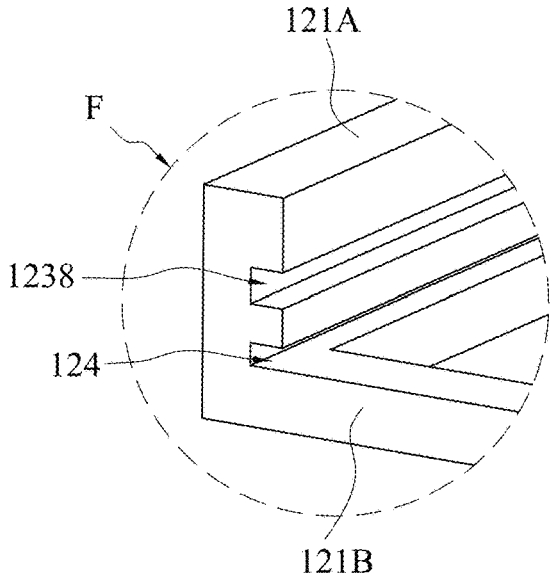
FIG. 11 is an enlarged view of Part F in FIG. 5.
Figure 12:
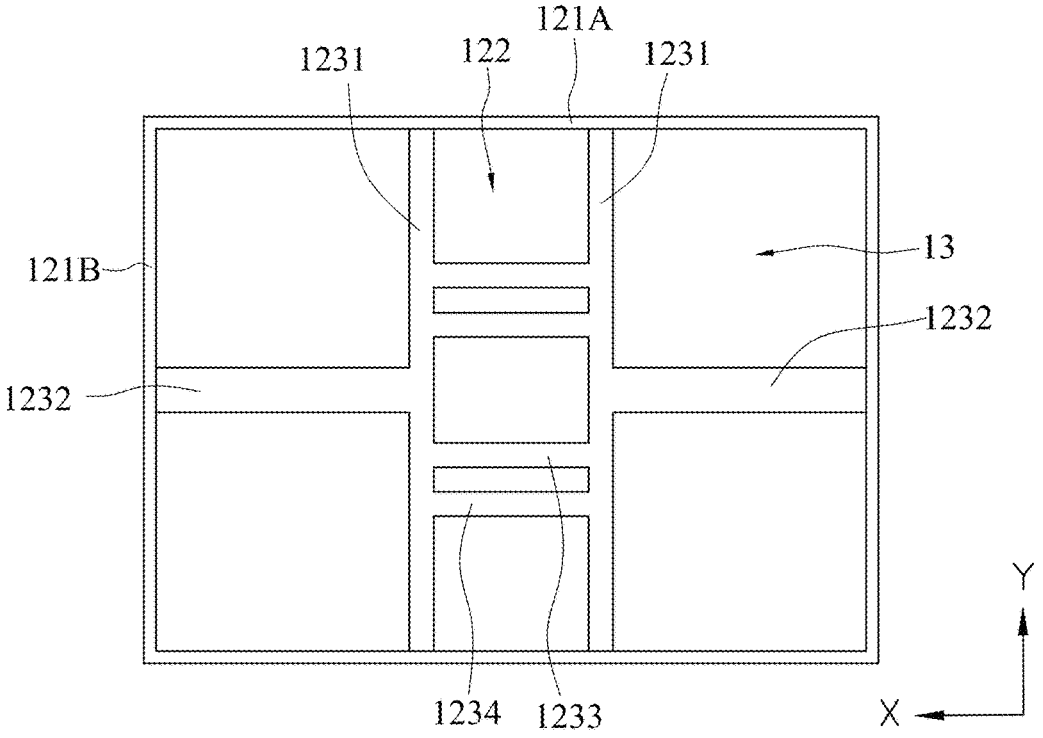
FIG. 12 is a top view of a fixing frame of the jigsaw puzzle table shown in FIG. 1.
Figure 13:
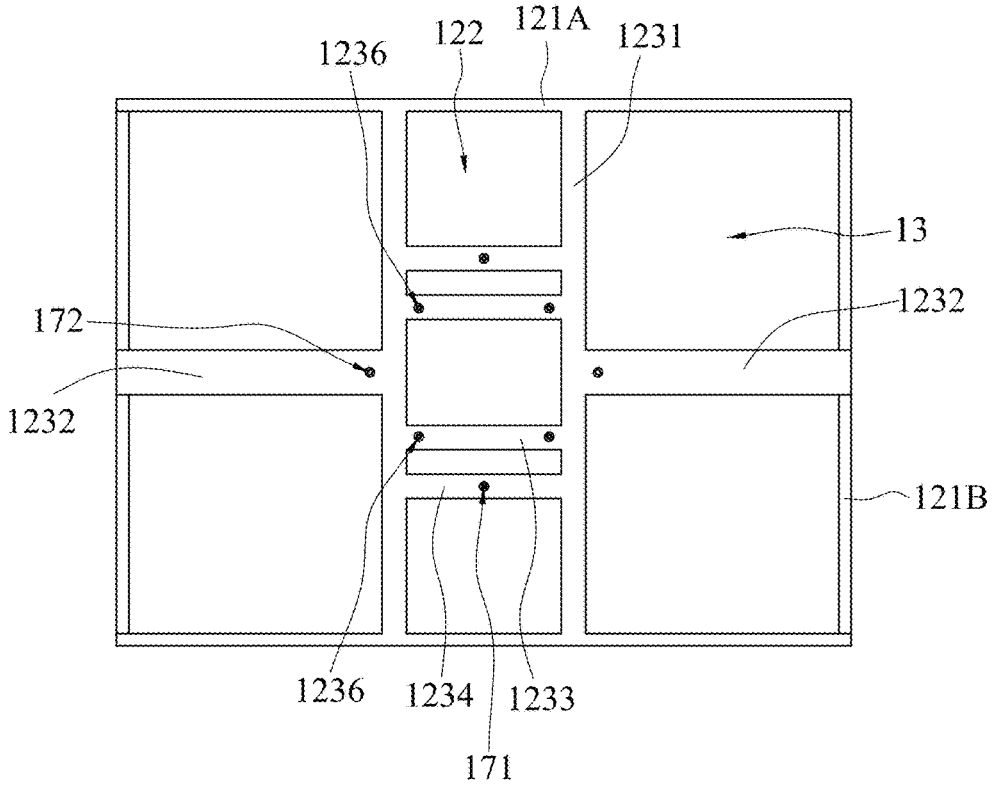
FIG. 13 is a bottom view of the fixing frame shown in FIG. 12.
Figure 14:
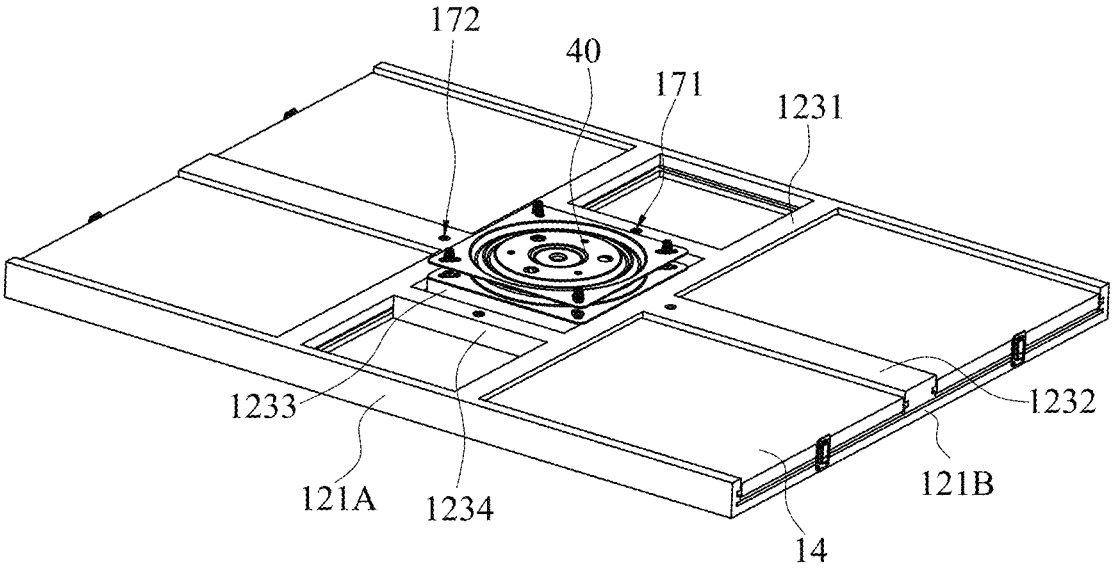
FIG. 14 is an illustrative isometric view of a puzzle board and a rotating assembly of the jigsaw puzzle table shown in FIG. 1.
Figure 15:
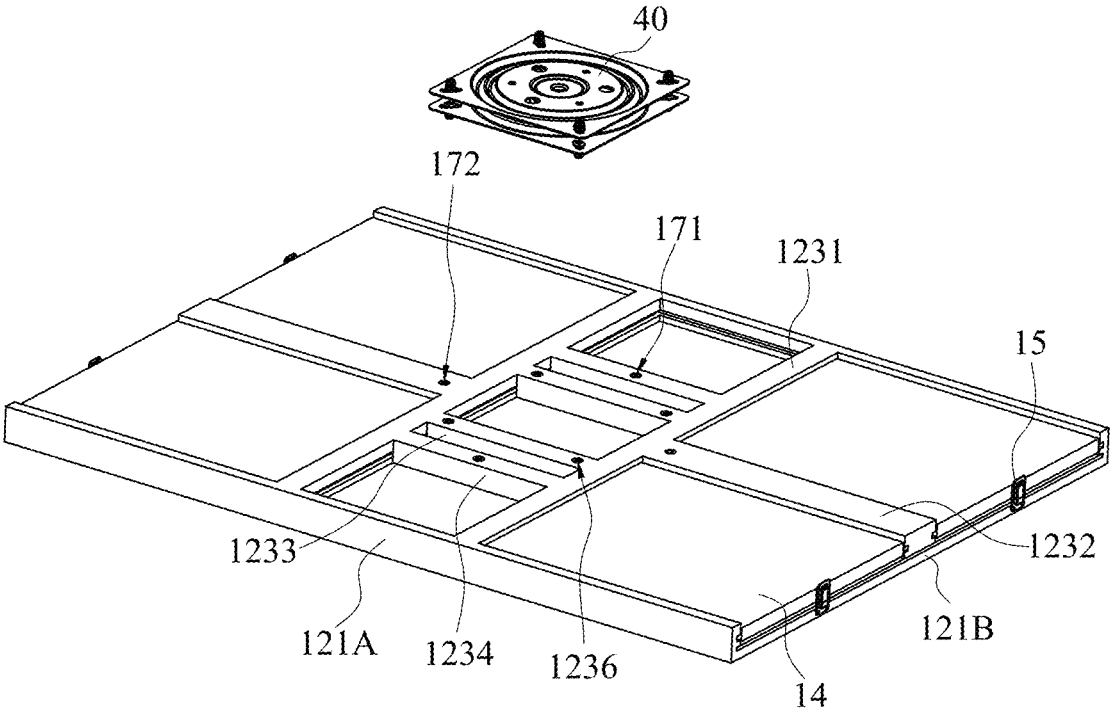
FIG. 15 is an exploded perspective view of the puzzle board and the rotating assembly.
Figure 16:
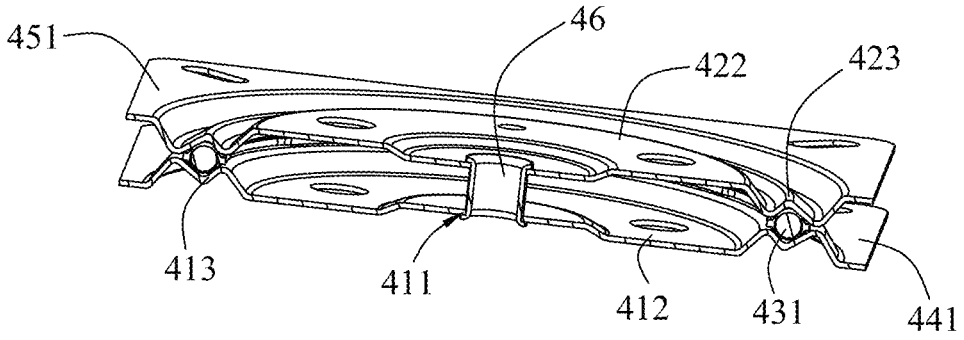
FIG. 16 is an illustrative cross-sectional view of the rotating assembly of the jigsaw puzzle table shown in FIG. 1.
Figure 17:
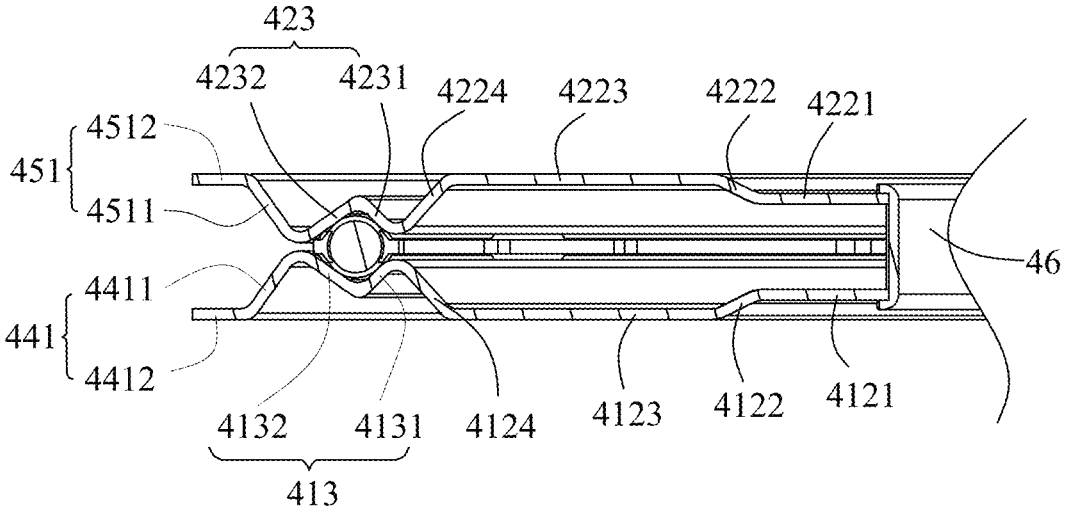
FIG. 17 is a front view of the rotating assembly shown in FIG. 16.
Figure 18:
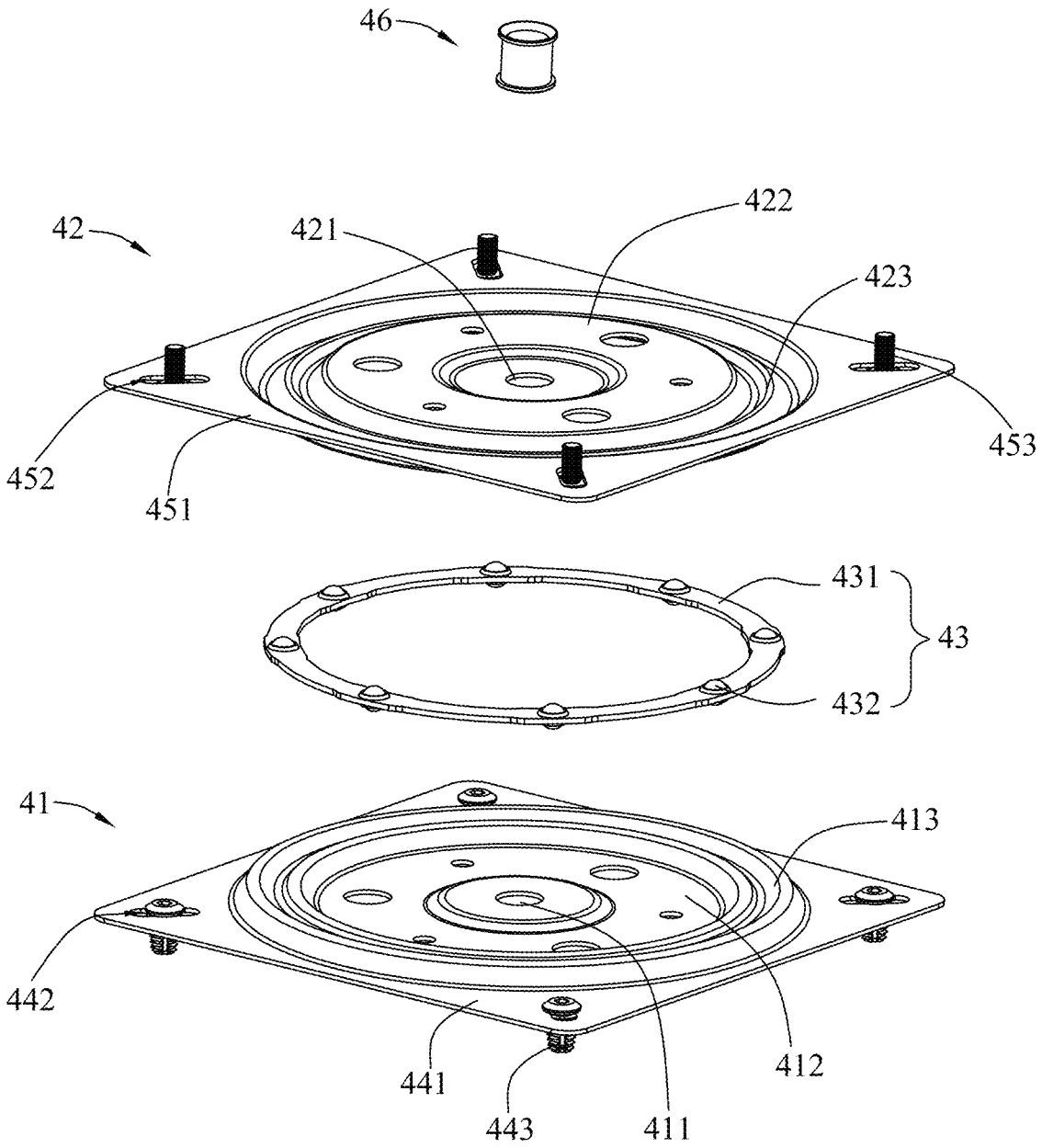
FIG. 18 is an exploded perspective view of the rotating assembly.
Figure 19:
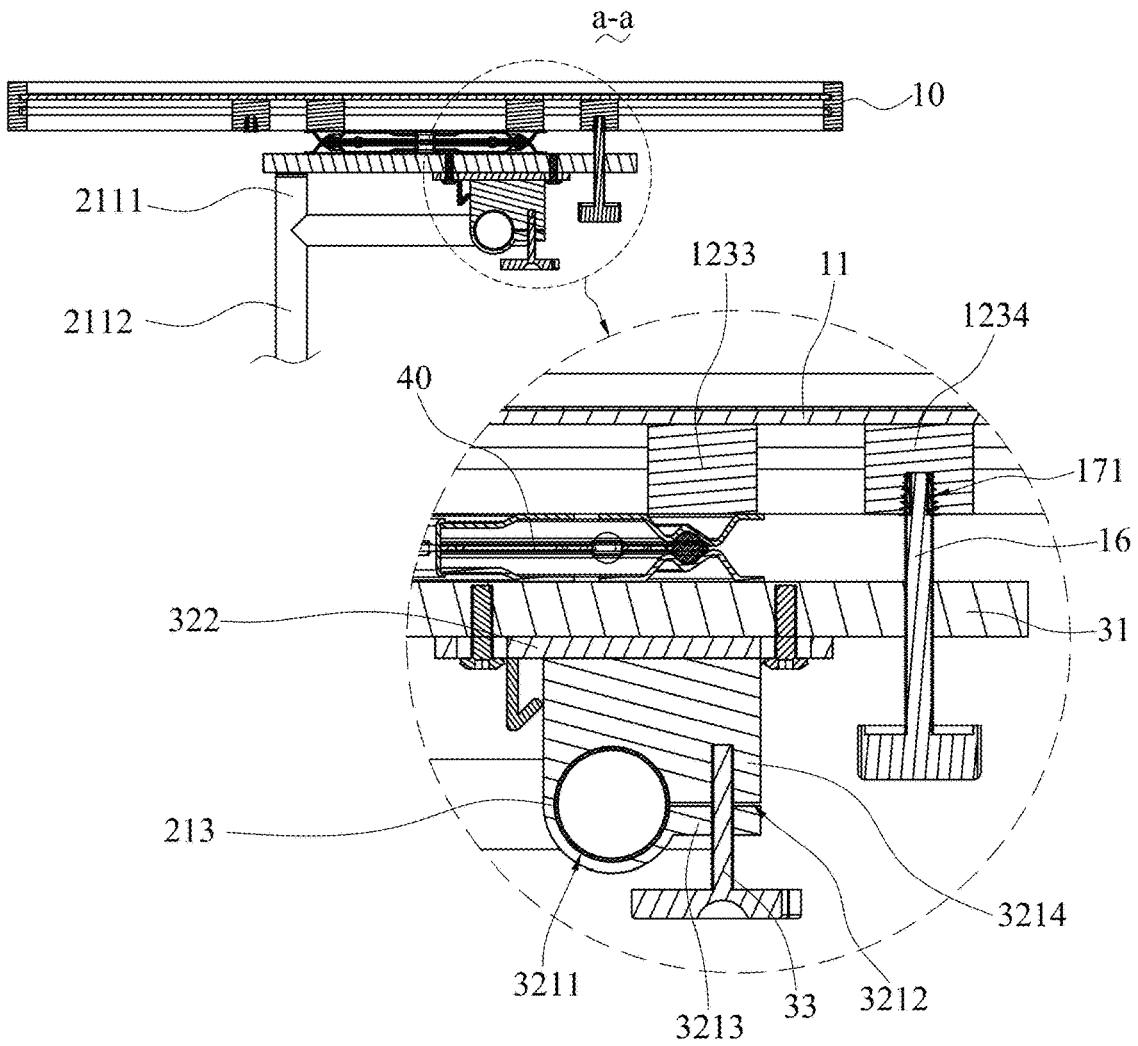
FIG. 19 is an illustrative cross-sectional view of the jigsaw puzzle table taken along line a-a of FIG. 1.
Figure 20:
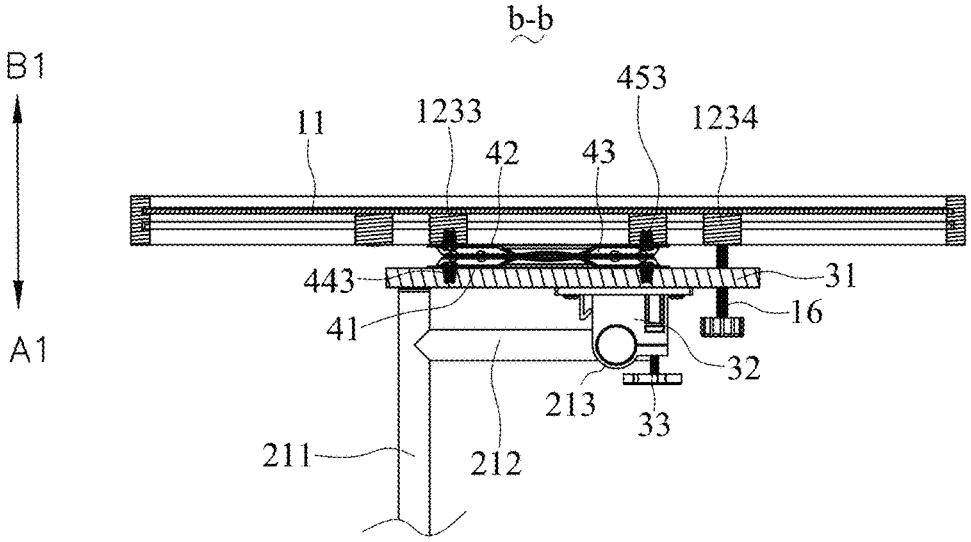
FIG. 20 is an illustrative cross-sectional view of the jigsaw puzzle table taken along line b-b of FIG. 1.
Figure 21:
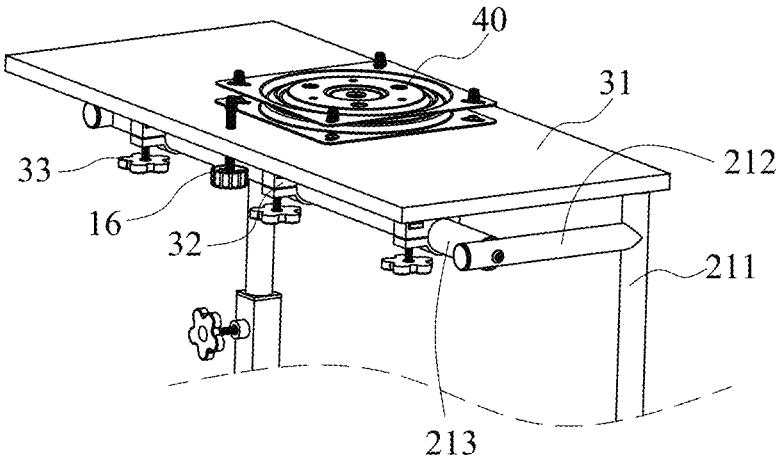
FIG. 21 is an illustrative isometric view of a rotating assembly, a supporting assembly, and an adjusting structure of the jigsaw puzzle table shown in FIG. 1, omitting a part of the supporting assembly.
Figure 22:
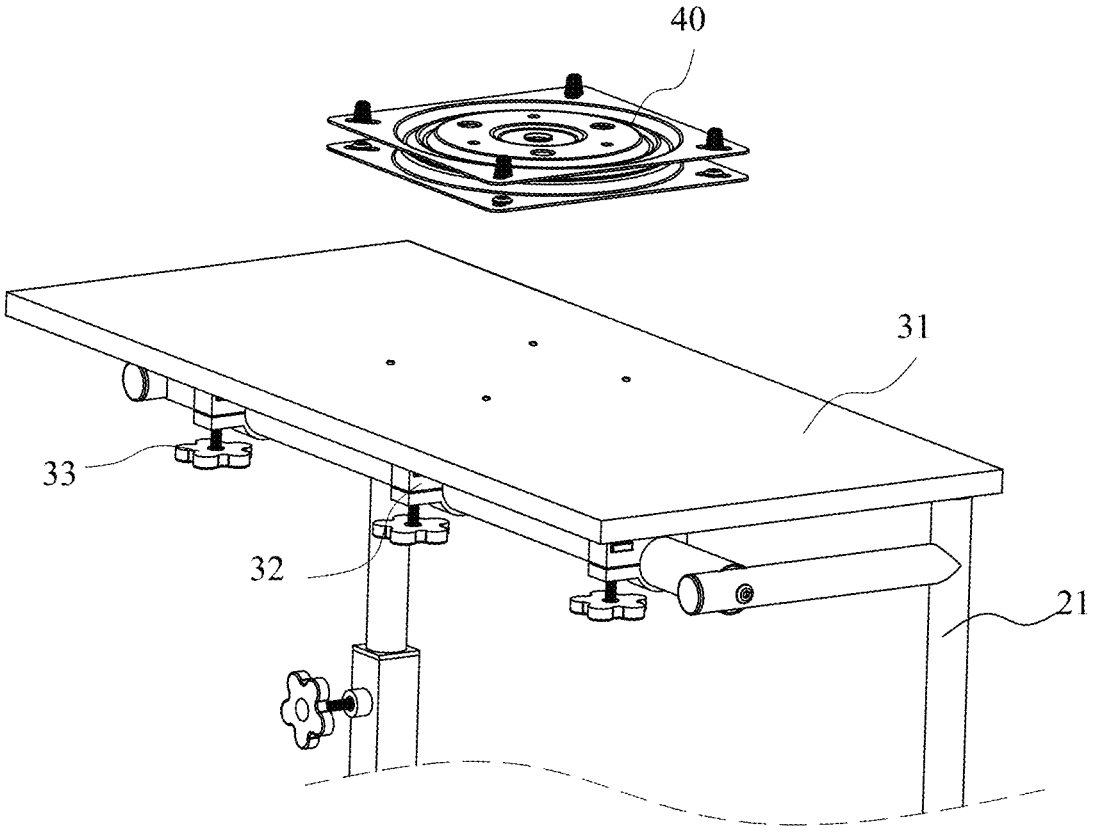
FIG. 22 is an exploded perspective view of the jigsaw puzzle table shown in FIG. 21.
Figure 23:
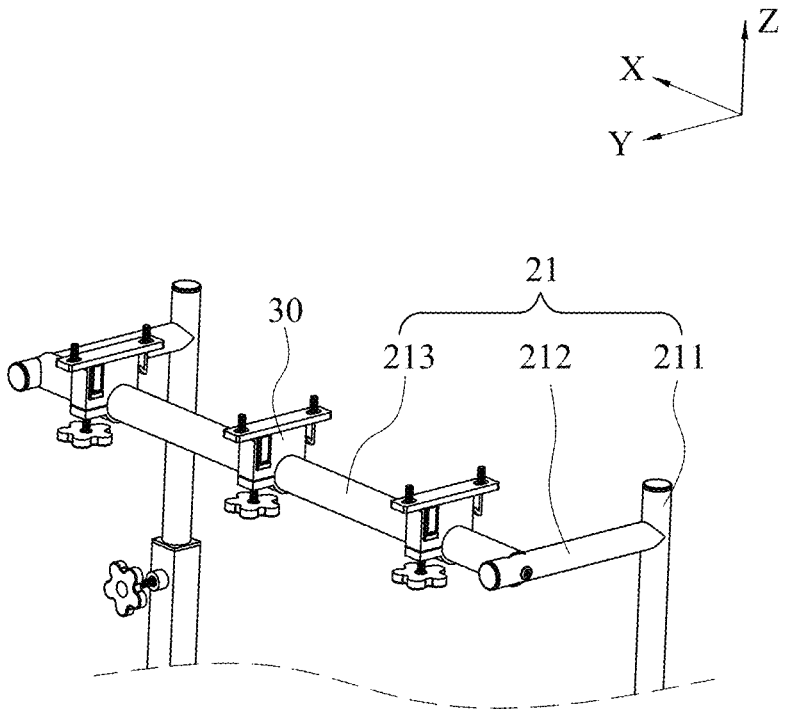
FIG. 23 is an illustrative isometric view of the supporting assembly and an adjusting portion of the adjusting structure shown in FIG. 21.
Figure 24:
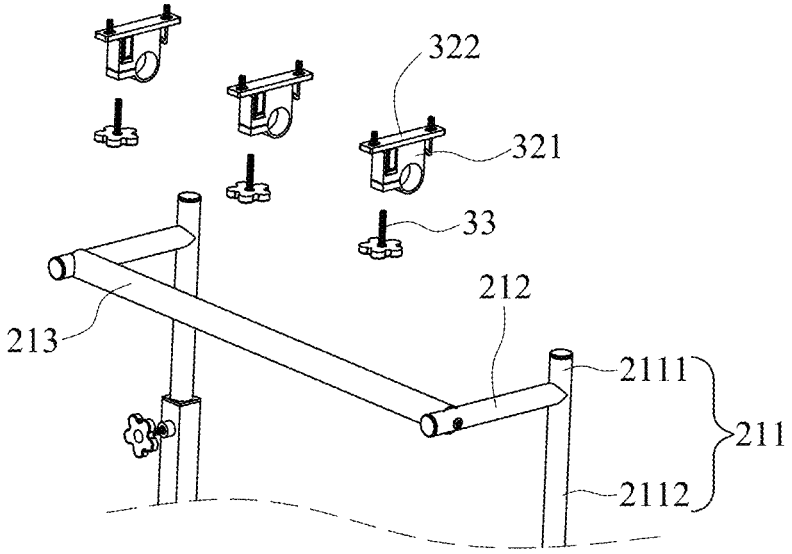
FIG. 24 is an exploded perspective view shown in FIG. 23.
Figure 25:
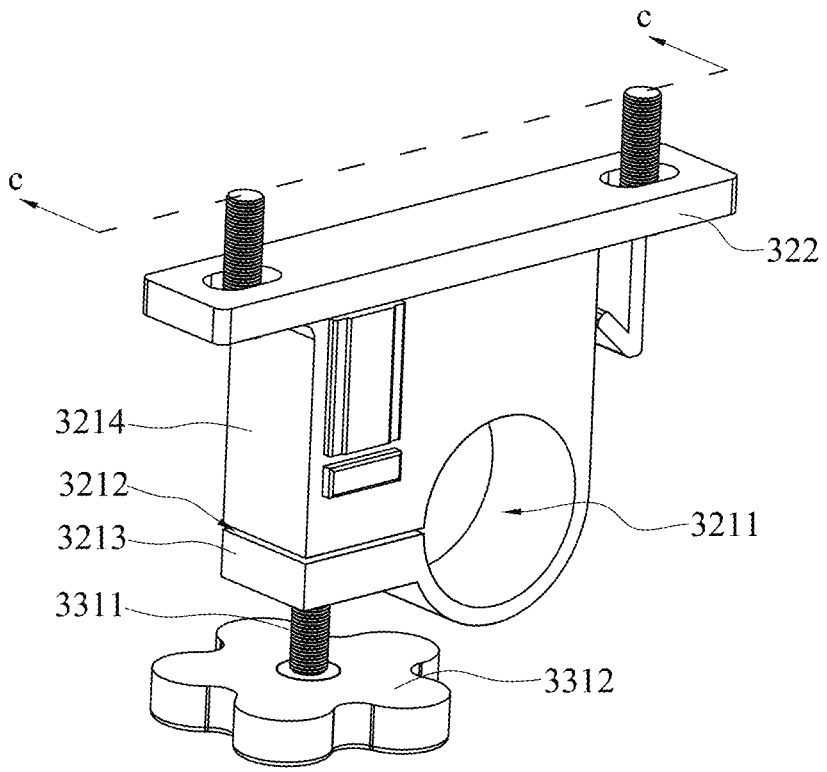
FIG. 25 is an illustrative isometric view of the adjusting portion shown in FIG. 23.
Figure 26:
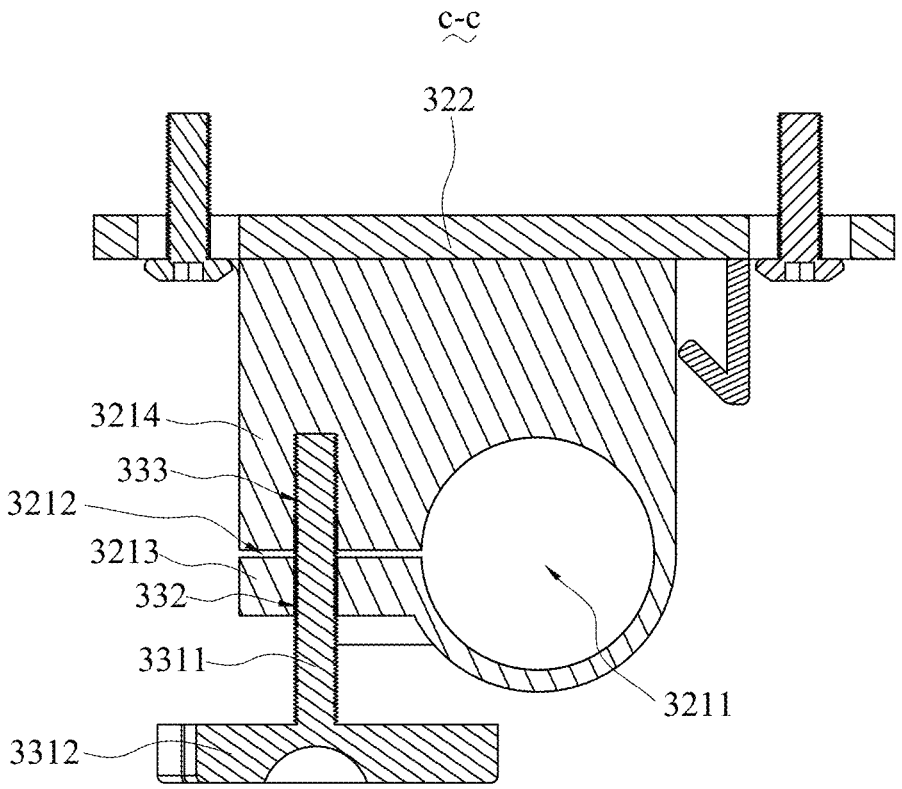
FIG. 26 is an illustrative cross-sectional view of the adjusting structure taken along line c-c of FIG. 25.
Figure 27:
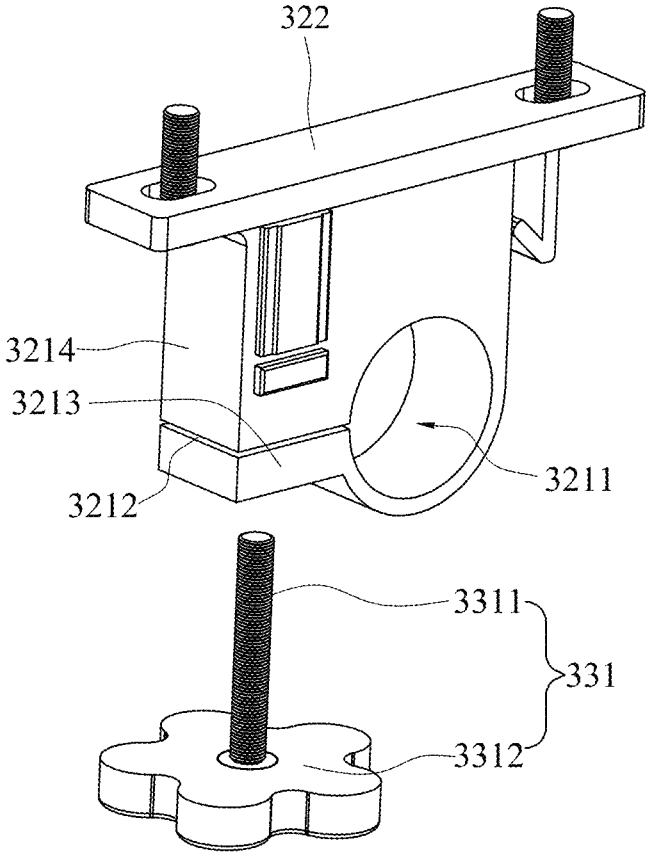
FIG. 27 is an exploded perspective view of the adjusting portion.
Figure 28:
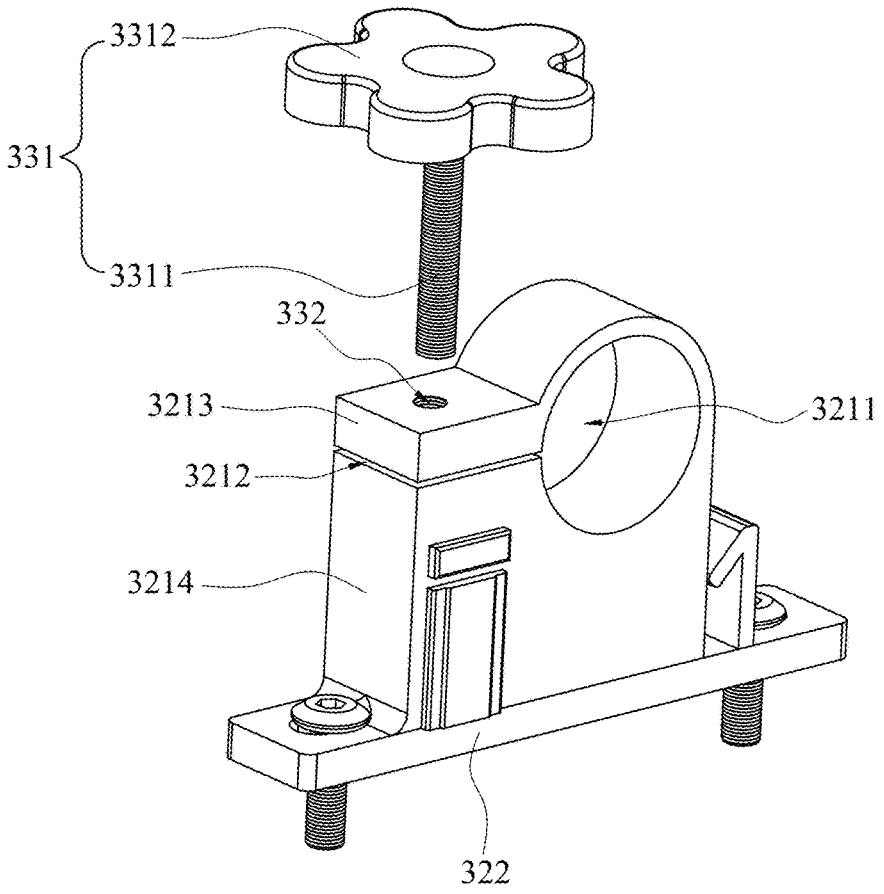
FIG. 28 is an exploded perspective view of the adjusting portion, viewed from a different angle.
Figure 29:
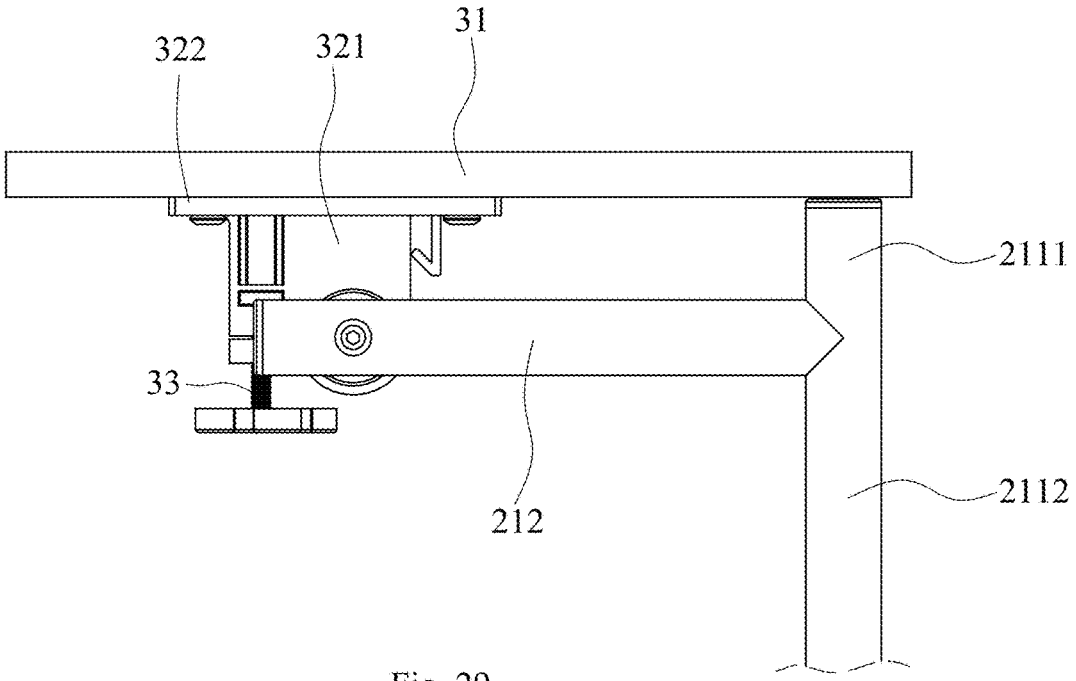
FIG. 29 is a side view of the adjusting structure and the supporting assembly, omitting a part of the supporting assembly.
Figure 30:
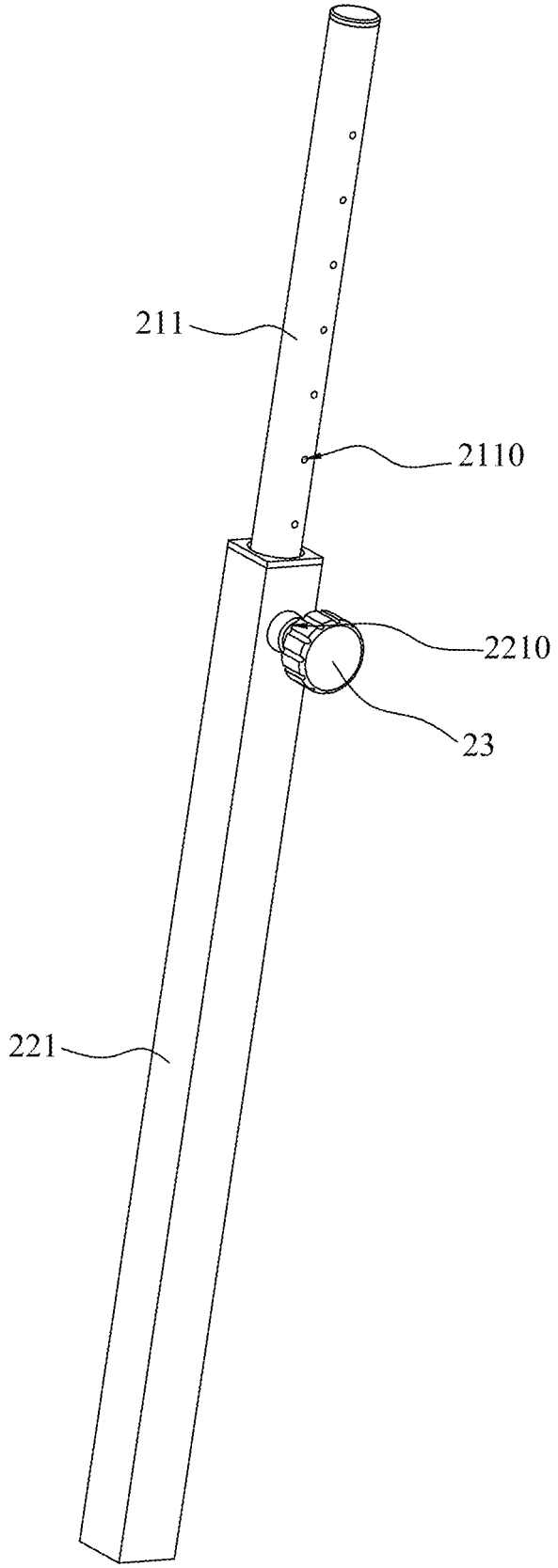
FIG. 30 is an illustrative isometric view of a supporting leg, an upper part, and a positioning fastener.
Figure 31:
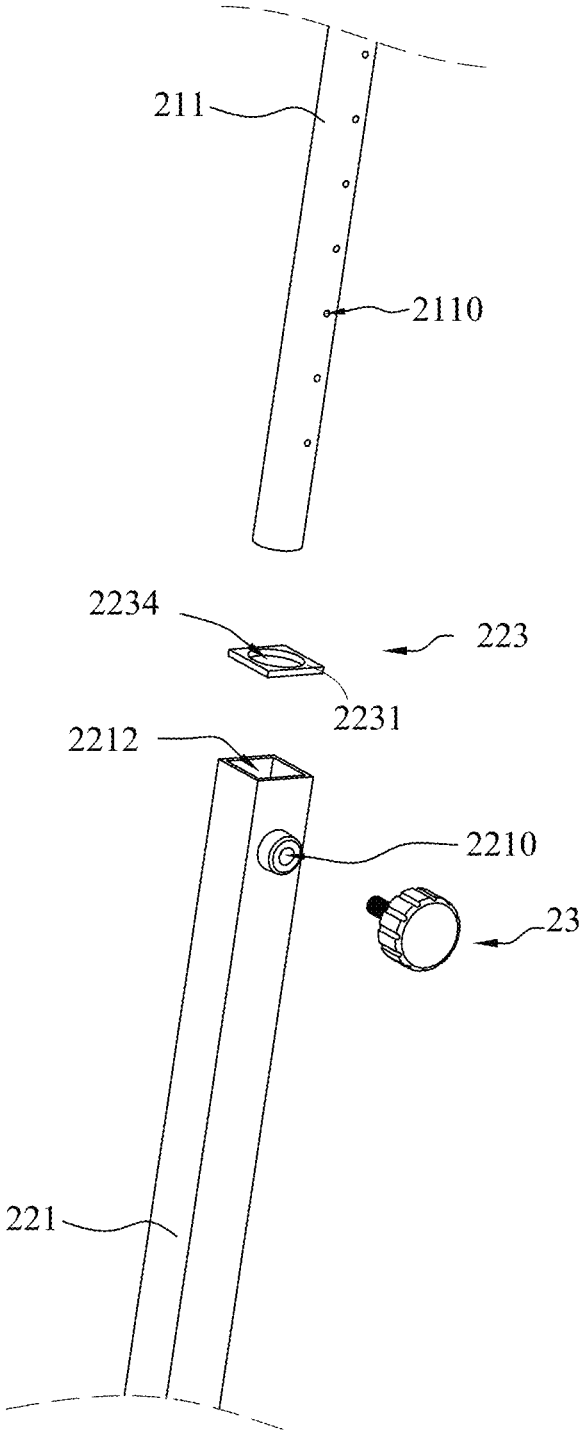
FIG. 31 is an exploded perspective view shown in FIG. 30.
Figure 32:
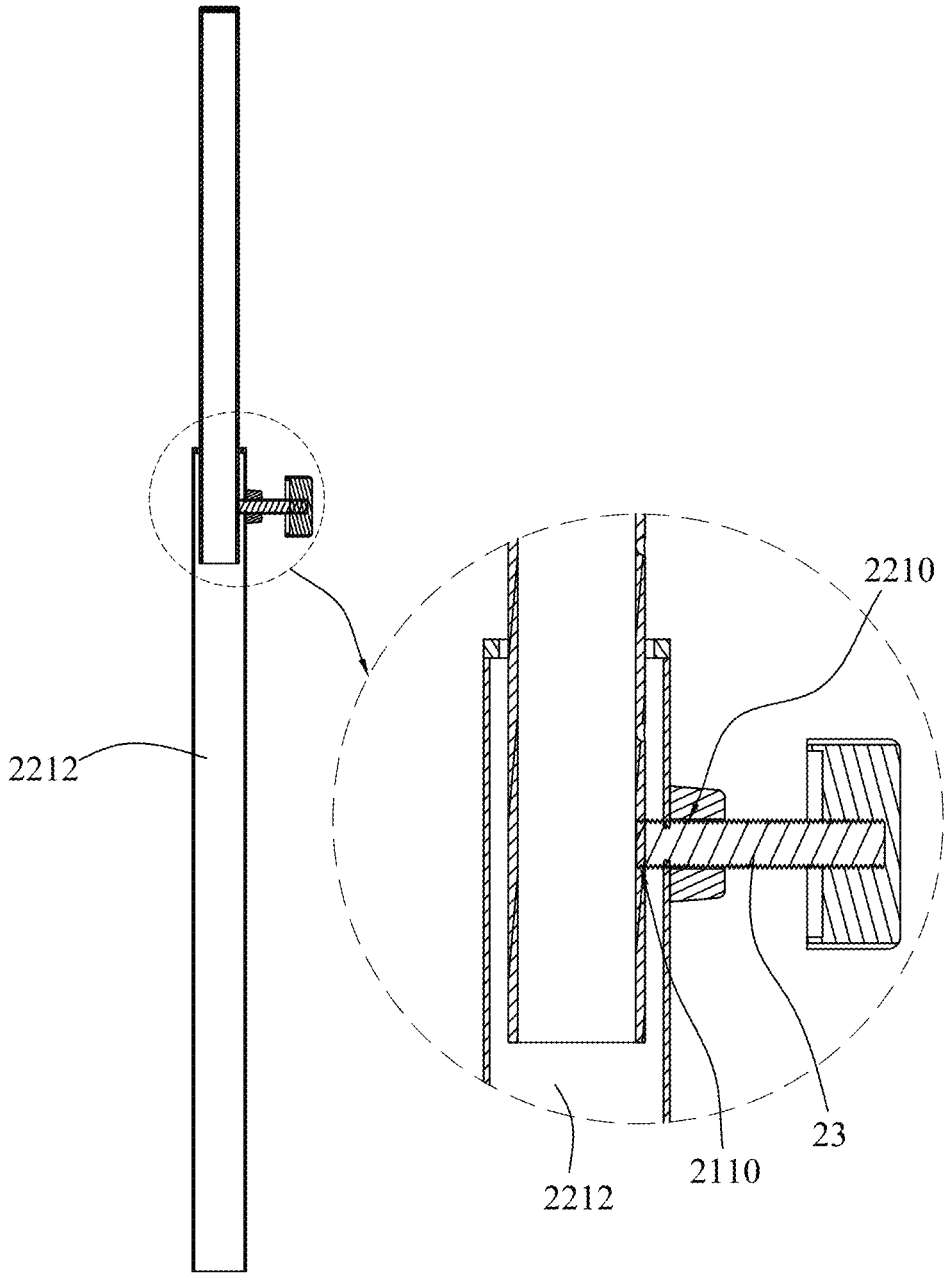
FIG. 32 is an illustrative cross-sectional view shown in FIG. 30.
Figure 33:
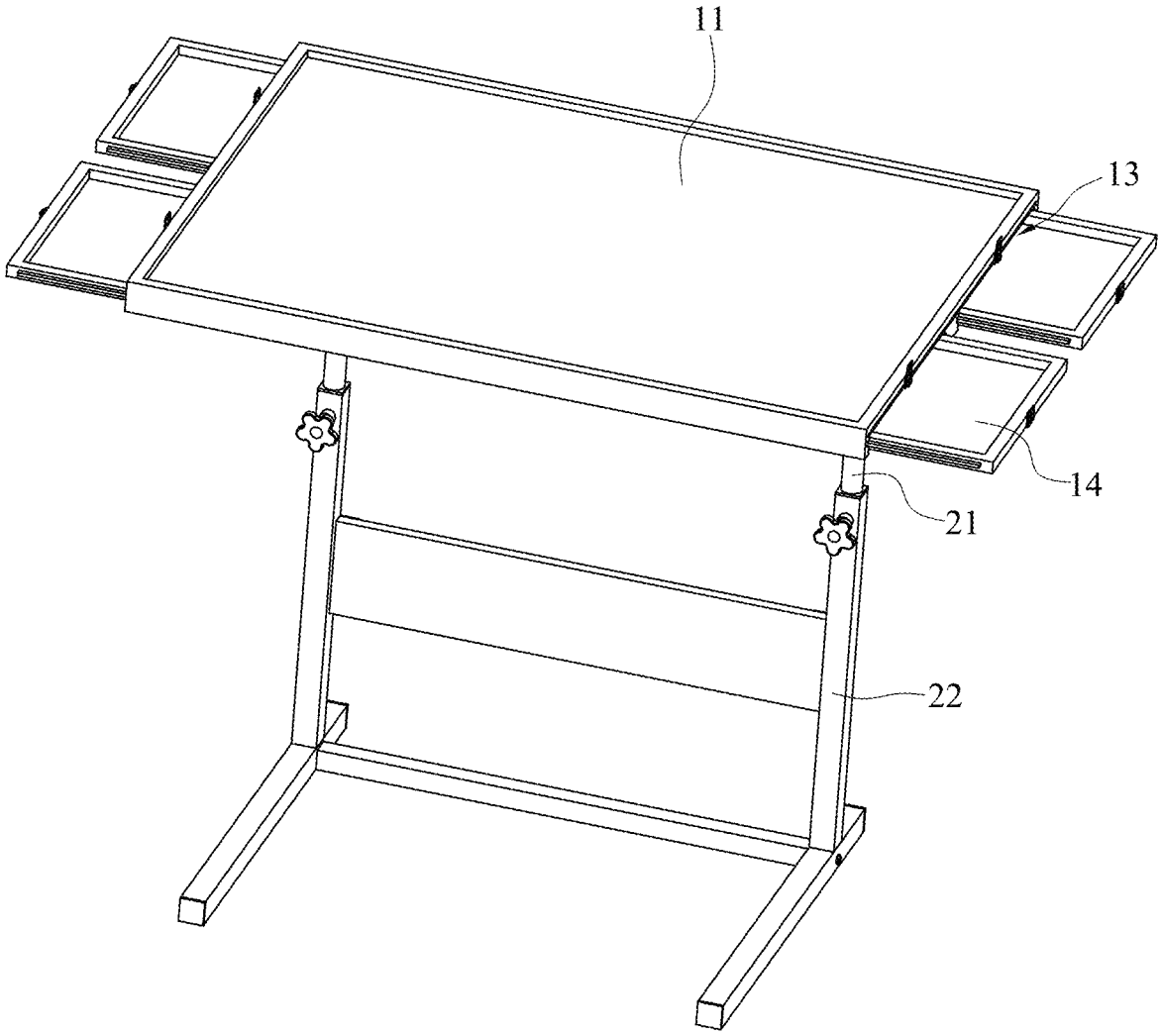
FIG. 33 is an illustrative isometric view of a state after opening a puzzle drawer in the jigsaw puzzle table shown in FIG. 1.
Figure 34:
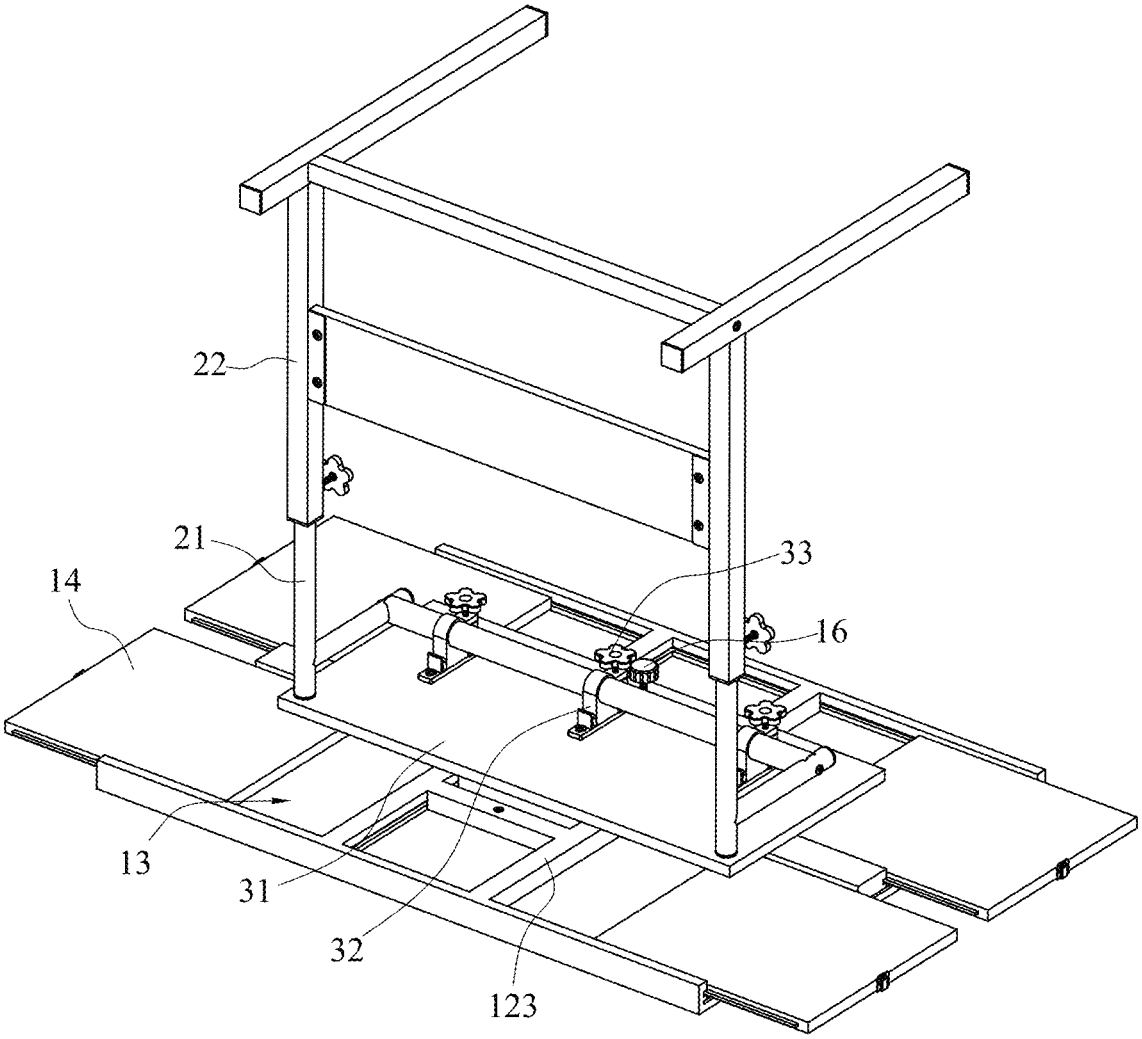
FIG. 34 is an illustrative isometric view shown in FIG. 33, viewed from a different angle.
Figure 35:
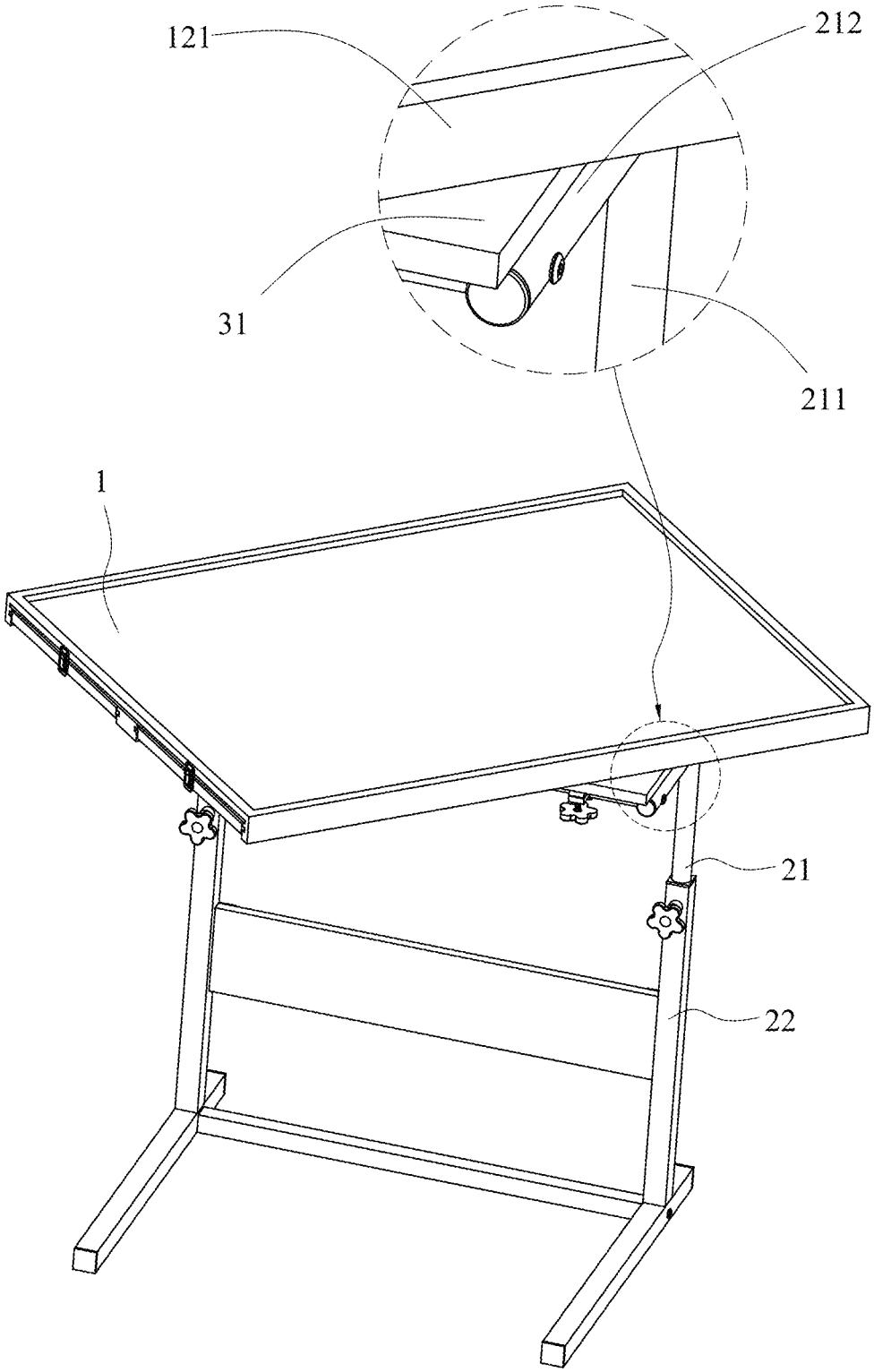
FIG. 35 is an illustrative isometric view of a rotating state of the jigsaw puzzle table shown in FIG. 1.
Figure 36:
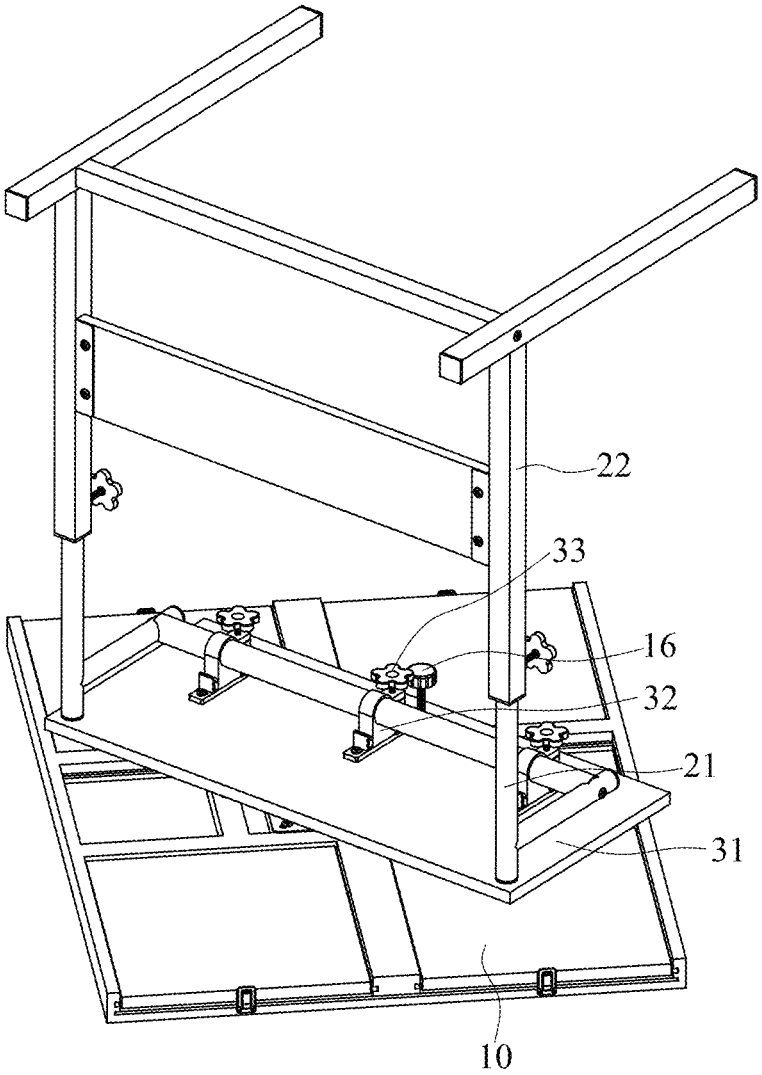
FIG. 36 is an illustrative isometric view shown in FIG. 35, viewed from a different angle.
Figure 37:
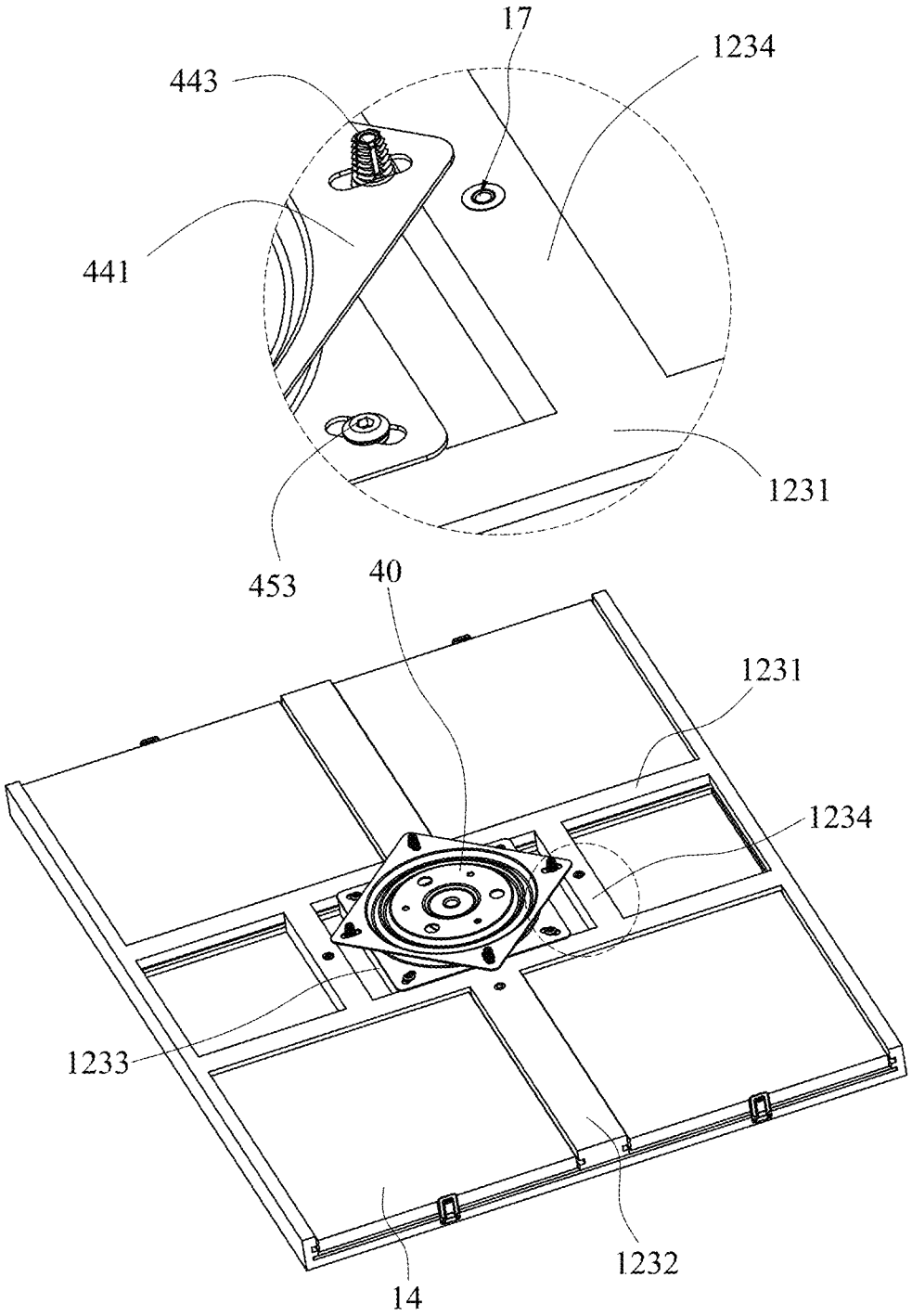
FIG. 37 is an illustrative isometric view of the puzzle board and the rotating assembly shown in FIG. 35.
Figure 38:
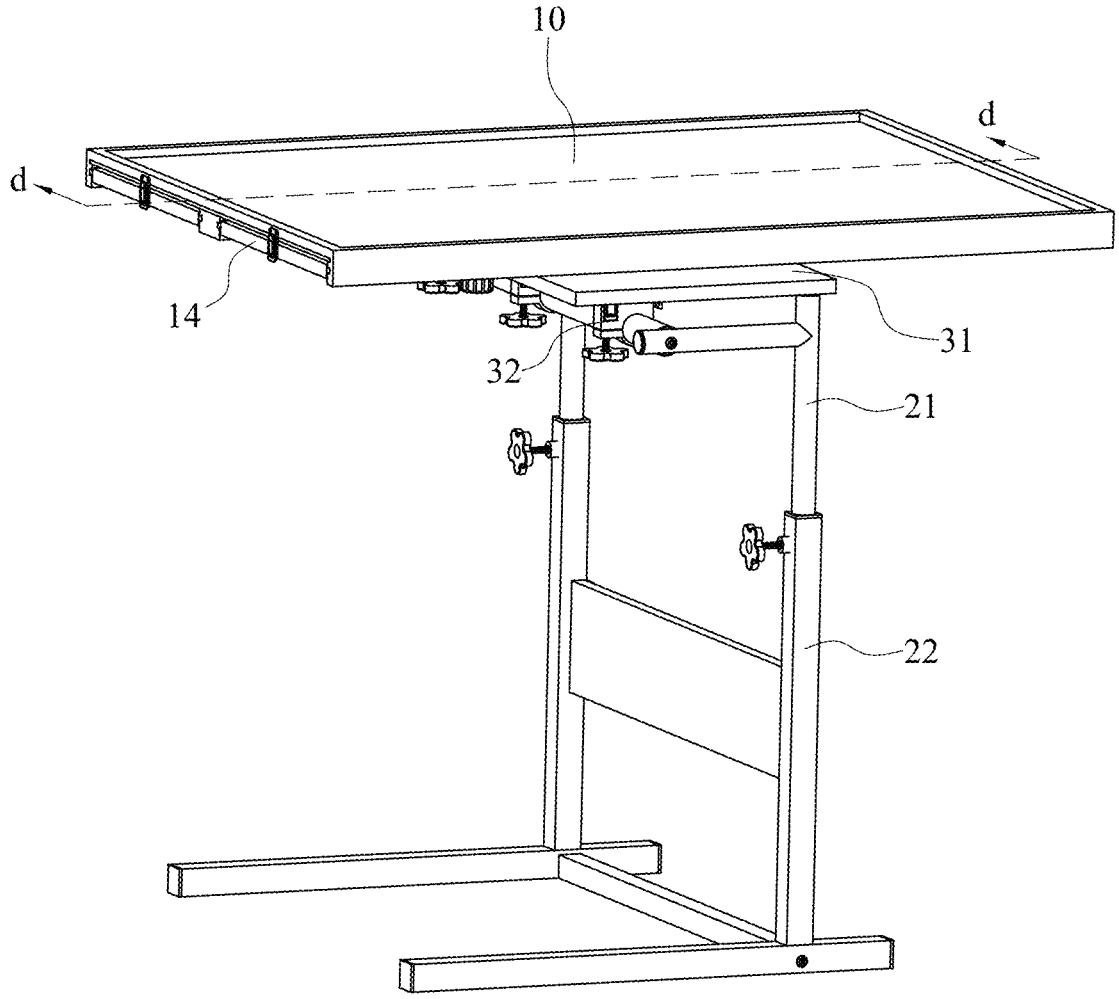
FIG. 38 is an illustrative isometric view of the jigsaw puzzle table in a horizontal lateral state shown in FIG. 1.
Figure 39:
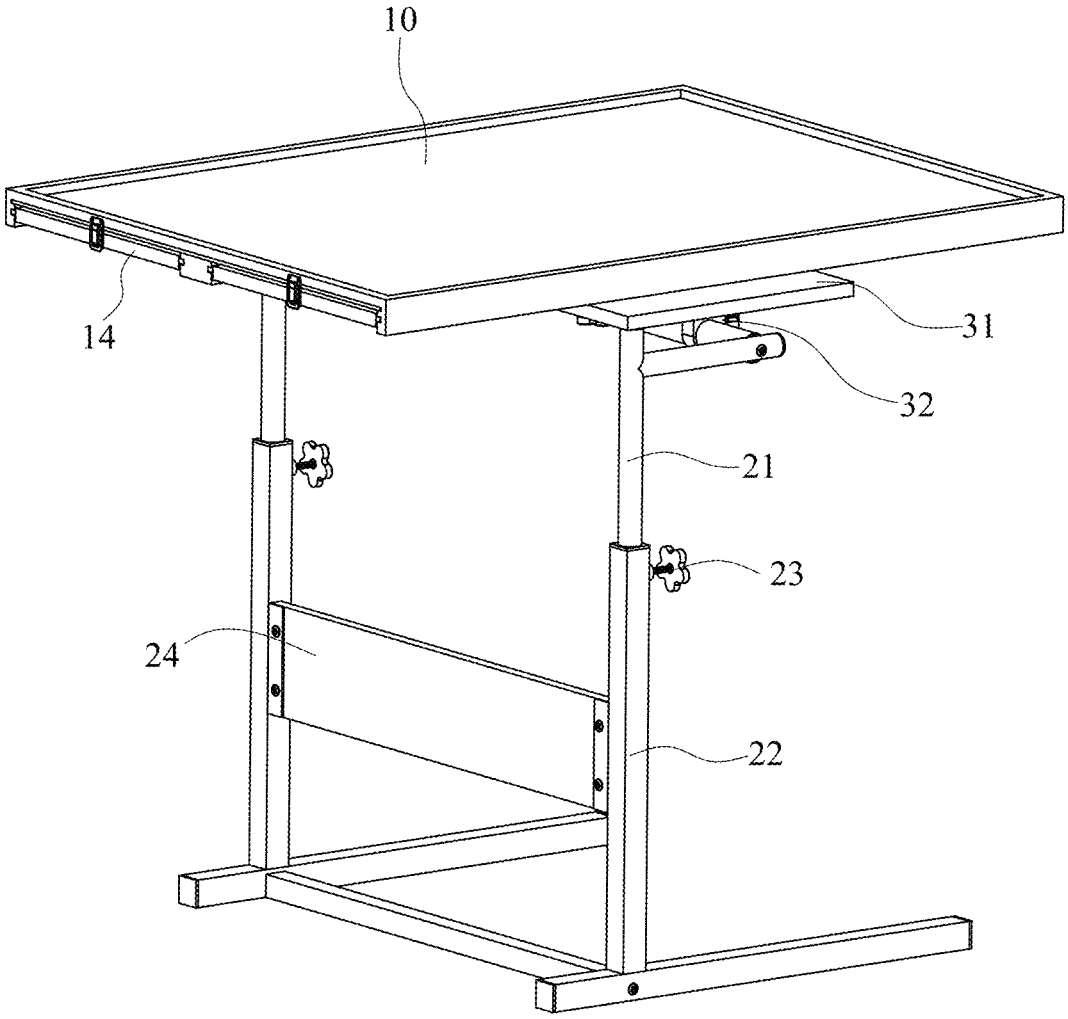
FIG. 39 is an illustrative isometric view shown in FIG. 38, viewed from a different angle.
Figure 40:
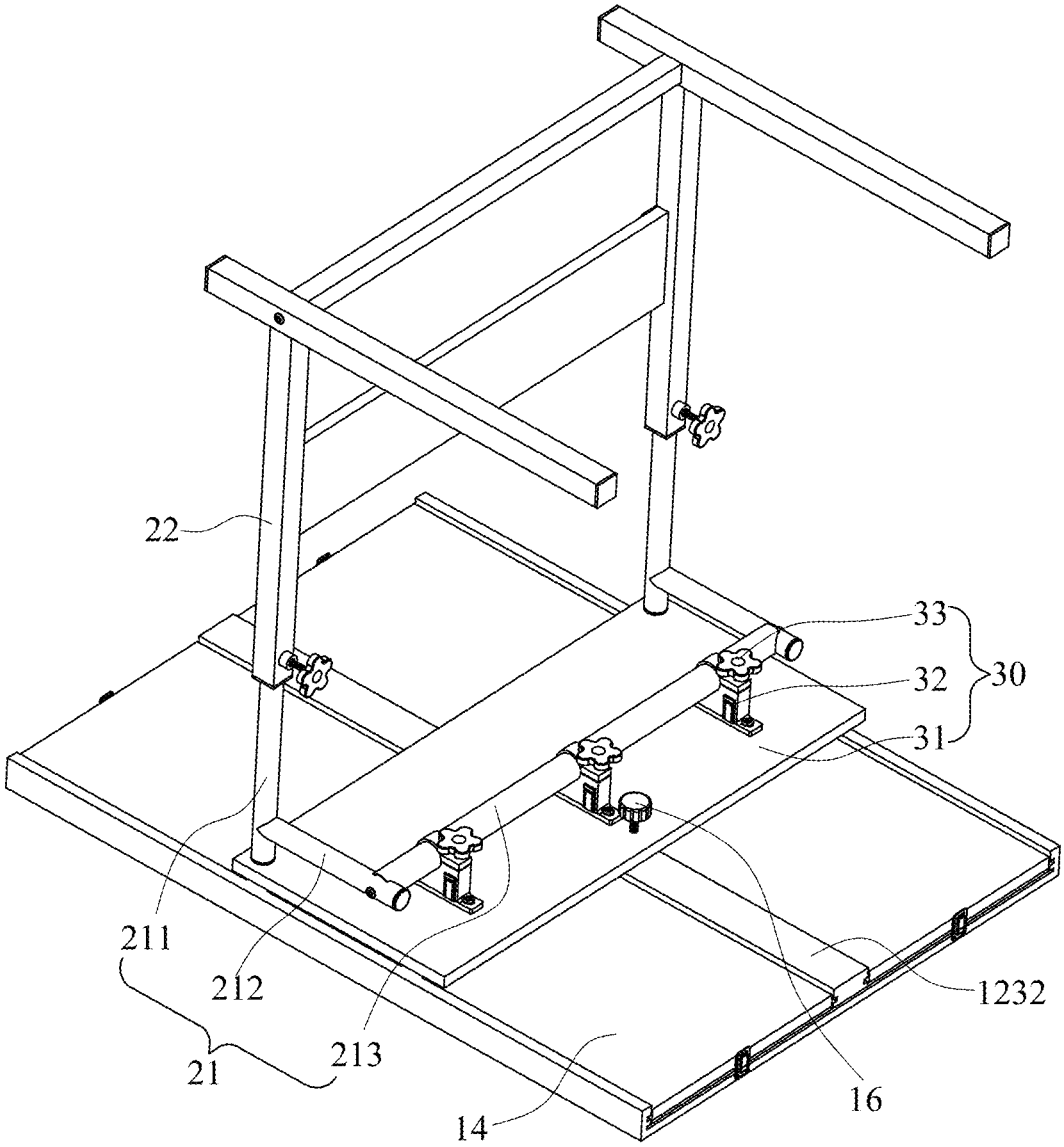
FIG. 40 is an illustrative isometric view shown in FIG. 38, viewed from a third angle.
Figure 41:
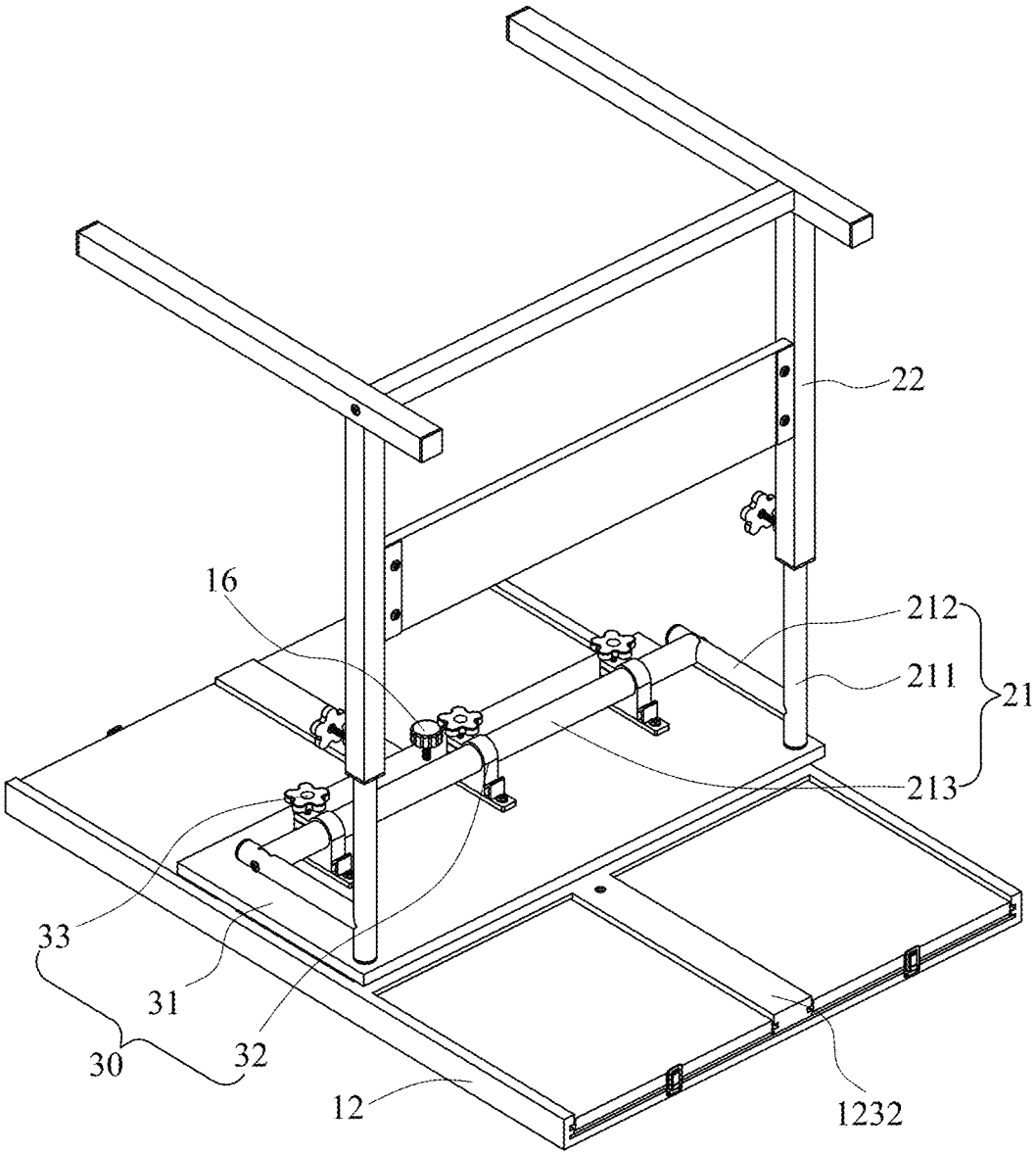
FIG. 41 is an illustrative isometric view shown in FIG. 38, viewed from a fourth angle.
Figure 42:
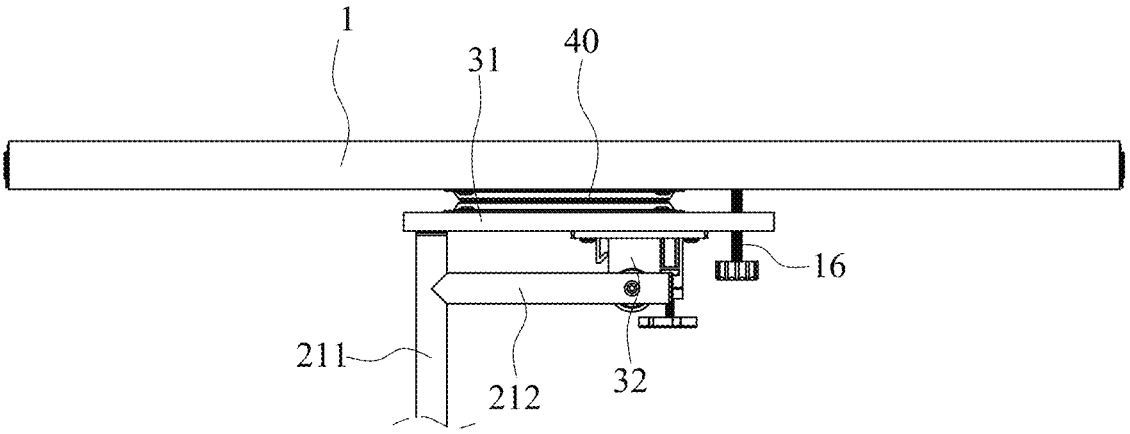
FIG. 42 is a side view of the structure shown in FIG. 38, omitting a part of the supporting assembly.
Figure 43:
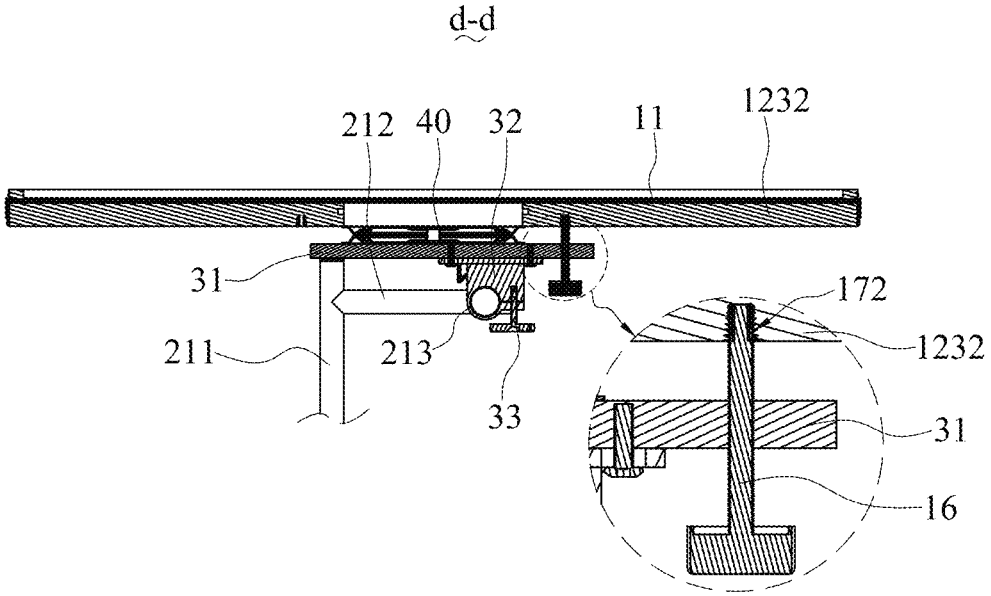
FIG. 43 is an illustrative cross-sectional view of the jigsaw puzzle table taken along line d-d of FIG. 38.
Figure 44:
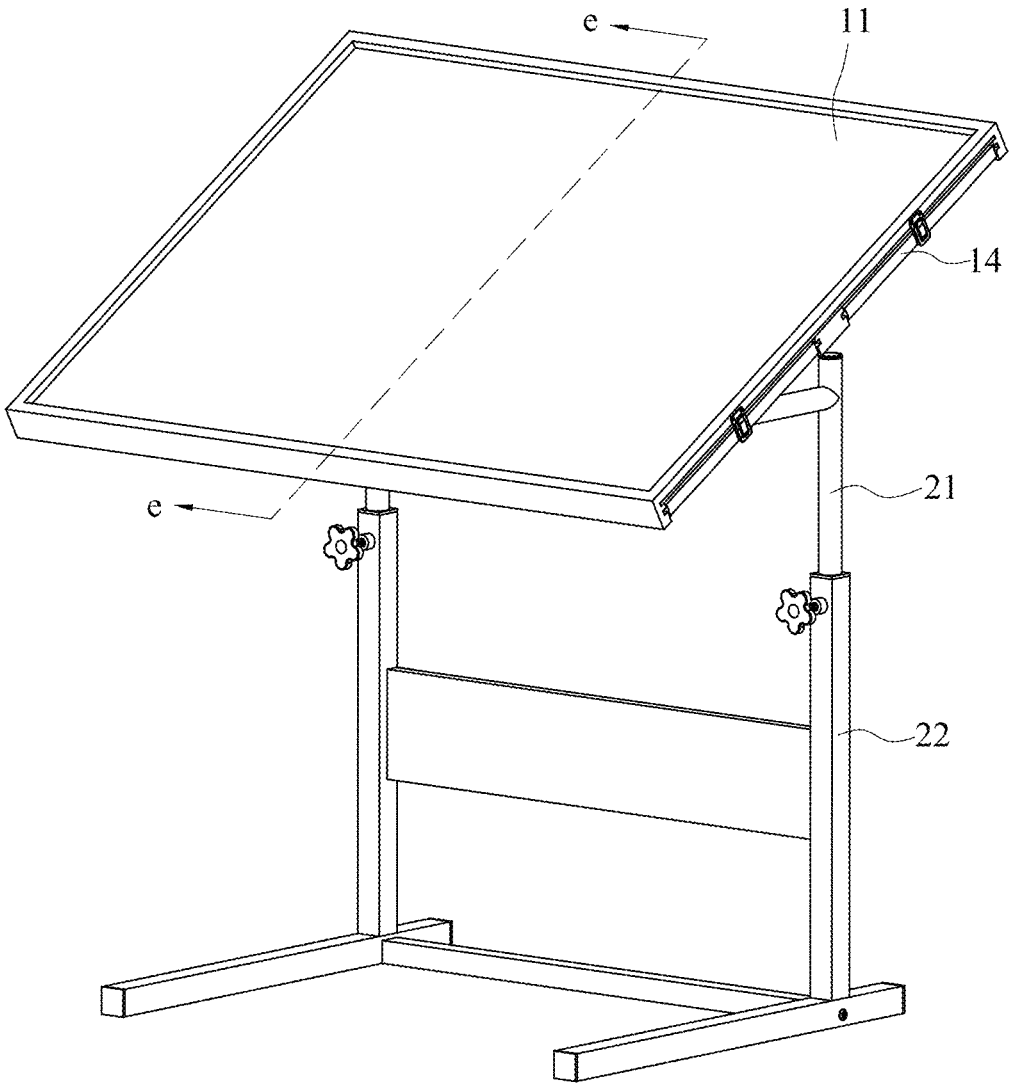
FIG. 44 is an illustrative isometric view of the jigsaw puzzle table in an inclined longitudinal state shown in FIG. 1.
Figure 45:
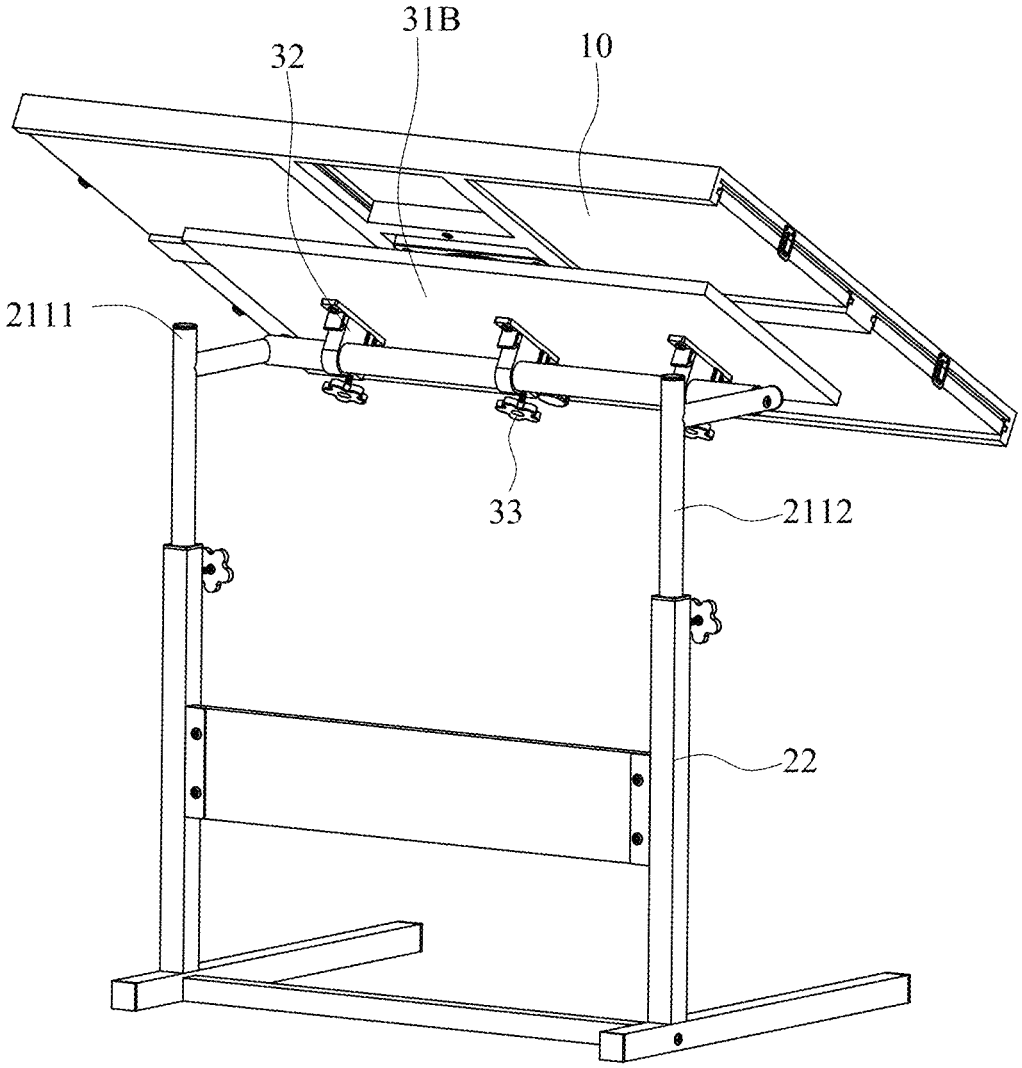
FIG. 45 is an illustrative isometric view shown in FIG. 44, viewed from a different angle.
Figure 46:
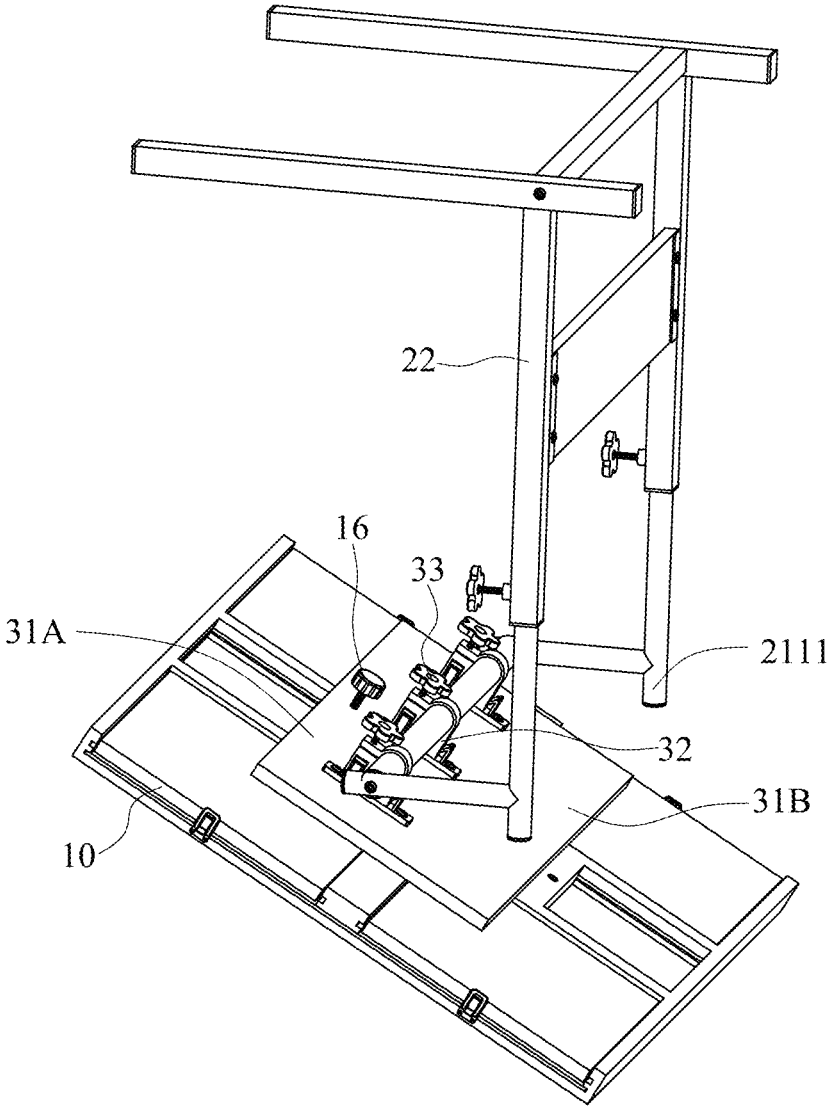
FIG. 46 is an illustrative isometric view shown in FIG. 44, viewed from a third angle.
Figure 47:
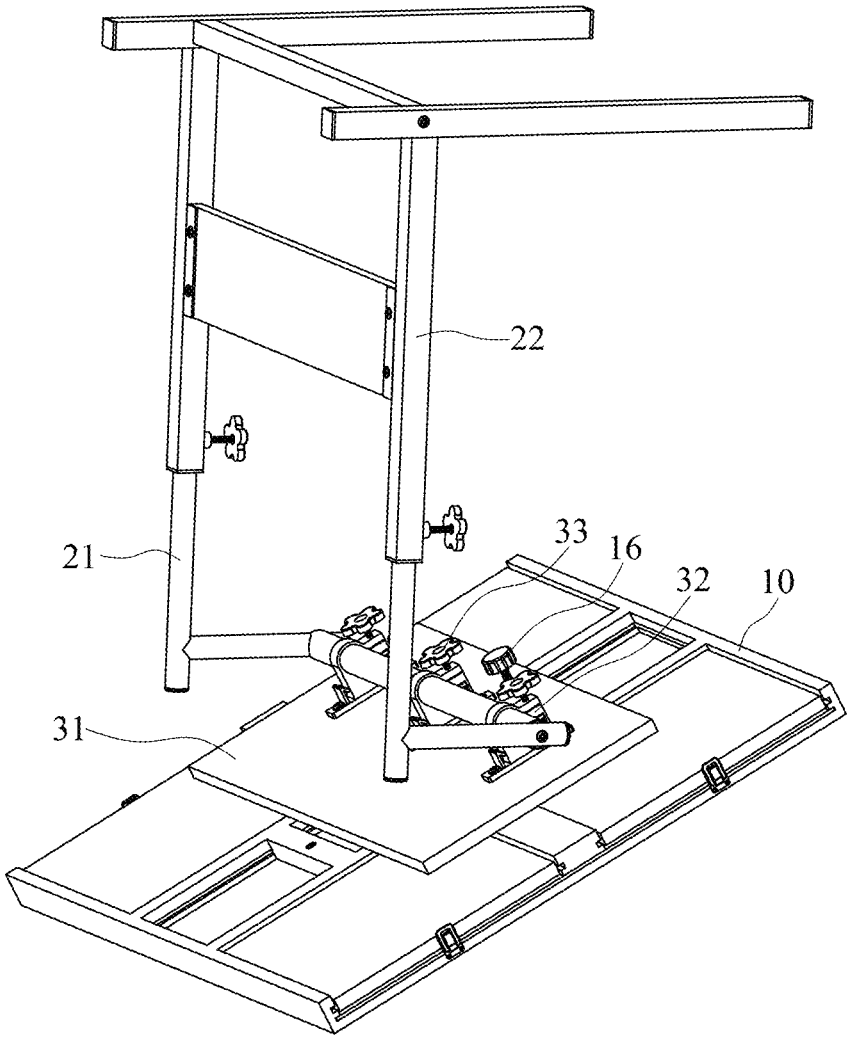
FIG. 47 is an illustrative isometric view shown in FIG. 44, viewed from a fourth angle.
Figure 48:
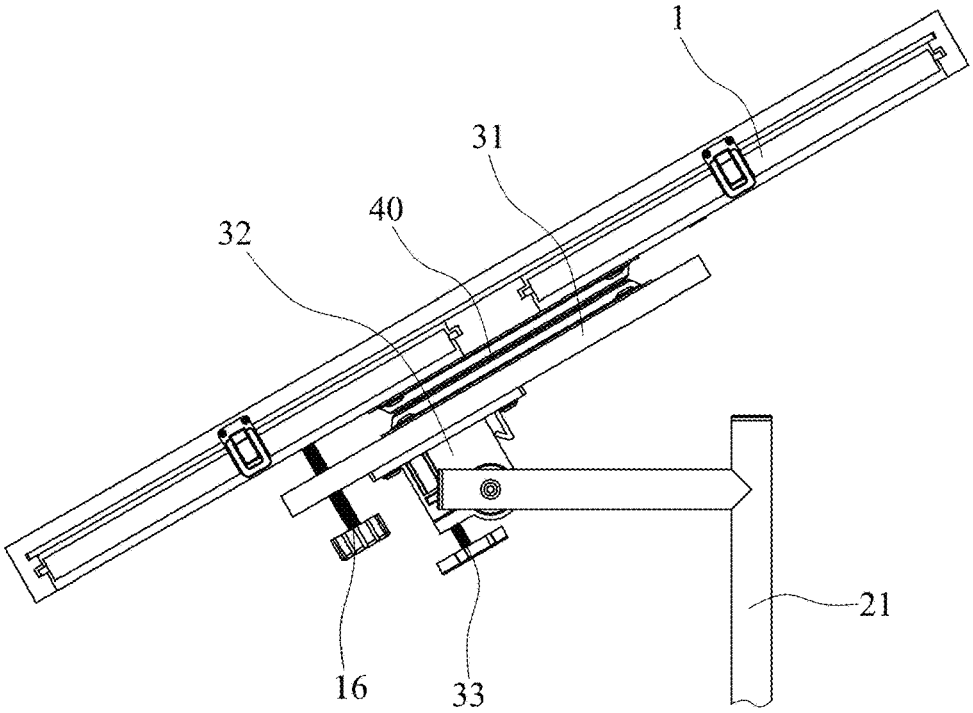
FIG. 48 is the side view of the structure shown in FIG. 44, omitting a part of the supporting assembly.
Figure 49:
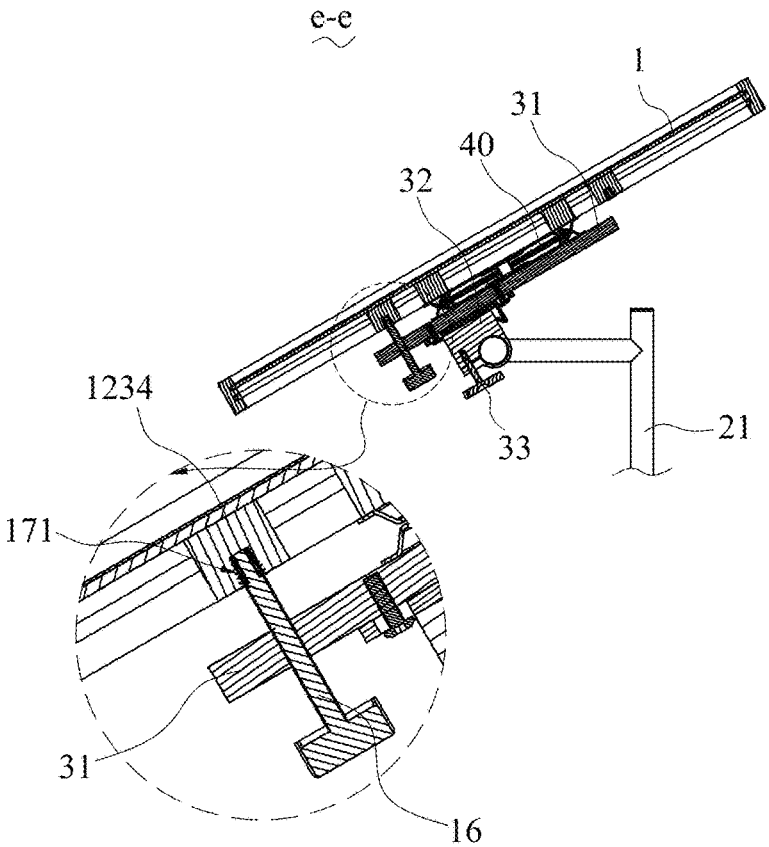
FIG. 49 is an illustrative cross-sectional view of the jigsaw puzzle table taken along line e-e of FIG. 44.

In order to facilitate understanding of the present invention, the present invention will be fully described below by referring to the accompanying drawings. The accompanying drawings show preferred embodiments of the present invention. However, the present invention may be realized in various forms, which are not limited to the embodiments described herein. The embodiments are provided to enable the present invention to be understood more thoroughly and comprehensively.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present invention and to simplify the descriptions, rather than to indicate or imply that the referred device or element must apply specific direction or to be operated or configured in specific direction. Therefore, the above-mentioned terminologies shall not be interpreted as confine to the present invention.

It is understandable that the term "a" should be understood as "at least one" or "one or more". In other words, in one embodiment, the number of an element may be one and in other embodiment the number of the element may be greater than one. The term "a" is not construed as a limitation of quantity.

In the description of the present invention, it should be noted that the terms "mounted," "connected," and "linked" should be understood in a general manner, which could be, for example, affixedly connected, detachably connected, or integrally connected. Unless expressly specified and defined otherwise, it may also be a mechanical connection, an electrical connection or may be in communication with each other; it may be directly connected or indirectly connected by means of an intermediate medium, and may be an interaction relationship between two or more elements inside the two elements. For a person of ordinary skill in the art, the specific meanings of the above terms in the present invention may be understood according to specific situations.

It should be noted that when an element is "fixed" to another element, it means that the element is directly arranged on the element, or an intermediate element is arranged therebetween. When an element is "connected" to another element, it means that the element is directly connected to the element, or an intermediate element is arranged therebetween. Furthermore, the term "and/or" is merely a description of an associative relationship between associated objects and indicates that three relationships may exist. For example, A and/or B means that A exists alone, both A and B exist, and B exists alone.

Unless otherwise defined, all technical and scientific terms used herein have the same meaning as commonly understood by any ordinary skilled person in the art. Terms in the specification of the present invention are used only for the illustrative purposes only. For example, "in," "out," "left," "right," and similar expressions are used for illustrative purposes only, and are not intended to limit the present invention.

Shown in FIGS. 1 to 49, schematic views of the jigsaw puzzle table 1000 from a first embodiment of the present invention are presented. The jigsaw puzzle table 1000 is designed for a user or player to assemble a plurality of puzzle pieces 200 thereon. Accordingly, the jigsaw puzzle table 1000 comprises a board assembly 10, a supporting assembly 20 supporting the board assembly 10, and an adjusting structure 30 located below the board assembly 10 and mounted on the supporting assembly 20. The jigsaw puzzle table 1000 may be placed in any playing space, such as on a table, wall, floor, or similar structure. The supporting assembly 20 supports the board assembly 10 relative to the playing space. The height of the supporting assembly 20 is adjustable, allowing a distance between the board assembly 10 and the user to be modified. The adjusting structure 30 is capable of adjusting a posture of the board assembly 10 relative to the user, enabling the adjusting structure 30 to support the board assembly 10 in either a horizontal state or an inclined state, and allowing the board assembly 10 to switch between the horizontal state and the inclined state.

The board assembly 10 comprises a puzzle board 1 for assembling a plurality of puzzle pieces 200 and a rotating assembly 40 attached to the puzzle board 1 for supporting the puzzle board 1. The rotating assembly 40 drives the puzzle board 1 to rotate in any direction, thereby changing positions of the puzzle board 1 relative to the user.

Due to the need to assemble the puzzle pieces 200 into a complete image, it is essential for an orientation of the puzzle pieces 200 to be aligned with the user's viewpoint to facilitate more effective puzzle operations. In a related jigsaw puzzle table, the positioning of the jigsaw puzzle table is fixed, offering only a specific puzzle position that is regarded as an optimal viewpoint. When the size of the jigsaw puzzle table exceeds the user's arm length, making it impossible to reach the puzzle pieces 200 located on the opposite side of the optimal viewpoint, the user must walk around to assemble the puzzle pieces 200 and then return to the original optimal viewpoint. In this situation, forces users are to adapt to the structural characteristics of the product, which significantly diminishes their experience of using the jigsaw puzzle table.

The present invention provides the rotating assembly 40, allowing the orientation of the jigsaw puzzle table 1000 to be adjusted flexibly. This means that the optimal viewpoint may be adjusted in real-time according to the location of the user currently working on the puzzle pieces 200, without requiring the user to move. Particularly during collaborative sessions involving multiple users, this rotatable design enables different users to switch their optimal viewpoint of the jigsaw puzzle table, allowing each user to maintain the optimal viewpoint, which significantly enhances both efficiency and user experience. Furthermore, when the jigsaw puzzle table 1000 is large, the optimal viewpoint on the opposite side may also be rotated to face the user directly. After accessing the puzzle pieces 200, the user may rotate it back to its original position without needing to walk around. Therefore, the rotating assembly 40 fundamentally alters the structural characteristics of the related jigsaw puzzle table 1000, enabling the product to adapt to user habits and greatly improving the overall user experience.

Referring to FIGS. 1-5, the puzzle board 1 comprises a puzzle plate 11 and a fixing frame 12 supporting the puzzle plate 11. The puzzle plate 11 serves as an area for assembling the puzzle pieces 200 and where users perform their puzzle operations. Both the adjusting structure 30 and the rotating assembly 40 are located on a backside of the puzzle plate 11. The puzzle plate 11 is a rectangular planar structure that comprises two longer edges 11A extending along a longitudinal direction X and two shorter edges 11B extending along a lateral direction Y. The longitudinal direction X is perpendicular to the lateral direction Y.

Referring to FIGS. 4-5 and 9-11, the fixing frame 12 comprises a fixing portion 121, a hollow space 122 surrounded by the fixing portion 121, and a reinforcing portion 123 located within the hollow space 122 and connected to the fixing portion 121. The puzzle plate 11 is received in the hollow space 122 and is supported by the reinforcing portion 123. The puzzle plate 11 and the fixing frame 12 may be assembled together using threads, snap-fit, friction fit, screws, rivets, ultrasonic welding, adhesive bonding, or other similar methods. The fixing portion 121 is a circular structure that matches the shape of the puzzle plate 11, thereby enhancing the overall coordination of the product. The fixing portion 121 comprises a fixing slot 124 that communicates with the hollow space 122. The fixing slot 124 extends linearly from one end of the fixing portion 121 to the other. The puzzle plate 11 may be inserted from either end of the fixing slot 124, with its edges constrained within the fixing slot 124. The fixing slot 124 restricts the lateral and thickness movement of the puzzle plate 11, allowing its motion to occur only along the extension direction of the fixing slot 124. Therefore, there is no need for additional fixing structures between the puzzle plate 11 and the fixing frame 12, while still maintaining a detachable connection between them. This allows the puzzle plate 11 and the fixing frame 12 to be packaged separately for transportation, addressing the potential issue of damage during transport when the puzzle plate 11 is assembled onto the fixing frame 12.

The fixing portion 121 comprises two longer sidewalls 121A extending along the longitudinal direction X and two shorter sidewalls 121B extending along the lateral direction Y. The fixing slot 124 is located on the longer sidewalls 121A and is designed to accommodate the longer edge 11A of the puzzle plate 11. The fixing slots 124 on the two longer sidewalls 121A are positioned at the same horizontal height to ensure that the puzzle plate 11 is flat relative to the fixing portion 121 after installation, meaning that the puzzle plate 11 is horizontally aligned with respect to the playing space or the user's perspective. Of course, if it is desired for the puzzle plate 11 to be installed at a slight angle, the fixing slots 124 on the two longer sidewalls 121A may also be positioned at different horizontal heights. Each longer sidewall 121A comprises an extending wall 1201 and a main supporting wall 1202 extending downwardly from the extending wall 1201. The extending wall 1201 is integral with the main supporting wall 1202 to form a one-piece structure. The extending wall 1201 is cooperated with puzzle plate 11 for forming the game area for placing the plurality of puzzle pieces 200.

Referring to FIGS. 2-4 and 12-15, the reinforcing portion 123 is capable of supporting the puzzle plate 11 and providing a mounting position for the rotating assembly 40. Optionally, the rotating assembly 40 may also be directly attached to a bottom of the puzzle plate 11.

The reinforcing portion 123 is connected to the fixing portion 121 either directly or indirectly and may be arranged in any direction, such as along the longitudinal direction X or the lateral direction Y. Preferably, multiple reinforcing portions are arranged in an interlaced manner along both the longitudinal direction X and the lateral direction Y to provide a more stable support for the puzzle plate 11. In this embodiment, the reinforcing portion 123 comprises a pair of first reinforcing arms 1231 arranged parallel to each other along the lateral direction Y, a pair of second reinforcing arms 1232 fixed to a corresponding first reinforcing arm 1231 and located outside both of the first reinforcing arms 1231, and a third reinforcing arm 1233 and a fourth reinforcing arm 1234 fixed to the first reinforcing arm 1231 and located between the two first reinforcing arms 1231. The two ends of each first reinforcing arm 1231 are fixed to the two longer sidewalls 121A, with the two first reinforcing arms 1231 symmetrically arranged concerning a midpoint line of the two longer sidewalls 121A.

The second reinforcing arm 1232 is aligned with the corresponding first reinforcing arm 1231, with both second reinforcing arms 1232 also symmetrically arranged relative to the midpoint line of the two longer sidewalls 121A. One end of the second reinforcing arm 1232 is fixed to the first reinforcing arm 1231, while the other end is aligned with the shorter sidewalls 121B and spaced below the shorter sidewalls 121B to avoid interference with the puzzle plate 11. Preferably, one end of the second reinforcing arm 1232 is positioned at a midpoint of the first reinforcing arm 1231, and the other end is located below a midpoint of the shorter sidewalls 121B.

The third reinforcing arm 1233 and the fourth reinforcing arm 1234 are parallel, with two of each being present. The two third reinforcing arms 1233 are symmetrically arranged concerning the midpoint line of the two first reinforcing arms 1231, and the two fourth reinforcing arms 1234 are similarly symmetrically arranged in relation to the midpoint line of the two first reinforcing arms 1231. Both third reinforcing arms 1233 are located between the two fourth reinforcing arms 1234.

The central area of the puzzle plate 11 has the highest degree of freedom, making it prone to collapse. The arrangement of the third reinforcing arm 1233 and the fourth reinforcing arm 1234 provides better support for the central area of the puzzle plate 11, increasing its load-bearing capacity for the puzzle pieces 200 and allowing it to accommodate a larger number of puzzle pieces, such as 1000, 1500, or other high-capacity quantities.

The longer sidewall 121A, the first reinforcing arm 1231, and the second reinforcing arm 1232 form a drawer cavity 13. One end of the drawer cavity 13 is aligned with the shorter sidewall 121B, and the drawer cavity 13 receives a puzzle drawer 14, which is located beneath the puzzle plate 11 and may be moved within the drawer cavity 13 to open or close. Specifically, the longer sidewall 121A and the first reinforcing arm 1231 are also equipped with a drawer slot 1238 that extends along the longitudinal direction X and allows for the movement of the puzzle drawer 14. The drawer slot 1238 is positioned below the fixing slot 124.

Referring to FIGS. 4-8, the puzzle drawer 14 serves as a storage space for the puzzle pieces 200, allowing the puzzle pieces 200 to be stored inside the puzzle drawer 14. The puzzle plate 11 closes off a top opening of the puzzle drawer 14, making it difficult for the puzzle pieces 200 to fall out from within the puzzle drawer 14. To prevent movement of the puzzle drawer 14 when closed especially during the user movement, rotation of the board assembly 10, or tilting the board assembly 10. The puzzle board 1 further comprises a drawer locking member 15. The drawer locking member 15 comprises a locking part 151 and a coupling part 152 fitting together with the locking part 151. One of them is fixed to the shorter sidewall 121B and the other to the puzzle drawer 14. The coupling part 152 locks the locking part 151 in place, preventing relative movement between the locking part 151 and the coupling part 152, thereby restricting the movement of the puzzle drawer 14 relative to the fixing frame 12. The board assembly 10 further comprises at least two puzzle drawers 14. Each second reinforcing arm 1232 is interlaced with a corresponding first reinforcing arm 1231. A pulling direction of the puzzle drawers 14 is the same as an extension direction of the second reinforcing arm 1232.

Since the puzzle plate 11 is located between the shorter sidewall 121B and the puzzle drawer 14, the drawer locking member 15 creates limits at both ends of the puzzle plate 11, restricting its movement along the longitudinal direction X.

Referring to FIGS. 1-5 and 21-24, the supporting assembly 20 comprises a supporting structure 21 and a foot structure 22 arranged below the supporting structure 21 to support the supporting structure 21. The supporting structure 21 comprises a pair of supporting legs 211 connected to the foot structure 22 and spaced apart from each other, a pair of extending arms 212 fixed corresponding one-to-one with the supporting legs 211 and also spaced apart from each other, and a connecting shaft 213 connecting the pair of extending arms 212. Each supporting leg 211 is extended along a thickness direction Z, which is perpendicular to both the lateral direction Y and the longitudinal direction X. Each extending arm 212 is extended along the lateral direction Y, while the connecting shaft 213 is extended along the longitudinal direction X. The pair of extending arms 212 are located on the same side of the supporting legs 211. The supporting structure 21 is a non-closed frame structure. Compared to a related closed frame structure, it omits another leg parallel to the connecting shaft 213, resulting in a simpler design that may reduce production costs. In an alternative embodiment, the supporting leg and the extending arm may be configured with only one or more than two. The extending arm may be omitted, allowing the supporting leg to directly connect to the connecting shaft. Alternatively, the connecting shaft may also be omitted, with the adjusting structure directly fixed to the supporting leg.

The extending arm 212 divides the supporting leg 211 into an upper body 2111 and a lower body 2112, with the upper body 2111 being suspended and the lower body 2112 connected to the foot structure 22. When the extending arm is omitted, the upper body 2111 protrudes from the connecting shaft 213.

The foot structure 22 is correspondingly arranged with the supporting legs 211, that is, the number of foot structures 22 is also two. The two foot structures 22 are connected by a crossbar 24 to enhance the stability of the foot structures 22. To provide stable support for the board assembly 10, the foot structures 22 need to be positioned in a central area of the board assembly 10, near its center of gravity. Compared to a related four-legged supporting structure, the present invention reduces the number of legs, thereby lowering production costs. Additionally, it decreases the number of structural components beneath the board assembly 10, reducing the footprint and allowing for better arrangement within the playing space. To adapt to the structure of the foot structure 22, the extending arm 212 should be designed in the form of a short structure, enabling the supporting assembly 20 to be as compact as possible within the central area of the board assembly 10.

Each foot structure 22 comprises an upper part 221, a lower part 222 and a connecting part 223 serving as a transitional connector between the supporting legs 211 and the upper part 221. The supporting leg 211 is movably connected to the upper part 221 to adjust the height of the supporting assembly 20, thereby changing the height of the board assembly 10 relative to the playing space. Specifically, one end of the upper part 221 connected to the supporting leg 211 comprises a receiving channel 2212, and the supporting leg 211 is correspondingly inserted into the receiving channel 2212 of the upper part 221, allowing it to move freely within the receiving channel 2212. The connecting part 223 comprises a flanging part 2231 mounted on the upper part 221 and an inner channel 2234 completely drilled through the flanging part 2231, which is communicated with the receiving channel 2212. The supporting leg 211 is inserted into the receiving channel 2212 via the inner channel 2234. The shape of the inner channel 2234 matches the shape of the supporting legs 211, thereby restricting the inclination of the supporting legs 211 along the thickness direction Z, allowing them to move linearly up and down along the connecting part 223 and the upper part 221 for height adjustment. The connecting part 223 has an overall structure of an outer square and inner circle structure, enabling the supporting legs 211 and the upper part 221 to have different structural forms.

The upper part 221 further comprises a first positioning hole 2210 penetrated through a sidewall of the upper part 221 and communicate with the receiving channel 2212 of the upper part 221. Each supporting leg 211 comprises a plurality of second positioning holes 2110 evenly spaced along the thickness direction Z. By moving the supporting leg 211 up and down, when the first positioning hole 2210 aligns with the desired second positioning hole 2110, it indicates that the position of the supporting leg 211 has been adjusted correctly. In this embodiment, a positioning fastener 23 is sequentially inserted into the first positioning hole 2210 and contacted with the second positioning hole 2110 thereby fixing the supporting leg 211 to the upper part 221 and restricting the movement of the supporting leg 211, thus achieving the height adjustment of the board assembly 10.

The lower part 222 is arranged perpendicular to the upper part 221, forming an L-shaped or inverted T-shaped vertical structure that increases a contact area between the foot structure 22 and the playing space, providing better support on the playing space.

Referring to FIGS. 2-5, 20-29 and 45-46, the adjusting structure 30 is mounted on the connecting shaft 213 for supporting the board assembly 10. The number of the adjusting structures 30 may be set according to actual needs and may be one, two, or more. When there is only one adjusting structure 30, it is installed at a center position of the connecting shaft 213. When there are two adjusting structures 30, they are symmetrically arranged on either side of the center position of the connecting shaft 213. When there are multiple adjusting structures 30, they are evenly spaced along the longitudinal direction X. In this embodiment, the number of adjusting structures 30 is chosen to be three, with a middle adjusting structure 30 installed at the center position of the connecting shaft 213.

The adjusting structure 30 comprises a supporting portion 31 and an adjusting portion 32 fixed below the supporting portion 31. The rotating assembly 40 is mounted on the supporting portion 31, while the adjusting portion 32 is fixed below the supporting portion 31 and is fitted over an outer circumference of the connecting shaft 213. The adjusting portion 32 is movably connected to the connecting shaft 213, allowing it to rotate around the connecting shaft 213, thereby adjusting a tilt angle of the supporting portion 31. In an alternative embodiment, the adjusting portion 32 may be directly fixed either on the puzzle board 1 or on the rotating assembly 40. The supporting portion may be omitted.

The supporting portion 31 is a substantially flat plate shape and comprises a first side 31A and a second side 31B opposite to the first side 31A. The adjusting portion 32 is fixed to the first side 31A of the supporting portion 31. The second side 31B is supported on the upper body 2111 spaced apart from the adjusting portion 32. The upper body 2111 protrudes relative to the connecting shaft 213, allowing it to accommodate the adjusting structure 30. This arrangement ensures the first side 31A and the second side 31B remain level in a horizontal state of the board assembly 10. Additionally, the upper body 2111 serves a limiting and supporting function when the board assembly 10 is mounted on the supporting assembly 20. To prevent user misoperation, the upper body 2111 is directly supported on the second side 31B, thus preventing users from pressing down on the board assembly 10 near the second side 31B. In the horizontal state, the second side 31B of the supporting portion 31 is mounted on a top of the upper body 2111, while in the inclined state, the second side 31B is suspended above the supporting assembly 20 and separated from the upper body 2111. In an alternative embodiment, the upper body 2111 may be omitted.

The adjusting portion 32 comprises a main portion 321 connected to the connecting shaft 213 and a fastening element 322 located above the main portion 321. The main portion 321 comprises a mounting hole 3211 penetrated along the longitudinal direction X, and an adjusting gap 3212 extending from an outer sidewall of the main portion 321 to the mounting hole 3211 and communicated with the mounting hole 3211. The main portion 321 is divided into a first part 3213 and a second part 3214 by the adjusting gap 3212. The main portion 321 further comprises an adjusting unit 33 connected to both the first part 3213 and the second part 3214 for adjusting a height of the adjusting gap 3212. In this embodiment, the adjusting gap 3212 extends from an outer circumference of the adjusting structure 30 to the mounting hole 3211. One side of the first part 3213 and the second part 3214 is spaced apart from each other by the adjusting gap 3212, while the other side of the first part 3213 and the second part 3214 is connected.

The main portion 321 is mounted on the connecting shaft 213 through the mounting hole 3211, allowing it to rotate around the connecting shaft 213. As the main portion 321 rotates, the tilt angle of the adjusting structure 30 changes, causing the supporting portion 31 to be positioned in the inclined state. During assembly, the adjusting portion 32 can be inserted directly into the connecting shaft 213 from either end through the mounting hole 3211; alternatively, the adjusting portion 32 may first be fitted onto the outer circumference of the connecting shaft 213 through the adjusting gap 3212, and then the mounting hole 3211 can be secured onto the connecting shaft 213. Both methods can be chosen based on actual needs.

The adjusting unit 33 comprises a fastening portion 331, a first connecting hole 332 formed in the first part 3213 and cooperated with the fastening portion 331, and a second connecting hole 333 formed in the second part 3214 and cooperated with the fastening portion 331. The fastening portion 331 engages with the first part 3213 and the second part 3214 to adjust the height of the adjusting gap 3212. The fastening portion 331 is inserted into the first connecting hole 332, the adjusting gap 3212 and the second connecting hole 333 for adjusting the height of the adjusting gap 3212.

During operation, reducing the height of the adjusting gap 3212 via the fastening portion 331 causes the first part 3213 to approach the second part 3214, thereby narrowing a diameter of the mounting hole 3211. This allows the main portion 321 to firmly clamp the connecting shaft 213, ensuring the restriction of the rotation of the main portion 321 around the connecting shaft 213 and allowing the board assembly 10 to maintain its inclined state. In this embodiment, the size of the mounting hole 3211 is adjusted to modify a contact friction between the adjusting structure 30 and the connecting shaft 213, thereby stably supporting the board assembly 10 on the supporting assembly 20 through the contact friction between the adjusting structure 30 and the connecting shaft 213. In an alternative embodiment, other methods may be employed to adjust the size of the mounting hole 3211 to change the contact friction between the adjusting structure 30 and the connecting shaft 213. For example, the main portion may be made from elastic material, with a diameter of the mounting hole 3211 being smaller than an outer diameter of the connecting shaft 213. The mounting hole 3211 is initially expanded to fit over the connecting shaft 213. In the rebound process, the main portion increases the contact friction between itself and the connecting shaft 213. This way, the contact friction is utilized to stably support the board assembly 10 on the supporting assembly 20. Additionally, the adjusting gap 3212 and the adjusting unit 33 may be omitted. The minimum diameter of the mounting hole 3211 is smaller than an outer diameter of the connecting shaft 213. After the adjusting portion 32 is installed on the connecting shaft 213, an inner sidewall of the mounting hole 3211 continuously compresses the connecting shaft 213, ensuring the stability of the connection between the adjusting portion 32 and the connecting shaft 213 through the friction force between them. This helps to provide stable support for the jigsaw puzzle table 1000. To ensure that the adjusting portion 32 continuously compresses the connecting shaft 213 and enhance the friction force between them, damping elements such as rubber sleeves, sponges, fabric, or similar materials can be added to the inner sidewall of the mounting hole 3211 or an outer surface of the connecting shaft 213.

The fastening portion 331 is a screw and comprises a body part 3311 and an operating part 3312 connected to the body part 3311. One end of the body part 3311 is connected to the operating part 3312, while the other end passes through the first connecting hole 332 and engages with the second connecting hole 333. Specifically, an outer surface of the body part 3311 is provided with external threads, and both the first connecting hole 332 and the second connecting hole 333 are internally threaded holes that match the threads of the body part 3311. The fastening portion 331 is secured to the first part 3213 and the second part 3214 through a threaded connection. In an alternative embodiment, the fastening element 322 and the main portion 321 may be secured together using various methods such as snap-fit and friction fit, as long as they allow for the adjustment of the height of the adjusting gap 3212.

In this embodiment, the user needs to stand close to the first side 31A and away from the second side 31B to adjust the inclined state of the board assembly 10. When it is necessary to switch the board assembly 10 from the horizontal state to the inclined state, there is no need to alter the tightness of the fastening portion 331. The user may directly press down on the board assembly 10, which drives both the board assembly 10 and the adjusting structure 30 to rotate together around the connecting shaft 213, thereby causing the board assembly 10 to tilt. When the board assembly 10 needs to be returned from the inclined state to the horizontal state, the user may lift the board assembly 10 upward. This movement drives the board assembly 10 and the adjusting structure 30 to rotate together around the connecting shaft 213, restoring the board assembly 10 to the horizontal state. When adjusting the tilt angle of the board assembly 10, the connecting shaft 213 remains stationary relative to the supporting leg 211. The adjusting structure 30 rotates around the connecting shaft 213 because the connecting shaft 213 is fixedly connected to the supporting legs 211. The board assembly 10, driven by the adjusting structure 30, rotates relative to the supporting assembly 20. When the upper body 2111 is omitted, the user may directly press down on the board assembly 10 from either the first side 31A or the second side 31B, causing the board assembly 10 to tilt.

By adjusting the fastening degree of the fastening portion 331, the clamping degree between the main portion 321 and the connecting shaft 213 may be changed, allowing the board assembly 10 to maintain a stable inclined state. Without loosening the fastening portion 331, the user may directly press down on the board assembly 10, thereby driving the main portion 321 to rotate on the connecting shaft 213. The rotation of the adjusting structure 30 further drives the board assembly 10 to rotate, making it more convenient to adjust the tilt angle of the board assembly 10.

Referring to FIGS. 4-5 and 16-20, the rotating assembly 40 is sandwiched between the supporting portion 31 and the puzzle board 1. The rotating assembly 40 comprises a first housing 41 mounted on the supporting portion 31 and a second housing 42 rotatably coupled with the first housing 41 and mounted on the puzzle board 1. When it is necessary to adjust the orientation of the puzzle board 1, a driving force is applied to the puzzle board 1, allowing it to rotate relative to the first housing 41 under the guidance of the second housing 42.

The rotation angle of the puzzle board 1 may be any angle. For example, during a two-person puzzle session, users P1 and P2 are positioned at opposite sides of the puzzle board 1. When there is a need to transfer control from user P1 to user P2 for assembling the puzzle pieces 200, the puzzle board 1 may simply be rotated 180 degrees either clockwise or counterclockwise. Additionally, users may assemble puzzle pieces 200 on one side of the jigsaw puzzle table 1000 and then rotate the puzzle board 1 by 180 degrees to work on another set of puzzle pieces 200 on the other side, thereby expediting the assembly process.

It should be noted that the rotation angle of the board assembly 10 may be adjusted to be less than 360 degrees, providing flexibility in how the puzzle board 1 is oriented for ease of use. The rotating assembly 40 is coaxially coupled with a center of mass of the puzzle board 1, allowing the puzzle board 1 to rotate in a balanced manner, ensuring its stability during operation. The rotating assembly 40 further comprises a rotor mechanism 43 rotatably positioned between the first housing 41 and the second housing 42. The rotor mechanism 43 serves as a connecting medium between the first and second housings 41 and 42, effectively spacing them apart. This configuration allows the puzzle board 1 to rotate smoothly in various planar directions relative to the supporting portion 31. This design transforms a frictional interaction between the first housing 41 and the second housing 42 from sliding friction to rolling friction. As a result, the friction damping between these two components is significantly reduced, providing a smoother rotation experience for the user.

The rotor mechanism 43 comprises a retainer unit 431 and a plurality of ball-shaped rotors 432 that are rotatably retained within the retainer unit 431. The retainer unit 431 is configured to spacedly retain the plurality of rotors 432 in a rollable manner, allowing each rotor 432 to freely roll on both the first housing 41 and the second housing 42.

The second housing 42 is fixed to the third reinforcing arm 1233, while the first housing 41 is fixed to the supporting portion 31. The first housing 41 comprises a first through hole 411, a first supporting frame 412 surrounding the first through hole 411, a first rolling portion 413 extending from the periphery of the first supporting frame 412 and surrounding the first supporting frame 412, and a first coupling unit 44 extending from the first rolling portion 413 away from the first supporting frame 412.

The first coupling unit 44 comprises a first coupling base 441 extending from the periphery of the first rolling portion 413, a first coupling hole 442 drilled completely through the first coupling base 441, and a first coupling portion 443 passed through the first coupling hole 442 and fixed to the supporting portion 31 along a fixing direction A1. The outline of the first coupling base 441 has a rectangular shape. The first coupling hole 442 is formed at the four corners of the first coupling base 441. In this embodiment, the first coupling base 441 is an integral annular structure that completely surrounds the first rolling portion 413. In an alternative embodiment, the number of first coupling bases may be multiple, spaced apart from each other by a certain distance. This design allows for greater flexibility and adaptability, enabling adjustments to the number and layout of coupling bases according to actual needs, thereby optimizing the performance and stability of the rotating assembly.

The first supporting frame 412 comprises a first inner portion 4121 surrounding the first through hole 411, a first inclination portion 4122 extending downward from the periphery of the first inner portion 4121, a first transiting portion 4123 extending from the periphery of the first inclination portion 4122 away from the first inner portion 4121, and a first continuing portion 4124 extending upward from the periphery of the first transiting portion 4123 and connected to the first rolling portion 413. The first coupling base 441 comprises a first extending part 4411 extending downward from the periphery of the first rolling portion 413 and a first contacting part 4412 extending from the first extending part 4411 away from the first rolling portion 413. The first coupling hole 442 is drilled completely through the first contacting part 4412. A lower surface of the first rolling portion 413 is taller than an upper surface of the first transiting portion 4123. The lower surface of the first rolling portion 413 is substantially level with an upper surface of the first inner portion 4121.

The second housing 42 comprises a second through hole 421, a second supporting frame 422 surrounding the second through hole 421, a second rolling portion 423 extending from the periphery of the second supporting frame 422 and surrounding the second supporting frame 422, and a second coupling unit 45 extending from the second rolling portion 423 away from the second supporting frame 422.

The second coupling unit 45 comprises a second coupling base 451 extending from the periphery of the second rolling portion 423, a second coupling hole 452 drilled completely through the second coupling base 451, and a second coupling portion 453 passed through the second coupling hole 452 and fixed to the third reinforcing arm 1233 of the puzzle board 1 along an assembly direction B1. The outline of the second coupling base 451 has a rectangular shape. The second coupling portion 453 is formed at the four corners of the second housing 42. In an alternative embodiment, the number of second coupling bases may be multiple, spaced apart from each other by a certain distance.

The second supporting frame 422 comprises a second inner portion 4221 surrounding the second through hole 421, a second inclination portion 4222 extending upward from the periphery of the second inner portion 4221 away from the second inclination portion 4222, a second transiting portion 4223 extending from the periphery of the second inclination portion 4222 away from the second inner portion 4221, and a second continuing portion 4224 extending downward from the periphery of the second transiting portion 4223 and connected to the second rolling portion 423. The second coupling base 451 comprises a second extending part 4511 extending upward from the periphery of the second rolling portion 423 and a second contacting part 4512 extending from the second extending part 4511 away from the second rolling portion 423. The second coupling hole 452 is drilled completely through the second contacting part 4512. The upper surface of the second rolling portion 423 is lower than a lower surface of the second transiting portion 4223. The upper surface of the second rolling portion 423 is substantially level with a lower surface of the second inner portion 4221.

The retainer unit 431 allows the plurality of ball-shaped rotors 432 to be fixed at intervals in a rolling manner, thereby enabling each rotor 432 to roll freely on the first rolling portion 413 and the second rolling portion 423. The plurality of ball-shaped rotors 432 are rotationally placed between the first rolling portion 413 and the second rolling portion 423, allowing the second housing 42 to rotate relative to the first housing 41. This configuration enables the puzzle board 1 to rotate smoothly relative to the supporting assembly 20. The rotating assembly 40 also comprises a connecting element 46. The connecting element 46 connects the first housing 41 and the second housing 42 by passing through the first through hole 411 and the second through hole 421 in a rotational manner.

The first rolling portion 413 is substantially V-shaped and symmetrically positioned with respect to the second rolling portion 423. Each of the plurality of rotors 432 is free to roll on both the first rolling portion 413 of the first housing 41 and the second rolling portion 423 of the second housing 42. The first rolling portion 413 comprises a first engaging part 4131 connected to the first continuing portion 4124 of the first supporting frame 412 and a second engaging part 4132 extending from the first engaging part 4131. The extension length of the first engaging part 4131 is less than that of the second engaging part 4132, thereby allowing for better wrapping around the rotors 432. The second rolling portion 423 is substantially inverted V-shaped, comprising a first engaging portion 4231 connected to the second continuing portion 4224 of the second supporting frame 422 and a second engaging portion 4232 extending from the first engaging portion 4231. The extension length of the first engaging portion 4231 is less than that of the second engaging portion 4232, thereby facilitating better wrapping around the rotors 432 together with the first rolling portion 413. The distance between the first continuing portion 4124 and the second continuing portion 4224 is greater than that between the second engaging part 4132 and the second engaging portion 4232, facilitating better guidance of the rotors 432 within the motion space formed by the first rolling portion 413 and the second rolling portion 423. In other words, the first rolling portion 413 is spaced apart from the second rolling portion 423. An inner distance between the first rolling portion 413 and the second rolling portion 423 is larger than an outer distance between the first rolling portion 413 and the second rolling portion 423.

The third reinforcing arm 1233 and/or the fourth reinforcing arm 1234 of the puzzle board 1 comprise at least one fastening hole 1236 on the side that is close to the rotating assembly 40. The rotating assembly 40 is fixed to the third reinforcing arm 1233 and/or the fourth reinforcing arm 1234 through the second coupling portion 453, which is fastened within the fastening hole 1236; specifically, the second coupling portion 453 is a self-tapping screw.

When the size of the rotating assembly 40 is smaller, the third reinforcing arm 1233 may be selected as a mounting location, and the fastening hole 1236 is arranged in the third reinforcing arm 1233. Conversely, when the size of the rotating assembly 40 is larger, the fourth reinforcing arm 1234 may be chosen as the mounting location, and the fastening hole 1236 is arranged in the fourth reinforcing arm 1234. In this embodiment, when the third reinforcing arm 1233 is used as the mounting location for the rotating assembly 40, there are four mounting holes 1236, distributed in pairs on the third reinforcing arm 1233.

In this embodiment, when using the third reinforcing arm 1233 as the mounting location for the rotating assembly 40, there are four mounting holes 1236 distributed in pairs on the third reinforcing arm 1233. This arrangement allows for flexible installation options based on the dimensions of the rotating assembly 40 while ensuring secure attachment and stability.

Referring to FIGS. 1-5, 12-15, 19-20 and 41-43, the jigsaw puzzle table 1000 further comprises a rotating locking portion 16 and a rotating locking part 17 cooperated with the rotating locking portion 16. The rotating locking portion 16 is connected to the supporting portion 31 and is detachably coupled with the rotating locking part 17. Once the orientation adjustment of the puzzle board 1 is completed, the rotating locking portion 16 is assembled with the rotating locking part 17, which indirectly fixes the puzzle board 1 onto the supporting portion 31, thereby limiting further rotation of the puzzle board 1 relative to the supporting portion 31.

The rotating locking portion 16 aligns with the rotating locking part 17, and a receiving hole 2310 is drilled through the supporting portion 31. The end of the rotating locking portion 16 may pass through the receiving hole 2310 and be connected to the rotating locking part 17, thus restricting the relative movement between the supporting portion 31 and the puzzle board 1. Specifically, both the receiving hole 2310 and the rotating locking part 17 are threaded holes, while the rotating locking portion 16 functions as screw. By twisting the rotating locking portion 16, it is screwed into the receiving hole 2310 and secured within the rotating locking part 17.

The rotating locking part 17 may be directly formed on the puzzle board 1 or on a third-party component fixed to the puzzle board 1. In this embodiment, the rotating locking part 17 is formed in the reinforcing portion 123 and specifically comprises a horizontal locking hole 171 formed in the fourth reinforcing arm 1234 and a lateral locking hole 172 formed in the second reinforcing arms 1232. Both holes are positioned around the fastening hole 1236 to avoid interference with the rotating assembly 40. Optionally, the rotating locking portion 16 and the receiving hole 2310 may be fixed to the supporting assembly 20.

The horizontal locking hole 171 in the fourth reinforcing arm 1234 is used to maintain the horizontal state of the board assembly 10, while the lateral locking hole 172 in the second reinforcing arms 1232 is used to maintain the lateral state of the board assembly 10. The horizontal and lateral states of the board assembly 10 represent the most commonly used and reasonable position states in the invention; therefore, the rotating locking part 17 is set only for these two position states to achieve the maintenance of both lateral and longitudinal positions. In an optional embodiment, the rotating locking part 17 may be set at any position relative to the puzzle plate 11, thereby maintaining the orientation of the board assembly 10 with respect to the user at any location.

The adjustment processes for the adjusting structure 30 and the rotating assembly 40 operate independently. When the supporting portion 31 is mounted on the upper body 2111 of the supporting leg 211, the board assembly 10 is in the horizontal state relative to the user or the playing space. The orientation of the board assembly 10 in the horizontal state may be altered by moving the rotating assembly 40. When the supporting portion 31 is separated from the upper body 2111 of the supporting leg 211, the board assembly 10 transitions into the inclined state. Again, the movement of the rotating assembly 40 allows changes in the orientation of the board assembly 10 while it is in this inclined state. This independent functionality provides users with flexibility in adjusting both the tilt angle and the orientation of the board assembly 10 according to their preferences and needs, enhancing the overall usability and adaptability of the jigsaw puzzle table 1000 during play. Users may easily operate the puzzle board 1 to switch between the inclined state and the horizontal state while also adjusting the direction of the board assembly 10 for optimal viewing and access.

The adjustment process for the adjusting structure 30 and the adjustment process for the rotating assembly 40 may occur in any order. It is possible to first adjust the inclined state of the board assembly 10 through the adjusting structure 30, and then adjust the orientation of the board assembly 10 through the rotating assembly 40; alternatively, it is possible to first adjust the orientation of the board assembly 10 through the rotating assembly 40, and then adjust the inclined state of the board assembly 10 through the adjusting structure 30.

The jigsaw puzzle table 1000 may be in one of the following four common states relative to its playing space or usage:

Horizontal longitudinal state: Shown in FIGS. 1-3 and 33-34, in this state, the supporting portion 31 is mounted on the upper body 2111 of the supporting leg 211, the puzzle board 1 is longitudinally positioned, and the longer edge 11A of the puzzle plate 11, along with the longer sidewall 121A of the fixing frame 12, is directly in front of the user. To prevent the rotation of the puzzle board 1, the rotating locking portion 16 may be inserted into the horizontal locking hole 171 to secure this viewing position Horizontal lateral state: Shown in FIGS. 38-41, in this state, the supporting portion 31 is mounted the upper body 2111 of the supporting leg 211, the puzzle board 1 is positioned laterally, and both the shorter edge 11B and the shorter sidewall 121B are directly in front of the user. To prevent the rotation of the puzzle board 1, the rotating locking portion 16 may be inserted into the lateral locking hole 172 to secure this viewing position.

Inclined longitudinal state: Shown in FIGS. 44-49, in this state, the supporting portion 31 is separated from the upper body 2111 of the supporting leg 211, the puzzle board 1 tilts relative to the user, and both the longer edge 11A of the puzzle plate 11 and the longer sidewall 121A of the fixing frame 12 are directly in front of the user. To prevent the rotation of the puzzle board 1, the rotating locking portion 16 may be inserted into the horizontal locking hole 171 to secure this viewing position.

Inclined lateral state: in this state, the supporting portion 31 is also separated from the upper body 2111 of the supporting leg 211, the puzzle board 1 tilts relative to the user, and both the shorter edge 11B and the shorter sidewall 121B are directly in front of the user. To prevent the rotation of the puzzle board 1, the rotating locking portion 16 may be inserted into the lateral locking hole 172 to secure this viewing position.

In addition to the four common states mentioned above, the puzzle board 1 may achieve any orientation adjustment relative to the user due to the flexible rotation of the rotating assembly 40. Shown in FIGS. 35-37, when the puzzle board 1 is in the horizontal state, both the longer edge 11A and the shorter edge 11B may be positioned at a non-direct front position relative to the user.

The jigsaw puzzle table 1000 may flexibly change its height relative to the user by adjusting the height of the supporting assembly 20. The puzzle board 1 may rotate flexibly relative to the user with the help of the rotating assembly 40 supported by the supporting portion 31 and the supporting assembly 20. Through the collaborative action of the main portion 321 and the connecting shaft 213, the puzzle plate 11 may be set to either the inclined or horizontal state. Additionally, when the puzzle plate 11 is in either the longitudinal state or the lateral state, the effective cooperation between the rotating locking portion 16 and the rotating locking part 17 ensures that this viewing state is securely locked. At the same time, the tilt angle of the puzzle plate 11 may also be precisely adjusted using the adjusting structure 30. The jigsaw puzzle table 1000 provides significant enhancements to the user experience.

Shown in FIGS. 50-79, the jigsaw puzzle table 2000 from a second embodiment of the present invention are presented. The jigsaw puzzle table 2000 comprises a board assembly 10', an adjusting structure 30' located below the board assembly 10' for adjusting a posture of the board assembly 10' relative to the user, and a supporting assembly 20' supporting the board assembly 10', and the adjusting structure 30' and adjusting a height of the jigsaw puzzle table 2000.

Referring to FIGS. 50-56, the board assembly 10' comprises a puzzle board 1' and a rotating assembly 40' attached to the puzzle board 1'. The rotating assembly 40' allows the puzzle board 1' to rotate in any direction, thereby changing its orientation relative to the user. The puzzle board 1' comprises a puzzle plate 11', a fixing frame 12' used to support the puzzle plate 11' and a base 18' attached to the fixing frame 12' away from the puzzle plate 11'. The puzzle plate 11' is fixed to the fixing frame 12'. Both the adjusting structure 30' and the rotating assembly 40' are located on a backside of the puzzle plate 11'. The base 18' is parallel to the puzzle plate 11', and the rotating assembly 40' is sandwiched between the adjusting structure 30' and the base 18'. The puzzle plate 11' is a rectangular planar structure that comprises two longer edges 11A' extending along a longitudinal direction X' and two shorter edges 11B' extending along a lateral direction Y'. The longitudinal direction X' is perpendicular to the lateral direction Y'.

The fixing frame 12' comprises a fixing portion 121', a hollow space 122' surrounded by the fixing portion 121', and a reinforcing portion 123' located within the hollow space 122' and connected to the fixing portion 121'. The puzzle plate 11' is received in the hollow space 122' and is supported by the reinforcing portion 123'. The reinforcing portion 123' comprises a fastening hole 1236'. The base 18' comprises a fixing hole 181' communicated with the fastening hole 1236'.

Referring to FIGS. 56-68, the supporting assembly 20' comprises a supporting structure 21', a foot structure 22' arranged below the supporting structure 21' to support the supporting structure 21', and a positioning fastener 23' matched with the foot structure 22' to maintain a position of the supporting structure 21'. The supporting structure 21' comprises a pair of supporting legs 211' connected to the foot structure 22' and spaced apart from each other, a pair of extending arms 212' fixed to corresponding supporting legs 211' and also spaced apart from each other, and a connecting shaft 213' connecting the pair of extending arms 212'. Each supporting leg 211' is extended along a thickness direction Z', which is perpendicular to both the lateral direction Y' and the longitudinal direction X'. The positioning fastener 23' is configured to secure the supporting legs 211' and the upper part 221' to fix a height of the board assembly 10' supported by the supporting legs 211' and the upper part 221'; the positioning fastener 23' is further configured to release the security between the supporting legs 211' and the upper part 221' to enable the supporting legs 211' and the upper part 221' to be at least partially movable relative to each other to adjust the supported height.

Referring to FIGS. 50-52 and 75-79, the supporting legs 211' are welded and fixed to corresponding extending arms 212', contributing to the overall structural stability of the supporting assembly 20'. The extending arms 212' may be detachably connected to the connecting shaft 213', reducing the overall packaging size. In an alternative embodiment, the supporting legs 211', the extending arms 212', and the connecting shaft 213' may either be welded together as a single unit or connected in a detachable manner. The connecting shaft 213' comprises a hollow structure, notches 2130' at both ends for engaging with the two extending arms 212' and two fixing plates 2131' received in the hollow structure. The fixing plates 2131' work with screw connections 214' to secure the connecting shaft 213' onto the extending arms 212'. The fixing plates 2131' comprises a contacting hole 2132' for matching with the screw connections 214' firmly.

The foot structure 22' corresponds to the supporting legs 211' and comprises an upper part 221', a lower part 222', and a connecting part 223'. The upper part 221' has a receiving channel 2212' for receiving the supporting legs 211'. The supporting legs 211' are connected to the upper part 221' through the connecting part 223' to adjust the height of the jigsaw puzzle table 2000. The connecting part 223' helps stabilize a connection between the supporting legs 211' and the upper part 221', and maintains the supporting legs 211' with the upper part 221' in the thickness direction Z' to prevent any inclination of the supporting legs 211' along the thickness direction Z'.

The connecting part 223' comprises a guiding portion 2232' inserted into the receiving channel 2212', a flanging part 2231' extending from the guiding portion 2232' to cover the receiving channel 2212', and an inner channel 2234' communicated with the receiving channel 2212' and surrounded by the flanging part 2231' and guiding portion 2232' to serve as a passage for the supporting leg 211'. The upper part 221' is directly formed from square tubing. An outer shape of the guiding portion 2232' matches to a shape of the square receiving channel 2212' of the upper part 221'. The flanging part 2231' mounted on a top surface of the upper part 221' and acts as a stop for preventing the connecting part 223' from sliding down the receiving channel 2212' of the upper part 221' under load from above, while also maintaining stability of the connection between the connecting part 223' and the upper part 221'. The supporting legs 211' are made of cylindrical tubing and inserted into the guiding portion 2232' via the inner channel 2234'. A shape of the inner channel 2234' matches a shape of the supporting legs 211', thereby restricting the inclination of the supporting legs 211' along the thickness direction Z' and allowing the supporting legs 211' to move linearly up and down along the connecting part 223' and the upper part 221' for height adjustment. The connecting part 223' has an overall structure of outer square and inner circle structure, serving as a transitional connector between the supporting legs 211' and the upper part 221', allowing the supporting legs 211' and the upper part 221' to have different structural forms.

The upper part 221' comprises a first positioning hole 2210' penetrated through a side wall of the upper part 221' and communicated with the receiving channel 2212' of the upper part 221'. Each supporting leg 211' comprises a plurality of second positioning holes 2110' evenly spaced along the thickness direction Z'. The side wall of the connecting part 223' is provided with a third positioning hole 2233', which is aligned and in communication with the first positioning hole 2210'. To adjust the position of the supporting legs 211' vertically, aligning and connecting the desired first positioning hole 2210' with the third positioning hole 2233' and the second positioning hole 2110' indicates that the position adjustment of the supporting legs 211' is in place. The positioning fastener 23' is sequentially inserted into the first positioning hole 2210', the third positioning hole 2233', and the second positioning hole 2110', clamping the supporting legs 211' to the connecting part 223', restricting the movement of the supporting legs 211' along the thickness direction Z', and achieving position retention. The first positioning hole 2210' and the third positioning hole 2233' are through-holes, while the second positioning hole 2110' may be either a through-hole or a blind hole.

The third positioning hole 2233' is formed in the guiding portion 2232'. This is because the guiding portion 2232' is fully inserted into the receiving channel 2212'. To facilitate the installation and easier insertion of the positioning fastener 23' into the third positioning hole 2233', four third positioning holes 2233' are provided on the four side walls of the guiding portion 2232', thereby increasing the success rate of inserting the positioning fastener 23' into the upper part 221'. During assembly, there is no need to align the third positioning hole 2233' with the first positioning hole 2210'. Simply insert the guiding portion 2232' into the receiving channel 2212', and the third positioning hole 2233' will naturally align with the first positioning hole 2210'. In an alternative embodiment, the number of third positioning holes may also be just one. The guiding portion 2232' may be omitted. The flanging part 2231' may be accommodated in the receiving channel 2212'. The inner channel 2234' is completely drilled through the flanging part 2231'.

Figure 50:
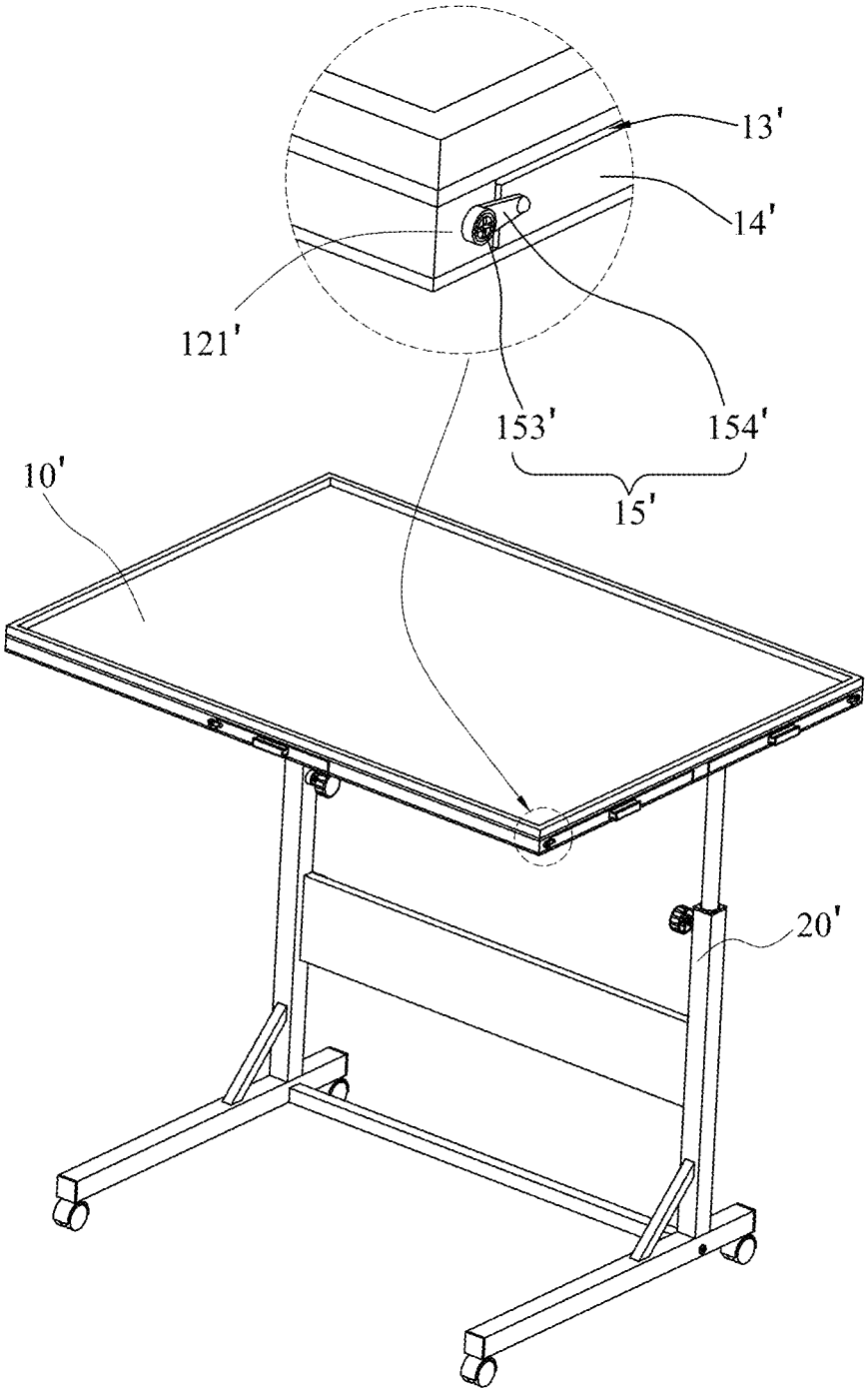
FIG. 50 is an illustrative isometric view of the jigsaw puzzle table according to a second embodiment of the present invention.
Figure 51:
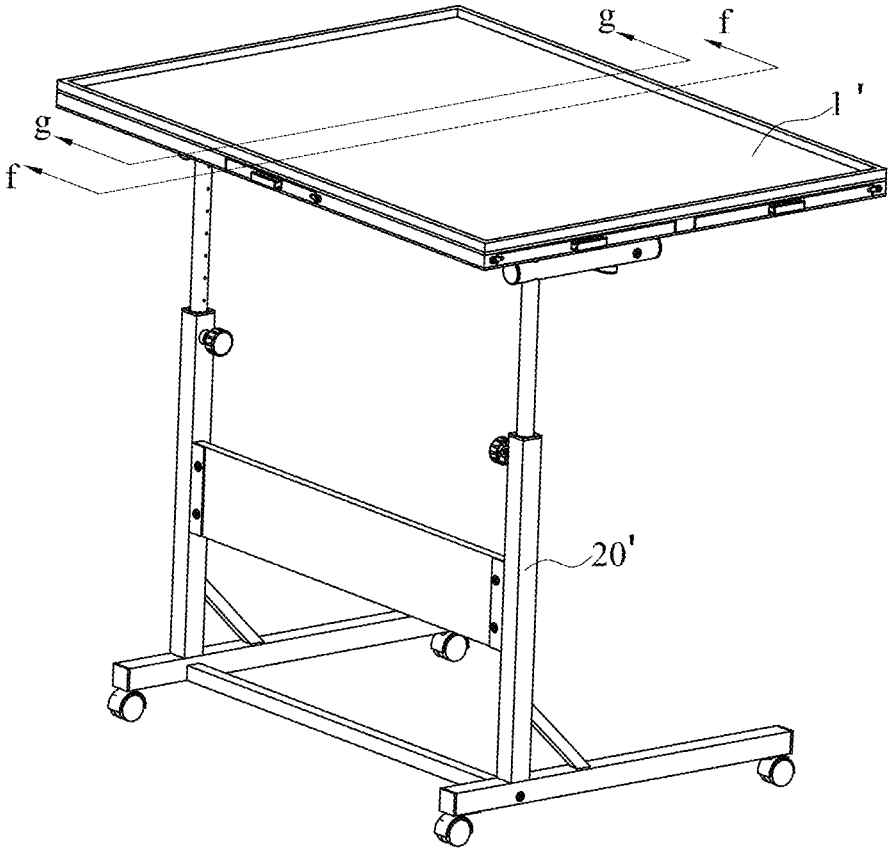
FIG. 51 is an illustrative isometric view shown in FIG. 50, viewed from a different angle.
Figure 52:
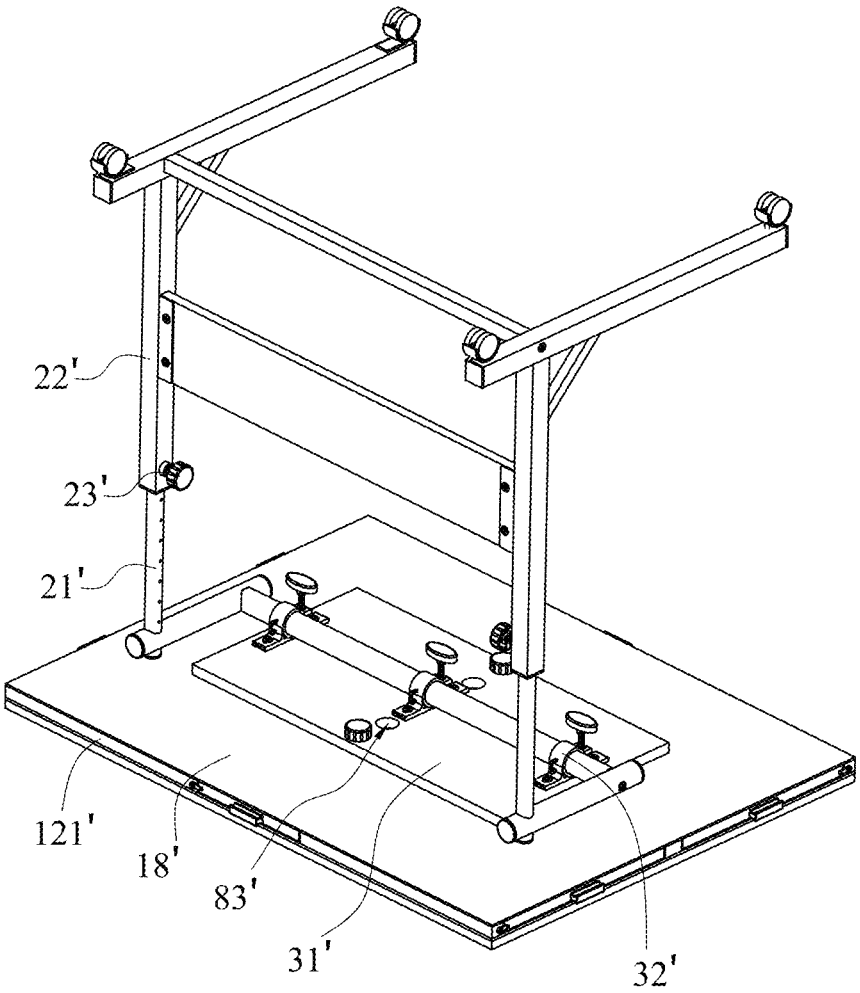
FIG. 52 is an illustrative isometric view shown in FIG. 50, viewed from a third angle.
Figure 53:
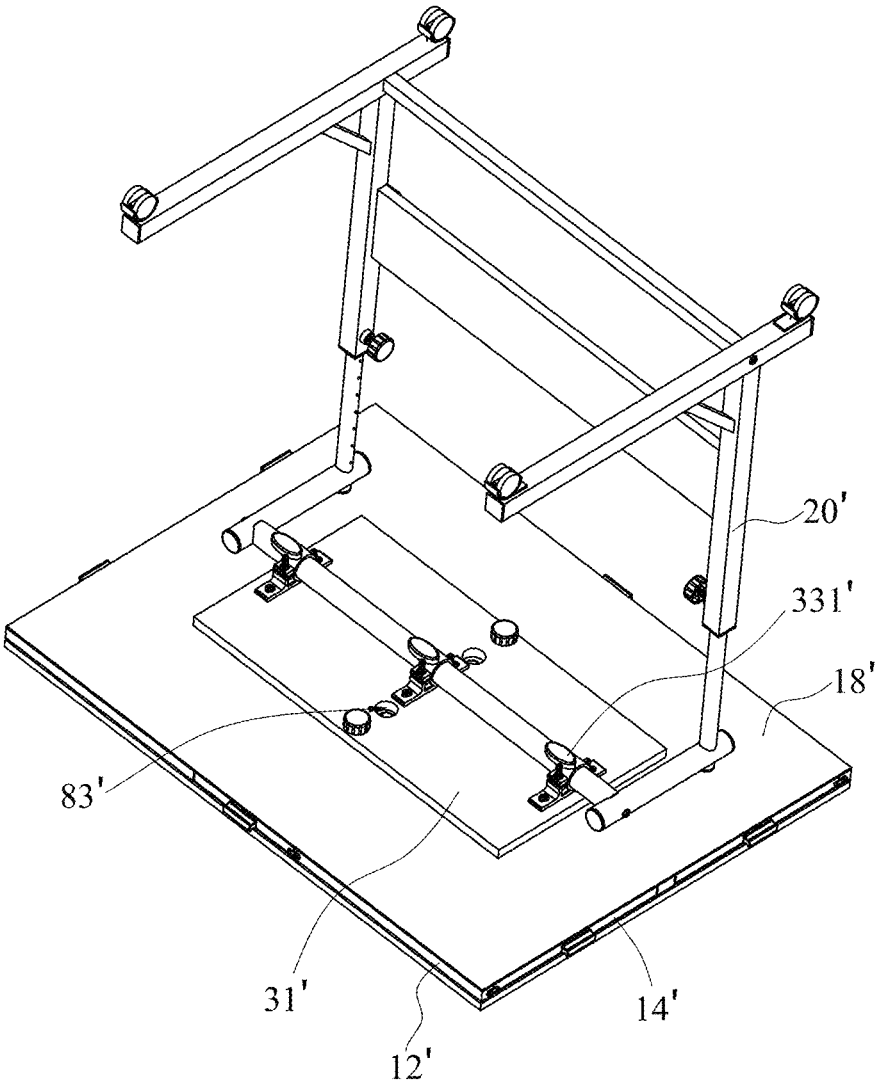
FIG. 53 is an illustrative isometric view shown in FIG. 50, viewed from a fourth angle.
Figure 54:
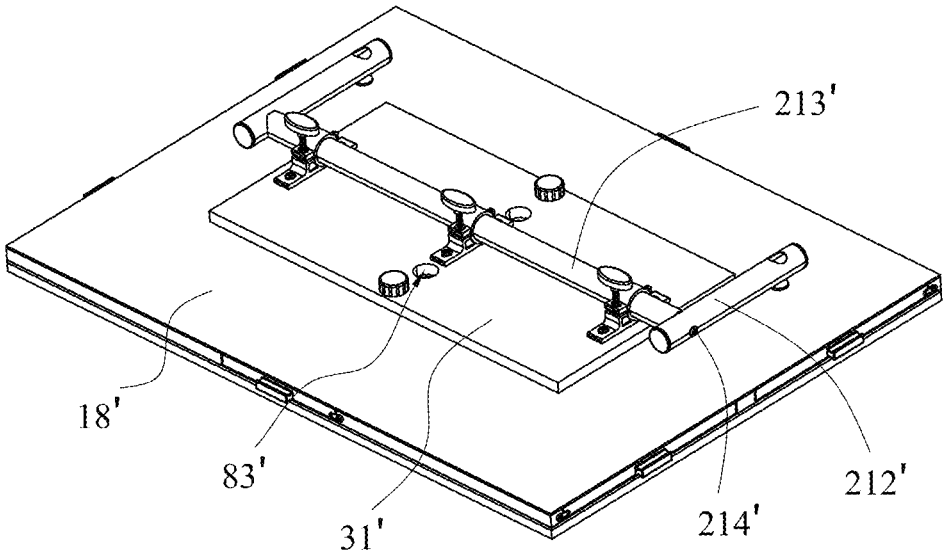
FIG. 54 is an illustrative isometric view of a board assembly, a supporting assembly, and an adjusting structure of the jigsaw puzzle table shown in FIG. 50, with a part of the supporting assembly omitted.
Figure 55:
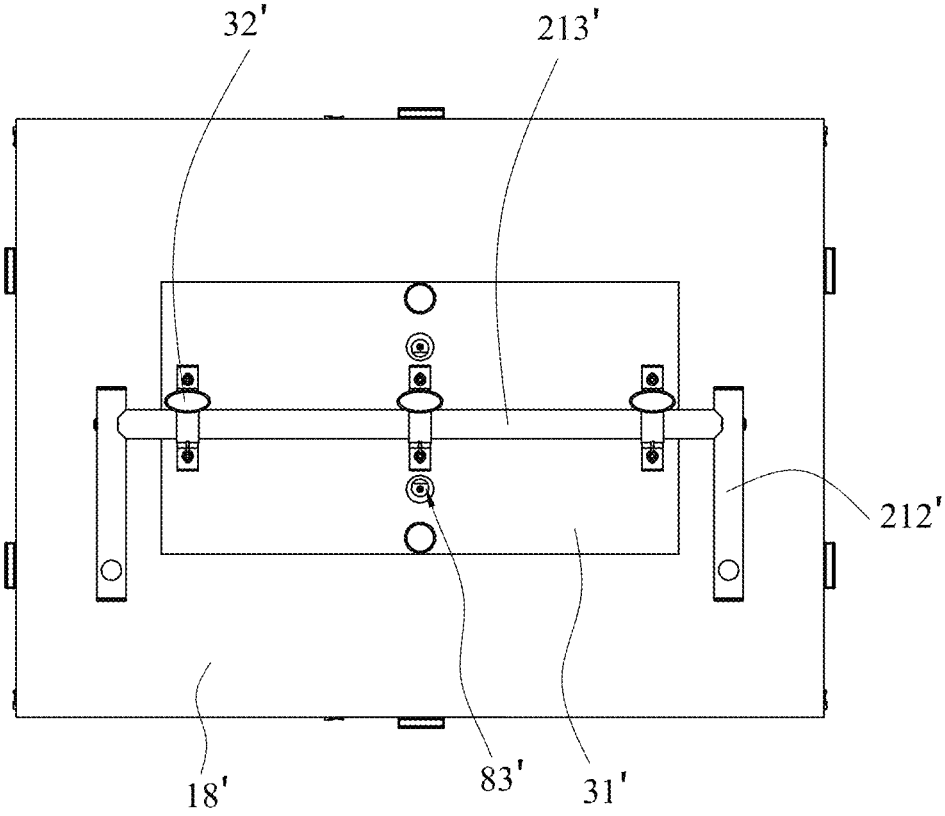
FIG. 55 is the bottom view of the structure shown in FIG. 54.
Figure 70:
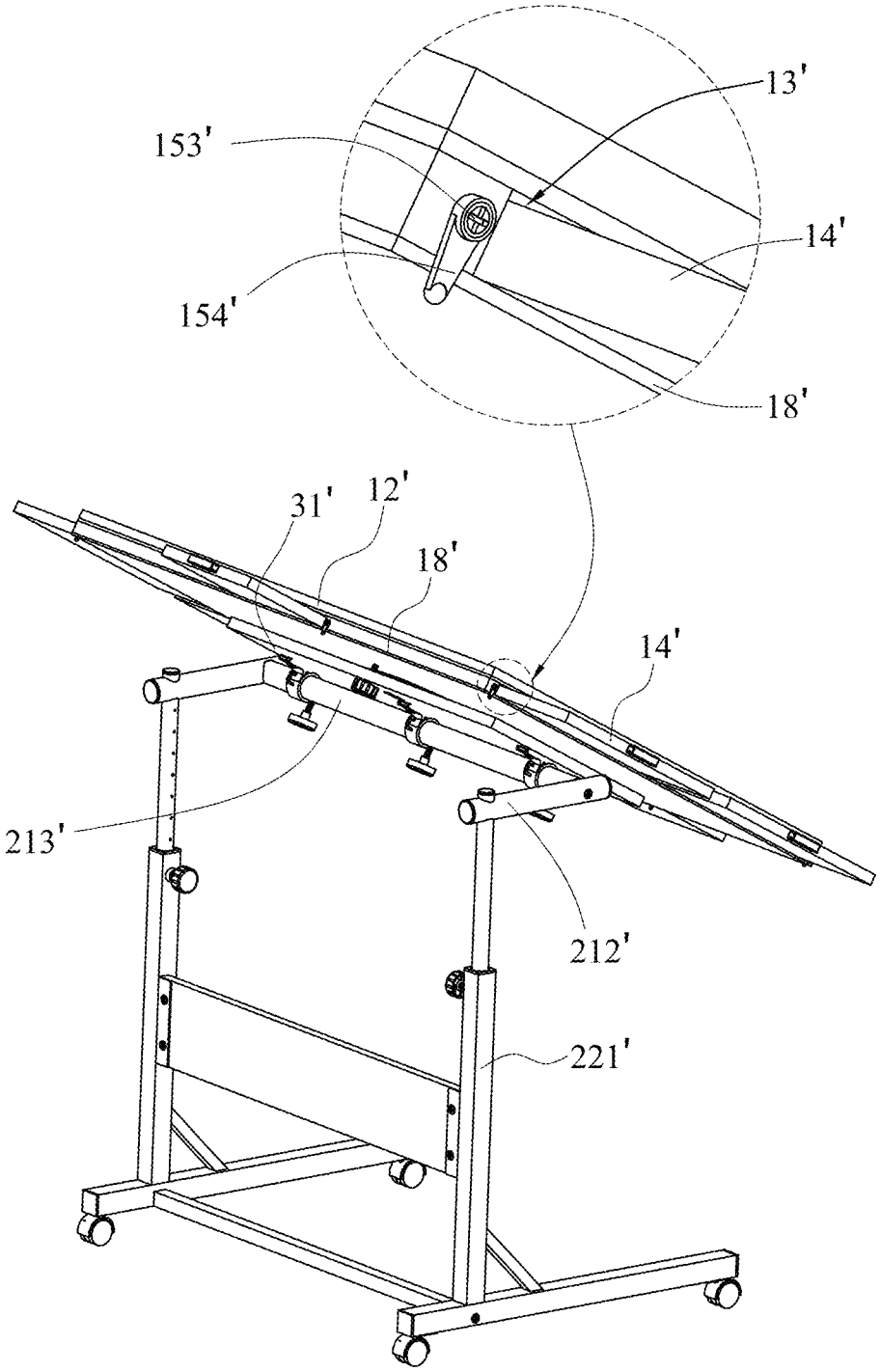
FIG. 70 is an illustrative isometric view of the jigsaw puzzle table shown in FIG. 69, viewed from a different angle.
Figure 71:
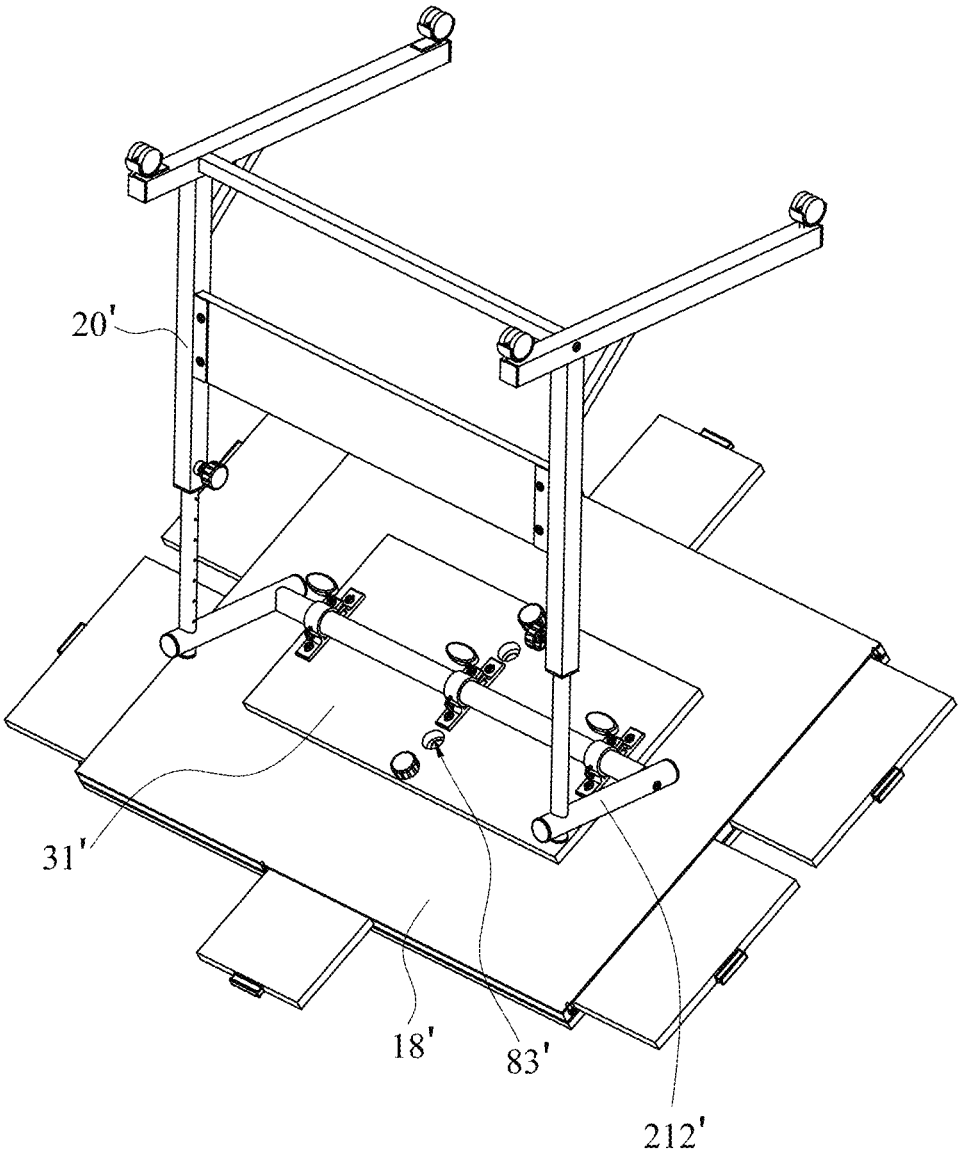
FIG. 71 is an illustrative isometric view of the jigsaw puzzle table of a state after opening a puzzle drawer in the jigsaw puzzle table shown in FIG. 69.

Referring to FIGS. 50 and 70, the puzzle board 1' further comprises a puzzle drawer 14', a drawer cavity 13' for receiving the puzzle drawer 14', and a drawer locking member 15' for locking the puzzle drawer 14' in the drawer cavity 13'. The drawer locking member 15' comprises a pin 153' and a baffle 154'. The pin 153' is fixed to the fixing portion 121', and the baffle 154' is hinged to the pin 153' for rotating around the pin 153'. The pin 153' is positioned close to the puzzle drawer 14'. When the baffle 154' rotates to engage with the puzzle drawer 14', it may limit the movement of the puzzle drawer 14', preventing it from being pulled out of the drawer cavity 13'. When the baffle 154' rotates to separate from the puzzle drawer 14', it does not limit the movement of the puzzle drawer 14', allowing it to be freely pulled out of the drawer cavity 13'.

To ensure controllability of the rotational state of the baffle 154', damping needs to be added between the baffle 154' and the pin 153'. For example, an interference fit may be used between the baffle 154' and the pin 153' so that friction between them creates a damping effect. When the driving force applied to the baffle 154' is greater than the friction force between the baffle 154' and the pin 153', the baffle 154' may be driven to rotate. If the driving force applied to the baffle 154' is not greater than the friction force between the baffle 154' and the pin 153', the baffle 154' will not rotate.

Referring to FIGS. 50-61 and 72-76, the adjusting structure 30' comprises a supporting portion 31' and an adjusting portion 32' fixed below the supporting portion 31'. The rotating assembly 40' is mounted on the supporting portion 31', while the adjusting portion 32' is fixed below the supporting portion 31' and fitted over an outer circumference of the connecting shaft 213'. The supporting portion 31' is a substantially flat plate shape and comprises an installation opening 83' completely drilled through it and an engaging hole 82' also fully drilled through the supporting portion 31' and spaced apart from the installation opening 83'.

The adjusting portion 32' comprises a mounting hole 3211' extending along the longitudinal direction X' and attached on the connecting shaft 213', and an adjusting gap 3212' communicated with the mounting hole 3211'. The adjusting portion 32' is divided into a first part 3213' and a second part 3214' by the adjusting gap 3212'. The main portion 321' further comprises an adjusting unit 33' connected to both the first part 3213' and the second part 3214' for adjusting a height of the adjusting gap 3212'. One side of the first part 3213' and the second part 3214' is spaced apart from each other by the adjusting gap 3212', while the other side of the first part 3213' and the second part 3214' is connected.

Referring to FIGS. 56-68, the rotating assembly 40' is sandwiched between the supporting portion 31' and the base 18' of the puzzle board 1'. The rotating assembly 40' comprises a first housing 41' mounted on the supporting portion 31' and a second housing 42' rotatably coupled with the first housing 41' and mounted on the base 18' of the puzzle board 1'. When it is necessary to adjust the orientation of the puzzle board 1', a driving force is applied to the puzzle board 1', allowing the puzzle board 1' to rotate relative to the first housing 41' under the drive of the second housing 42'.

The first housing 41' comprises a first middle hole 411', a first connecting portion 412' surrounding the first middle hole 411', and a first rolling portion 413' extending from the periphery of the first connecting portion 412' and surrounding the first connecting portion 412'. The second housing 42' comprises a second middle hole 421', a second connecting portion 422' surrounding the second middle hole 421', and a second rolling portion 423' extending from the periphery of the second connecting portion 422' and surrounding the second connecting portion 422'. The diameter of the first middle hole 411' is smaller than that of the second middle hole 421'. Looking up from the bottom of the jigsaw puzzle table 2000 along an assembly direction A1' of the puzzle board 1' and the rotating assembly 40', the second connecting portion 422' is completely covered by the first connecting portion 412', preventing the second connecting portion 422' from being exposed outside of the first connecting portion 412'. The ball bearings 43' are rotatably sandwiched between the first rolling portion 413' and the second rolling portion 423', allowing the second housing 42' to rotate relative to the first housing 41', thus driving the puzzle board 1' to rotate.

The rotating assembly 40' is detachably coupled with the supporting portion 31' and the puzzle board 1'. To secure the rotating assembly 40' on the supporting portion 31', the first housing 41' comprises a first coupling unit 44' attached to the supporting portion 31' along a fixing direction B1'. The first coupling unit 44' comprises a first coupling hole 441' formed in the first connecting portion 412' and a first coupling portion 442' passed through the first coupling hole 441' and fixed to the supporting portion 31'. The first housing 41' is detachably coupled at the supporting portion 31' by inserting the first coupling portion 442' through the first coupling hole 441' and the engaging hole 82' into the supporting portion 31'. To more securely attach the first housing 41' to the supporting portion 31', multiple first coupling units may be used, arranged with spacing between them.

To fix the rotating assembly 40' on the puzzle board 1', the second housing 42' comprises a second coupling unit 45' attached to the puzzle board 1' in the assembly direction A1'. The second coupling unit 45' comprises a second coupling hole 451' formed in the second connecting portion 422', and a second coupling portion 452' passed through the second coupling hole 451', the fixing hole 181', and the fastening hole 1236' of the puzzle board 1' before being fixed to the puzzle board 1'. The second housing 42' is detachably coupled at the puzzle board 1' by inserting the second coupling portion 452' through the second coupling hole 451' to the puzzle board 1'. The rotating assembly 40' further comprises a plurality of friction pads 48' for enhancing the relative friction between the rotating assembly 40', the puzzle board 1', and the supporting portion 31'.

The first housing 41' further comprises a plurality of installation holes 416' drilled completely through the first connecting portion 412'. When assembled, the first coupling unit 44' and the second coupling unit 45' are arranged in a staggered manner. The second coupling hole 451' is visible through the installation opening 83' and the corresponding installation hole 416'. When assembling the second housing 42' with the puzzle board 1', the second coupling unit 45' may be exposed through the installation opening 83' and the corresponding installation holes 416' along the assembly direction A1', thereby facilitating the assembly process for the second housing 42' with the puzzle board 1'. To securely attach the second housing 42' to the puzzle board 1', multiple second coupling units may be used, and arranged with spacing between them.

The first housing 41' and the supporting portion 31' may be secured together using various methods such as threads, snap-fit, or friction fit. Similarly, the second housing 42' and the puzzle board 1' may be secured together using the same methods. Consequently, the first and second coupling portions 442' and 452' may be selected from screws, rivets, or similar fasteners. The fixing hole 181' and the fastening hole 1236' of the puzzle board 1' may be pre-set or formed during the assembly process of the puzzle board 1' and the second housing 42'. Likewise, the engaging hole 82' of the supporting portion 31' may be prepared in advance or created during the assembly process of the supporting portion 31' and the first housing 41'.

The outline of the supporting portion 31' is exceeds that of the rotating assembly 40'. When viewed from the bottom of the jigsaw puzzle table 2000, aside from the exposed second coupling unit 45' of the rotating assembly 40', through the installation opening 83' and the installation holes 416', all other structures of the second housing 42' are covered by the supporting portion 31'. The purpose of the installation opening 83' and installation holes 416' allows the assembler to observe the second coupling unit 45' during the assembly process, enabling the assembler to install the second housing 42' onto the puzzle board 1'.

The installation method for the jigsaw puzzle table 2000 is as follows: First, assemble the rotating assembly 40' with the supporting portion 31'. Specifically, position an upper surface of the supporting portion 31' facing the assembler. Observe the positioning of the engaging hole 82' of the supporting portion 31', and then place the rotating assembly 40' on the supporting portion 31' so that the first coupling hole 441' of the rotating assembly 40' aligns with the engaging hole 82'. At the same time, ensure that the installation holes 416' of the first housing 41' correspond to the installation opening 83' of the supporting portion 31'. Finally, insert the first coupling portion 442' into both the first coupling hole 441' and the engaging hole 82' to secure the rotating assembly 40' to the supporting portion 31', thereby obtaining a combination of the rotating assembly 40' and the supporting portion 31'. The fixing direction B1' of the rotating assembly 40' on the supporting portion 31' differs from the assembly direction A1' of the puzzle board 1' and the rotating assembly 40'. In this embodiment, the fixing direction B1' and the assembly direction A1' are completely opposite.

Next, manually rotate the second housing 42' to adjust the position of the second coupling hole 451' so that the assembler may observe the second coupling hole 451' through the installation opening 83' and the installation holes 416' of the first housing 41' along the assembly direction A1' of the puzzle board 1'. When manually rotating the second housing 42', the first housing 41' remains fixed relative to the supporting portion 31' and does not rotate; therefore, the second housing 42' will rotate relative to the first housing 41', allowing for the adjustment of the position of the second coupling hole 451'. If after completing the previous step the assembler may already observe the second coupling hole 451' from the installation opening 83' and the installation holes 416', this step may not be necessary.

Finally, assemble the combined structure of the rotating assembly 40' and the supporting portion 31' with the puzzle board 1'. Specifically, position the puzzle plate 11' of the puzzle board 1' facing away from the assembler. Observe the alignment of the fixing hole 181' of the puzzle board 1', ensuring that the second coupling hole 451' aligns with the fixing hole 181' of the puzzle board 1' by looking through the installation opening 83' and the installation holes 416' of the first housing 41'. Lastly, insert the second coupling portion 452' into the second coupling hole 451', the fixing hole 181' and the fastening hole 1236' to secure the rotating assembly 40' to the puzzle board 1'.

Figure 56:
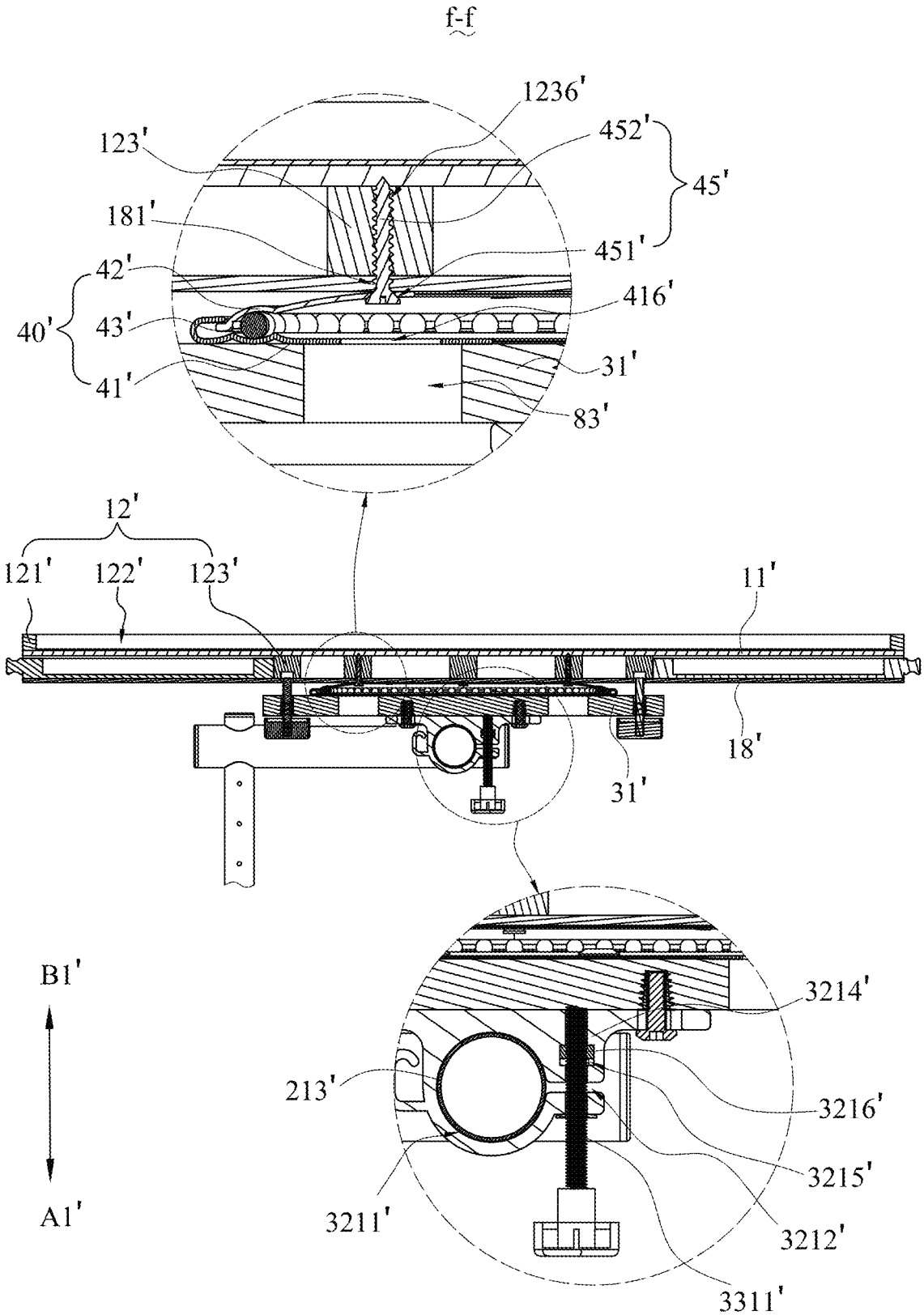
FIG. 56 is an illustrative cross-sectional view of the jigsaw puzzle table taken along line f-f of FIG. 51.
Figure 57:
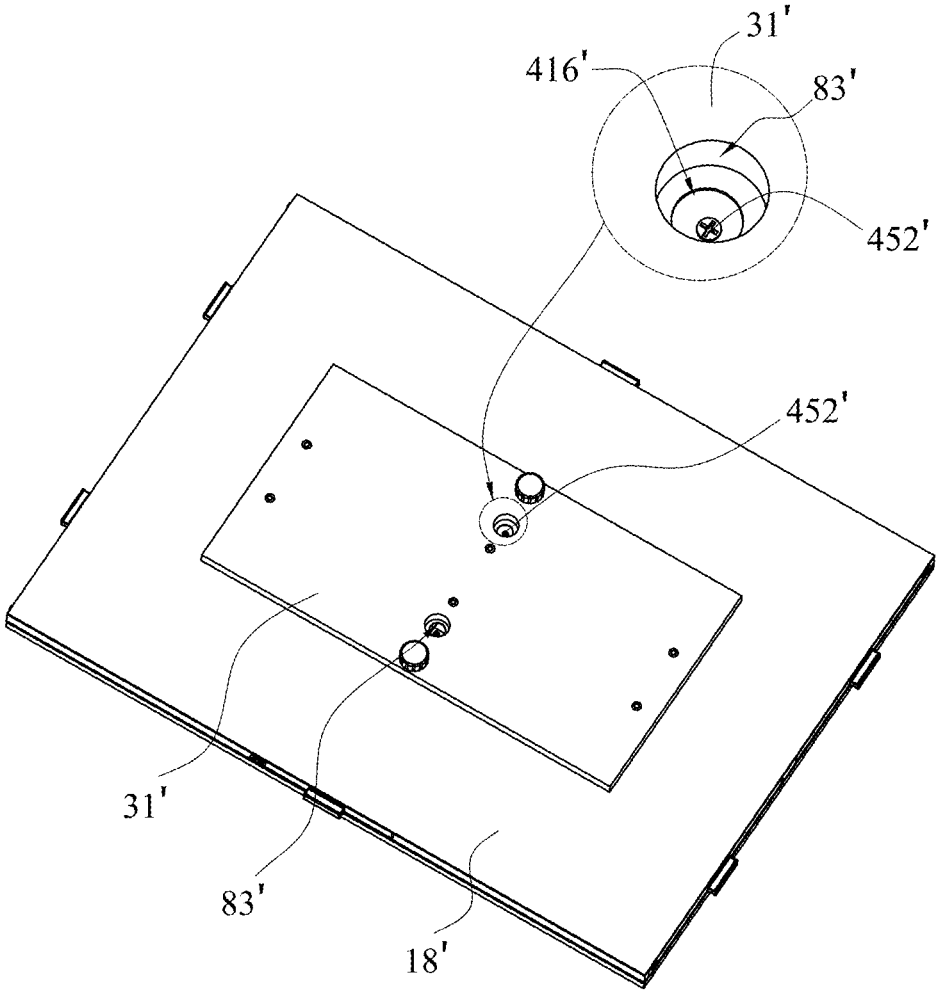
FIG. 57 is an illustrative isometric view of the board assembly and a supporting portion of the adjusting structure of the jigsaw puzzle table shown in FIG. 50.
Figure 58:
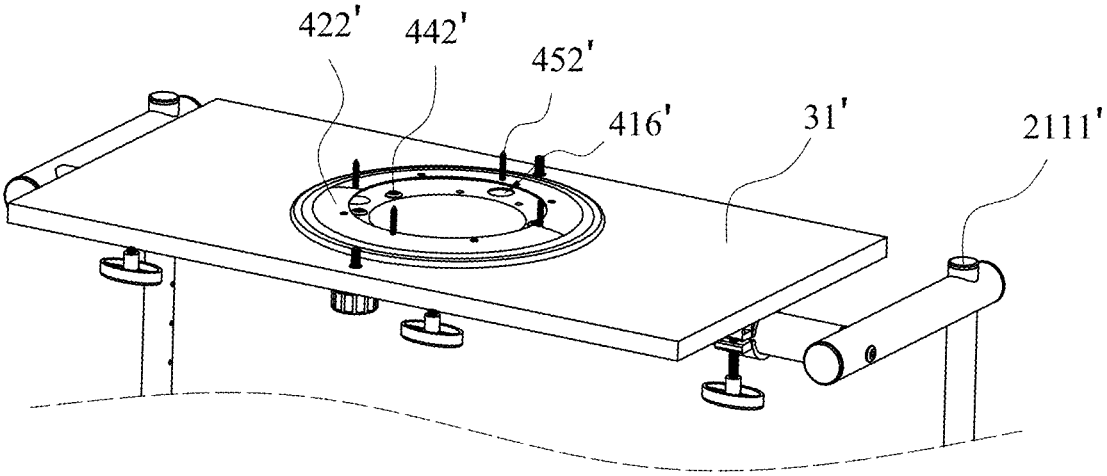
FIG. 58 is an illustrative isometric view of a rotating assembly, a supporting assembly, and an adjusting structure of the jigsaw puzzle table shown in FIG. 50, omitting a part of the supporting assembly.
Figure 59:
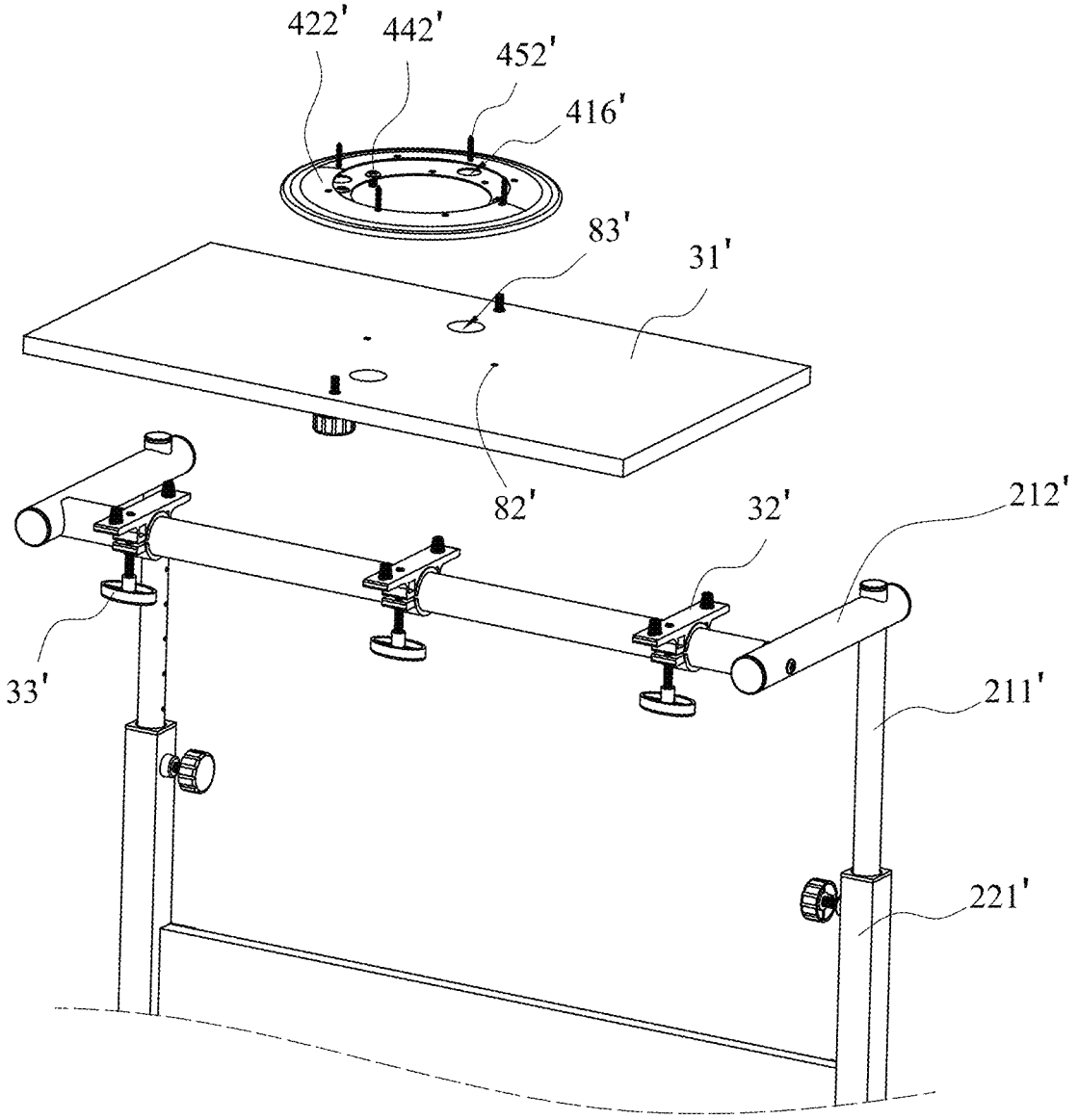
FIG. 59 is an exploded perspective view shown in FIG. 58.
Figure 60:
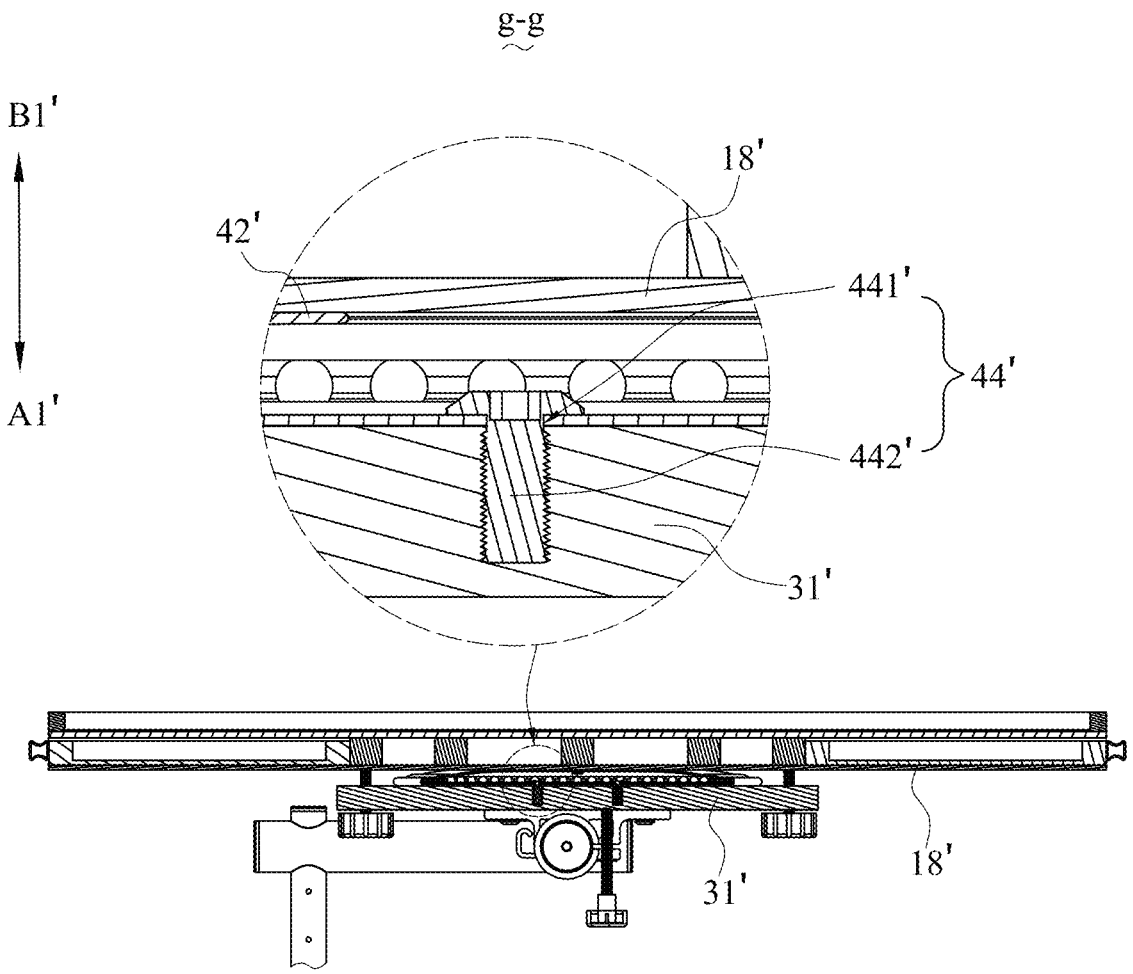
FIG. 60 is an illustrative cross-sectional view of the jigsaw puzzle table taken along line g-g of FIG. 51, omitting a part of the supporting assembly.
Figure 61:
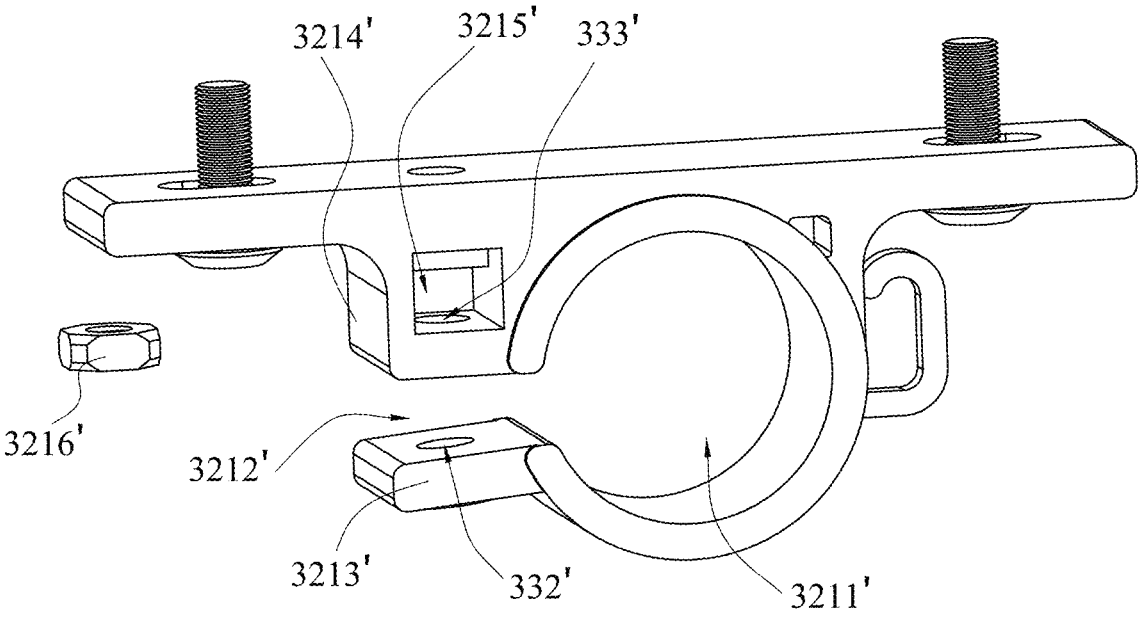
FIG. 61 is an exploded perspective view of the adjusting portion shown in FIG. 50.
Figure 62:
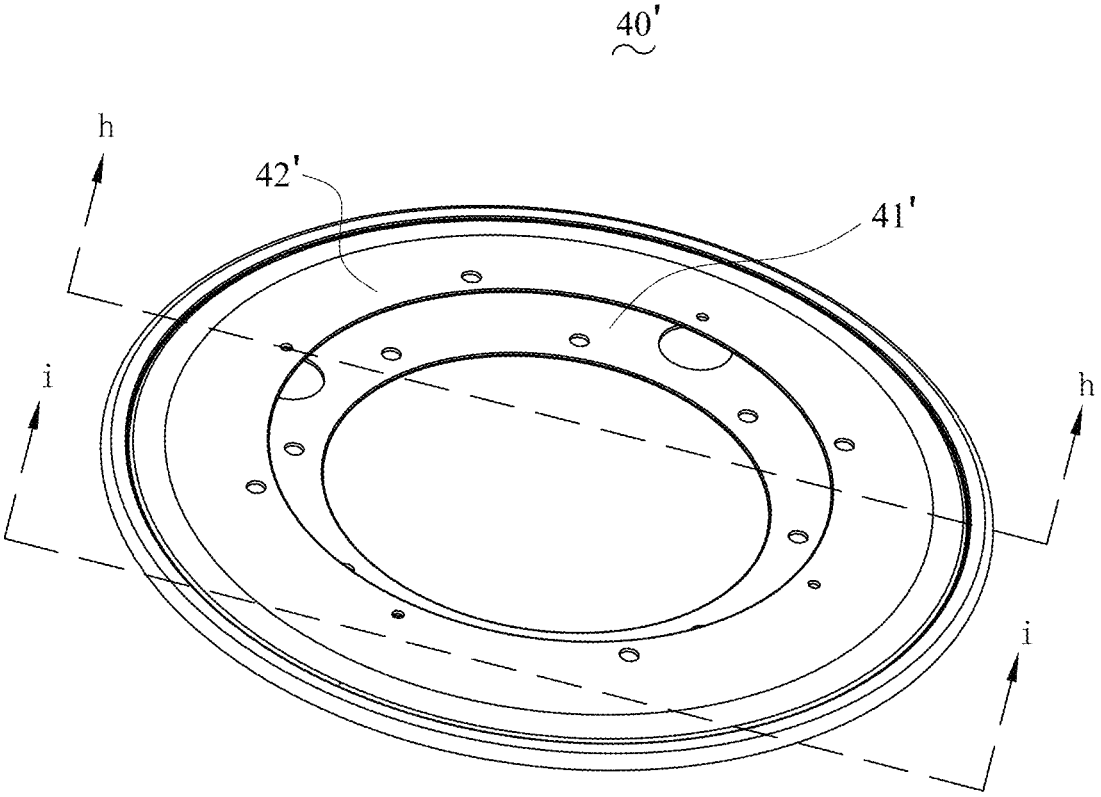
FIG. 62 is an illustrative isometric view of the rotating assembly shown in FIG. 50.
Figure 63:
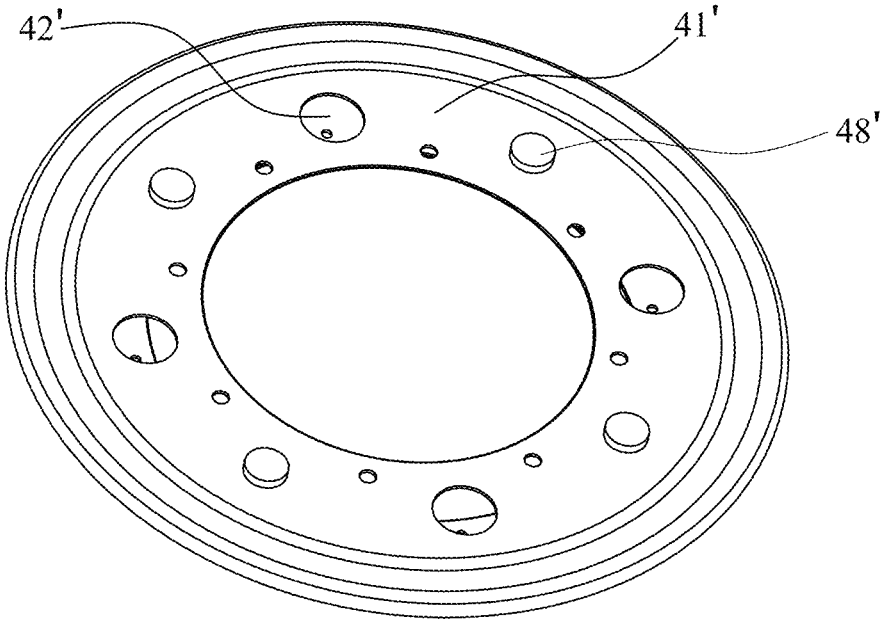
FIG. 63 is an illustrative isometric view of the rotating assembly shown in FIG. 62, viewed from a different angle.
Figure 64:
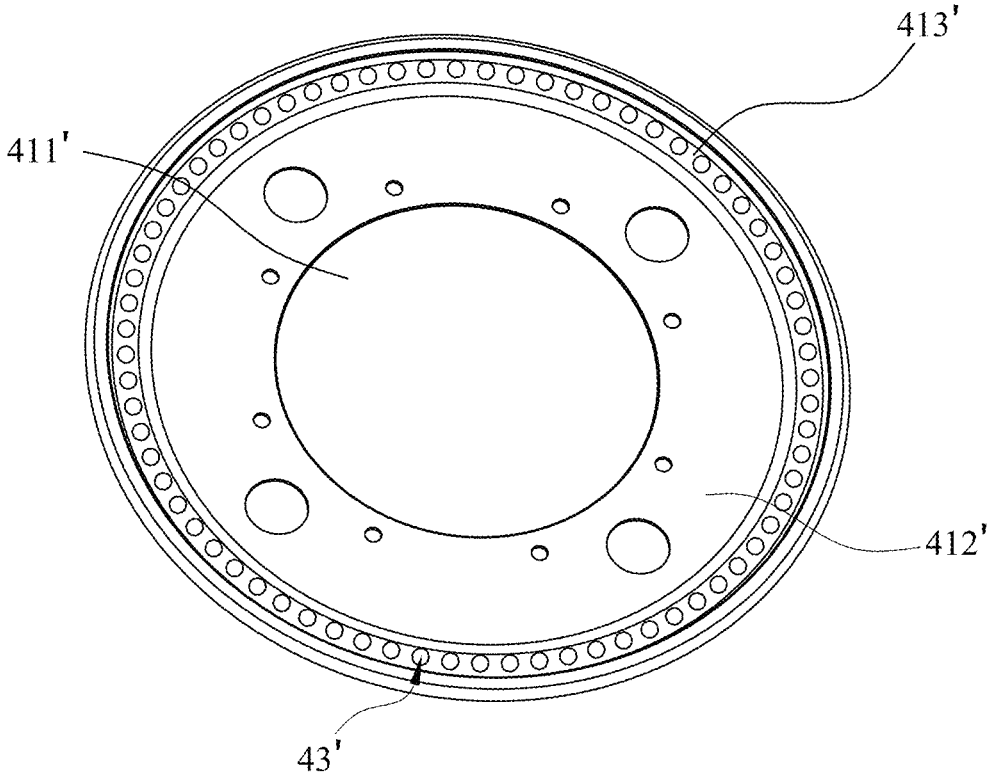
FIG. 64 is an illustrative isometric view of the rotating assembly shown in FIG. 62, omitting a part of the supporting assembly.
Figure 65:
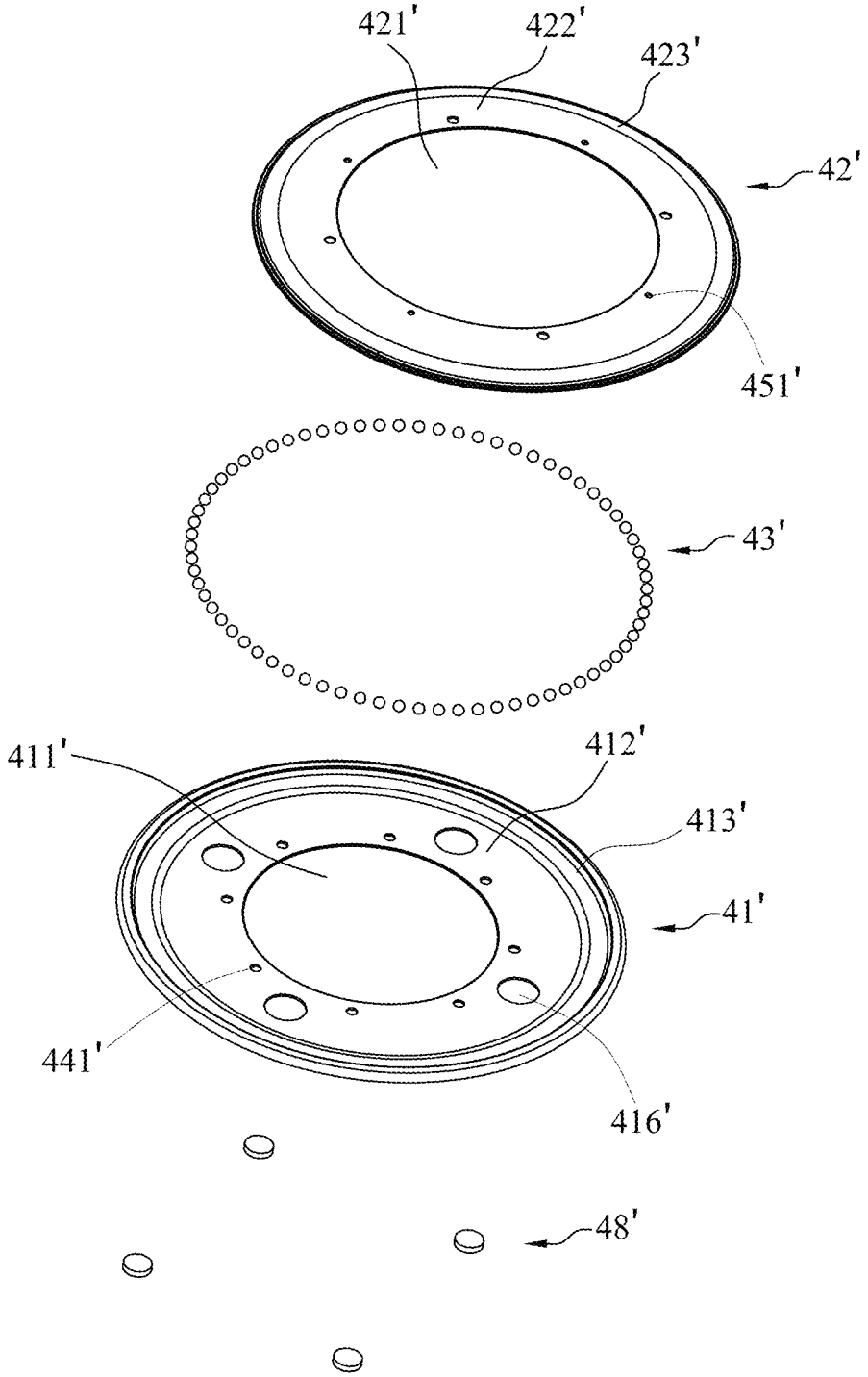
FIG. 65 is an exploded perspective view of the rotating assembly shown in FIG. 62.
Figure 66:
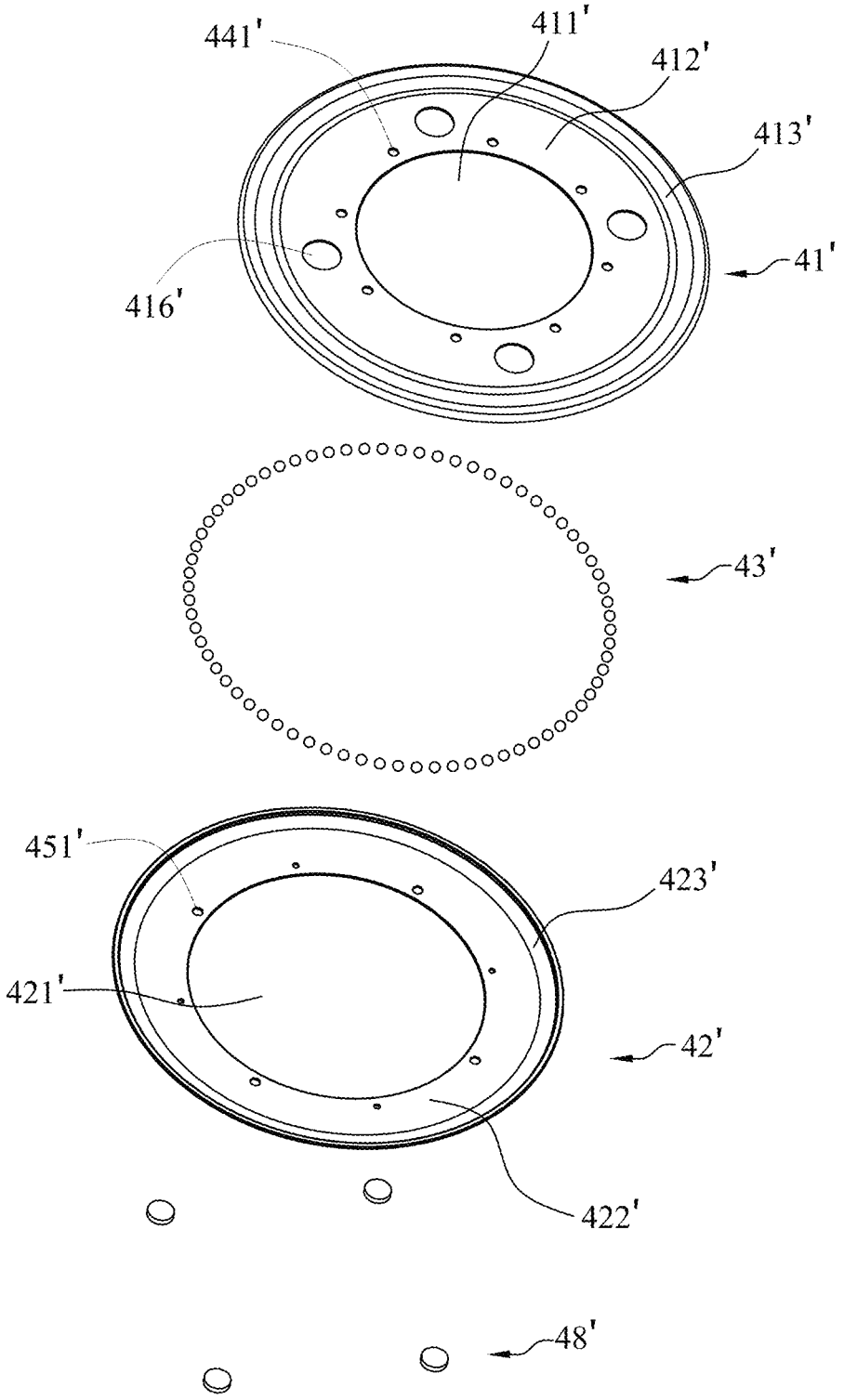
FIG. 66 is an exploded perspective view shown in FIG. 62, viewed from a different angle.
Figure 67:
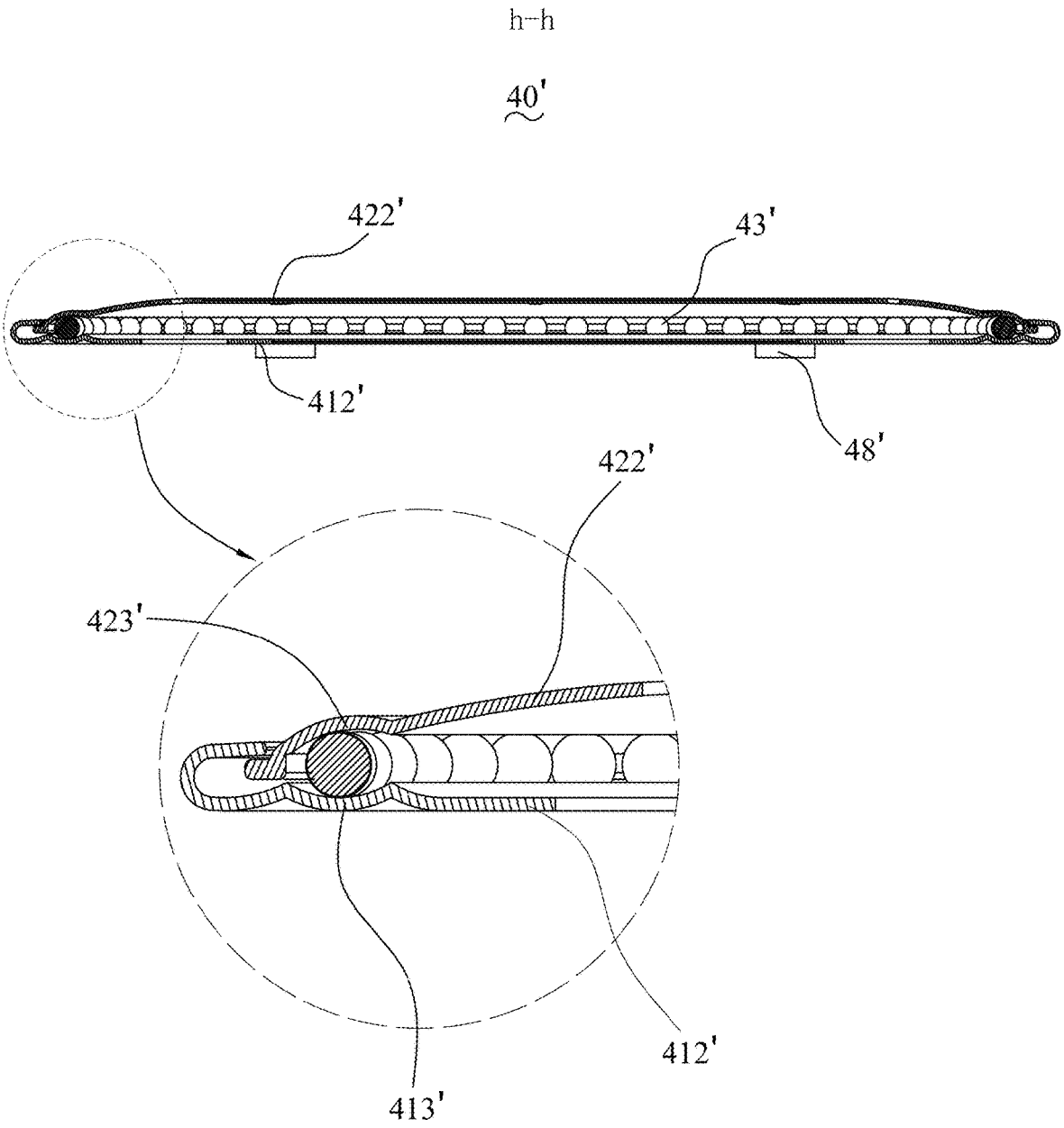
FIG. 67 is an illustrative cross-sectional view of the rotating assembly taken along line g-g in FIG. 62.
Figure 68:
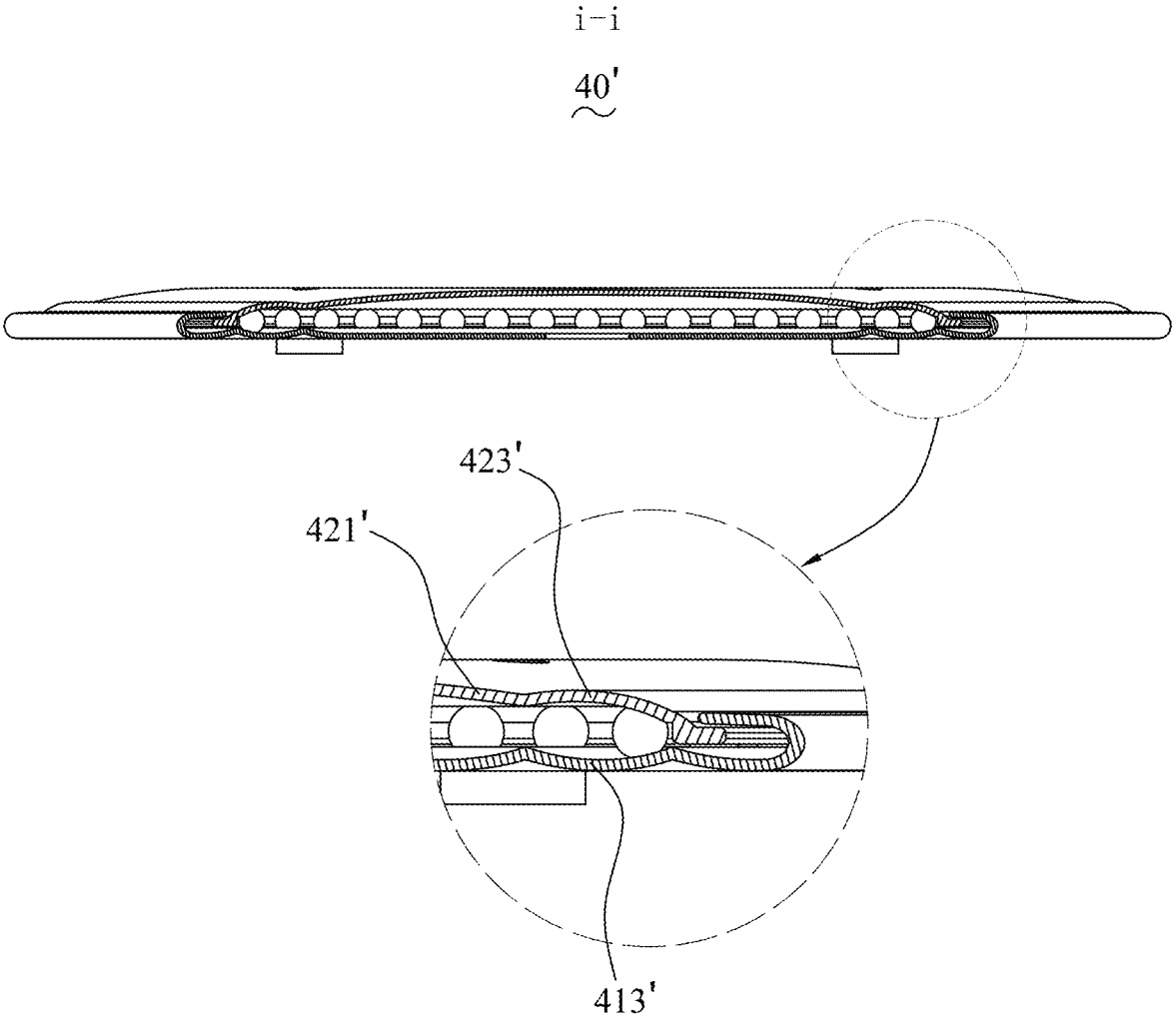
FIG. 68 is an illustrative cross-sectional view of the rotating assembly taken along line i-i in FIG. 62.
Figure 69:
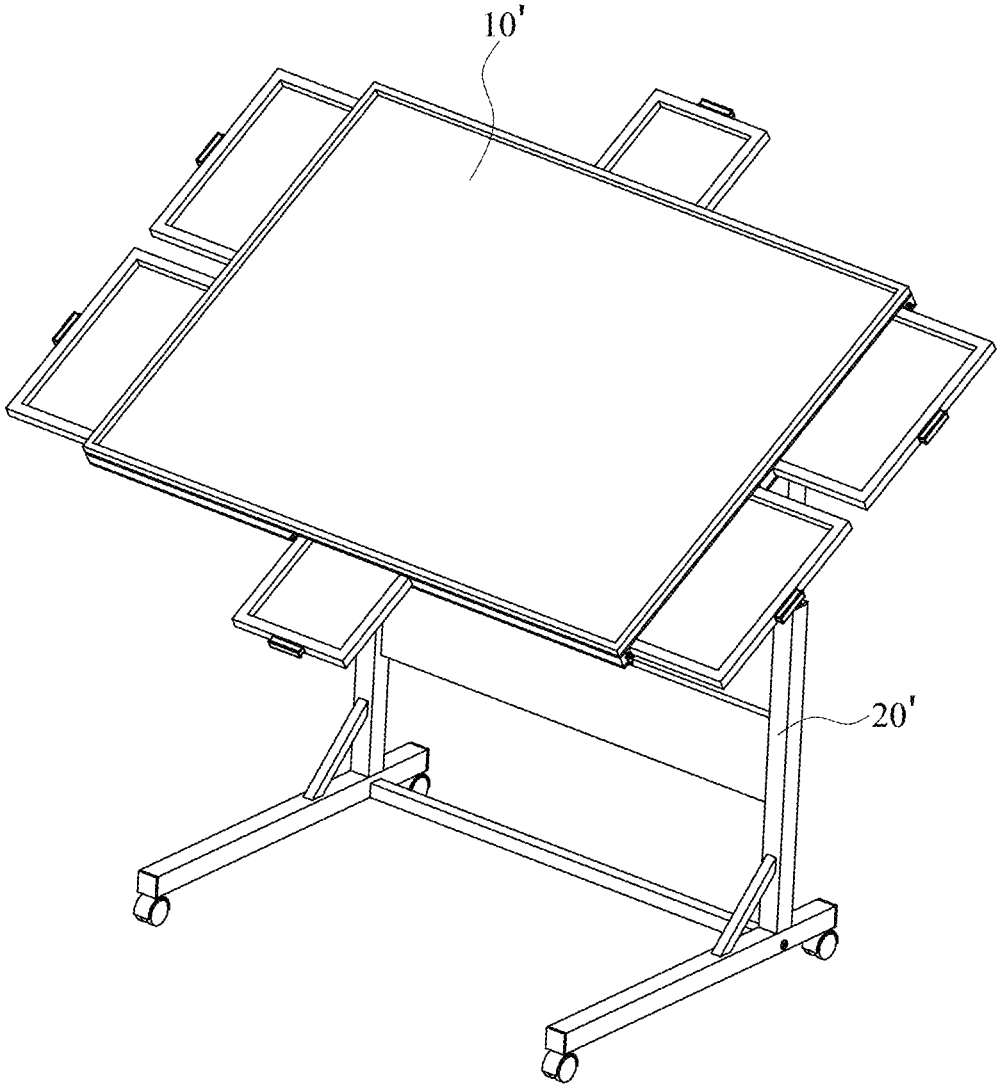
FIG. 69 is an illustrative isometric view of the jigsaw puzzle table in an inclined longitudinal state shown in FIG. 50.
Figure 72:
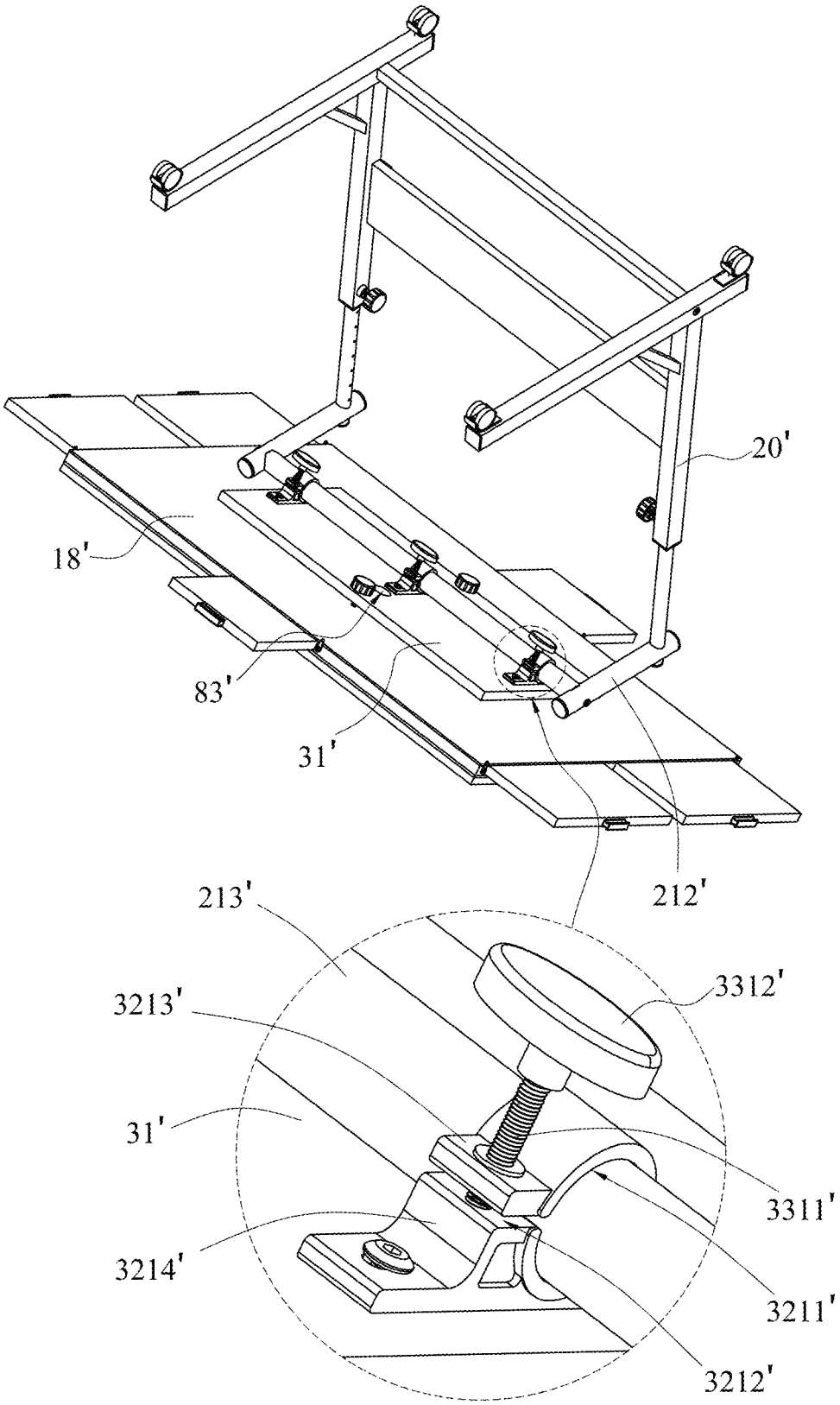
FIG. 72 is an illustrative isometric view of the jigsaw puzzle table shown in FIG. 71, viewed from a different angle.
Figure 73:
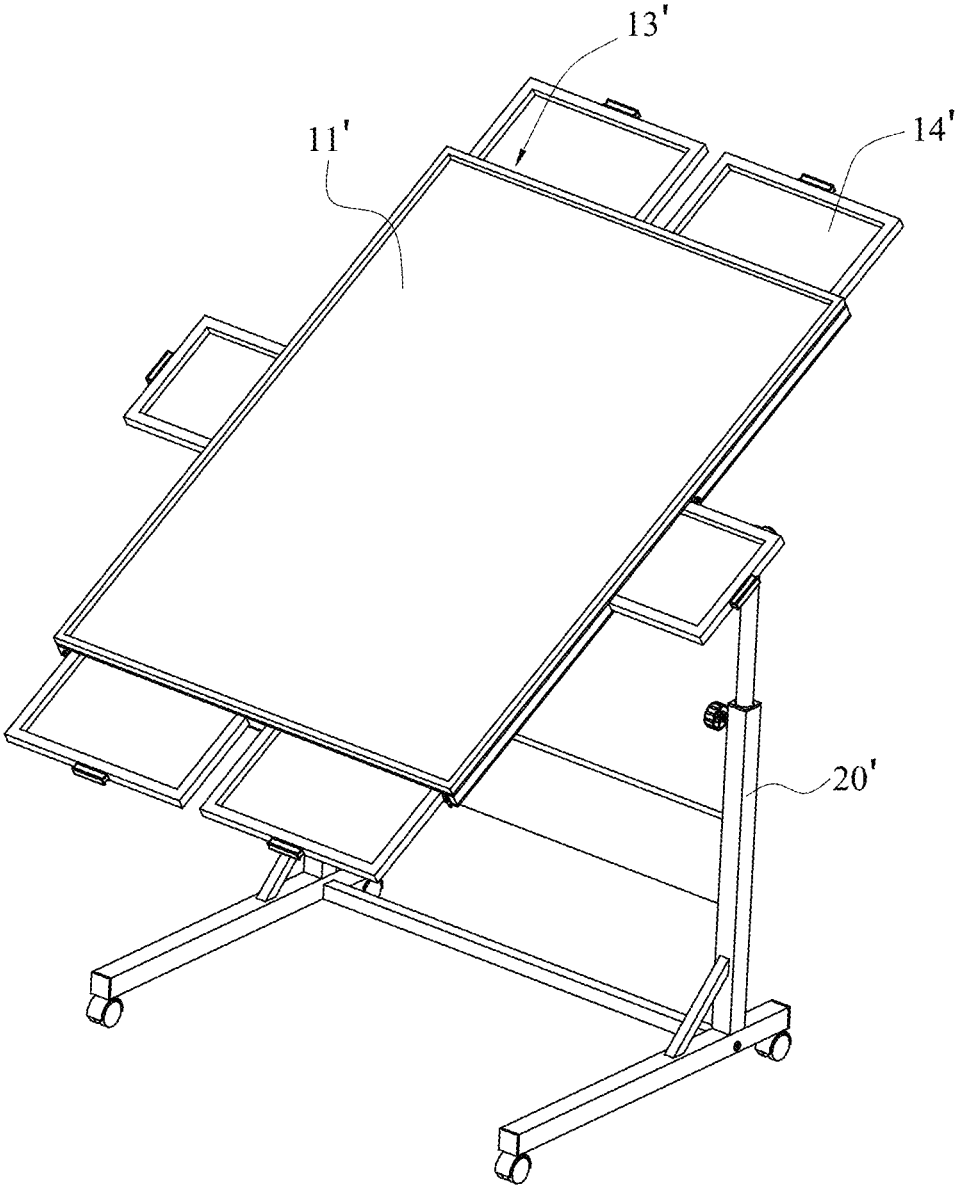
FIG. 73 is an illustrative isometric view of the jigsaw puzzle table in an inclined lateral state, shown in FIG. 50.
Figure 74:
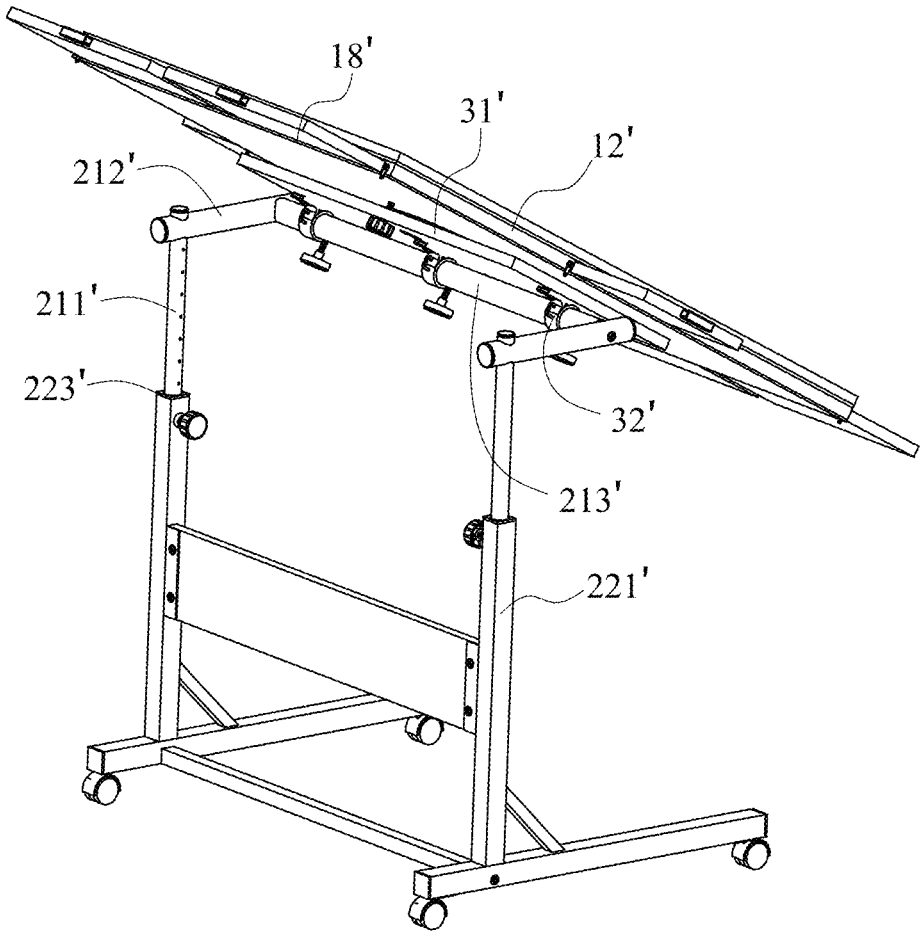
FIG. 74 is an illustrative isometric view of the jigsaw puzzle table shown in FIG. 73, viewed from a different angle.
Figure 75:
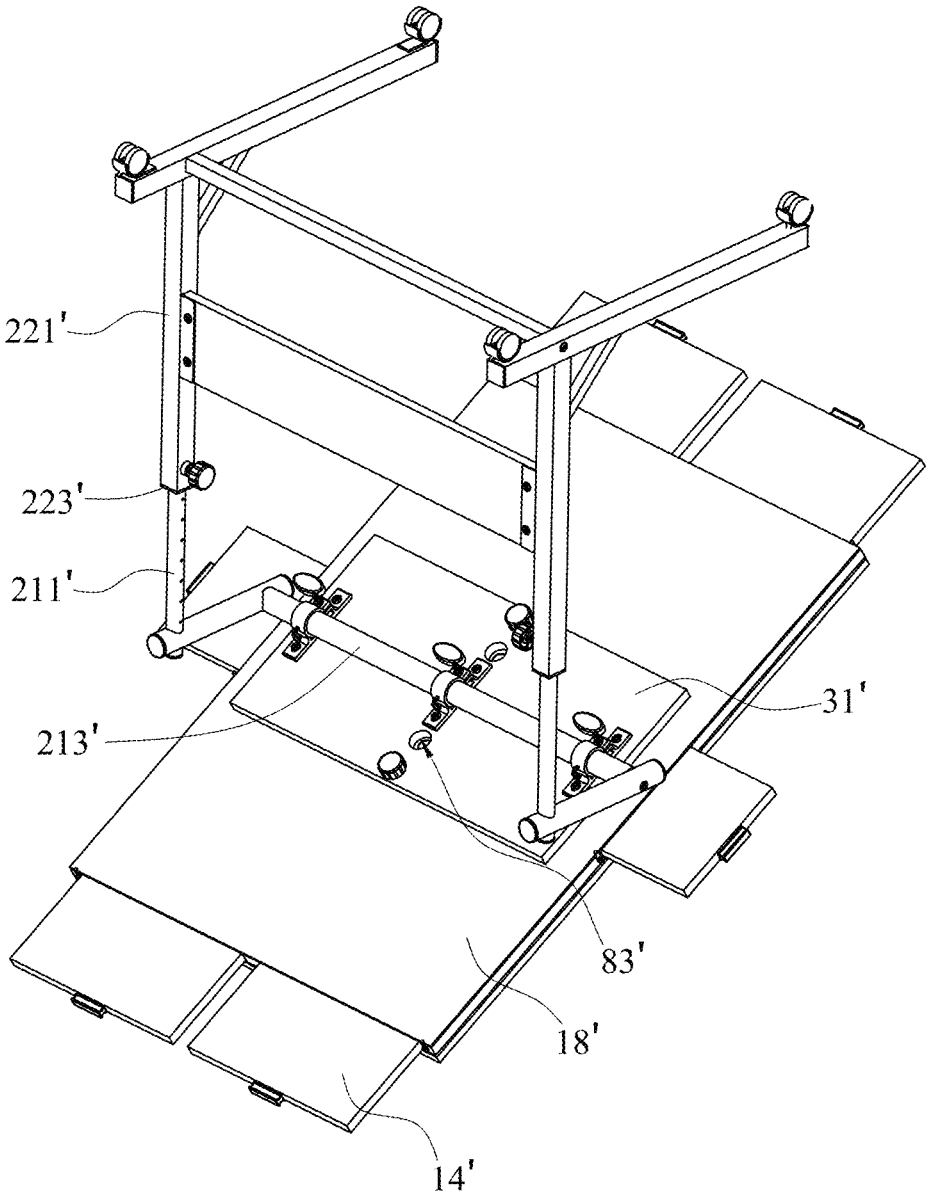
FIG. 75 is an illustrative isometric view of the jigsaw puzzle table shown in FIG. 73, viewed from a third angle.
Figure 76:
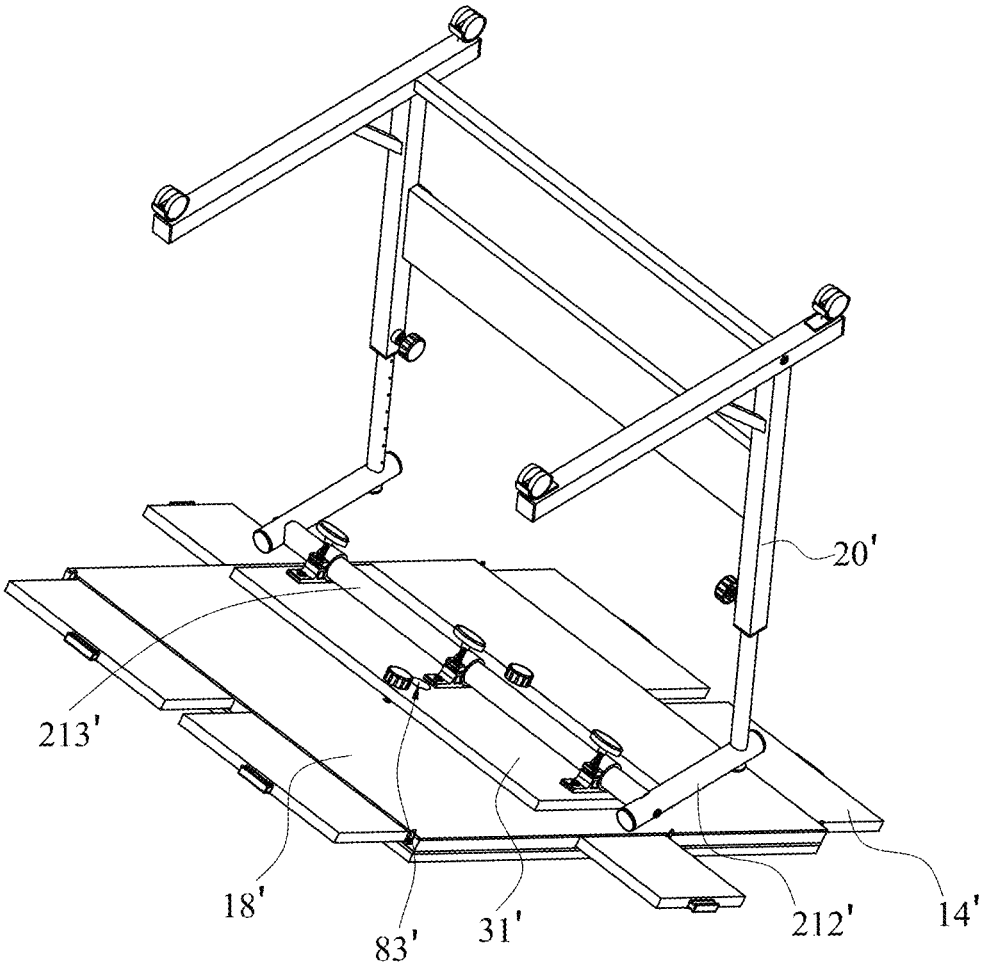
FIG. 76 is an illustrative isometric view of the jigsaw puzzle table shown in FIG. 73, viewed from a fourth angle.
Figure 77:
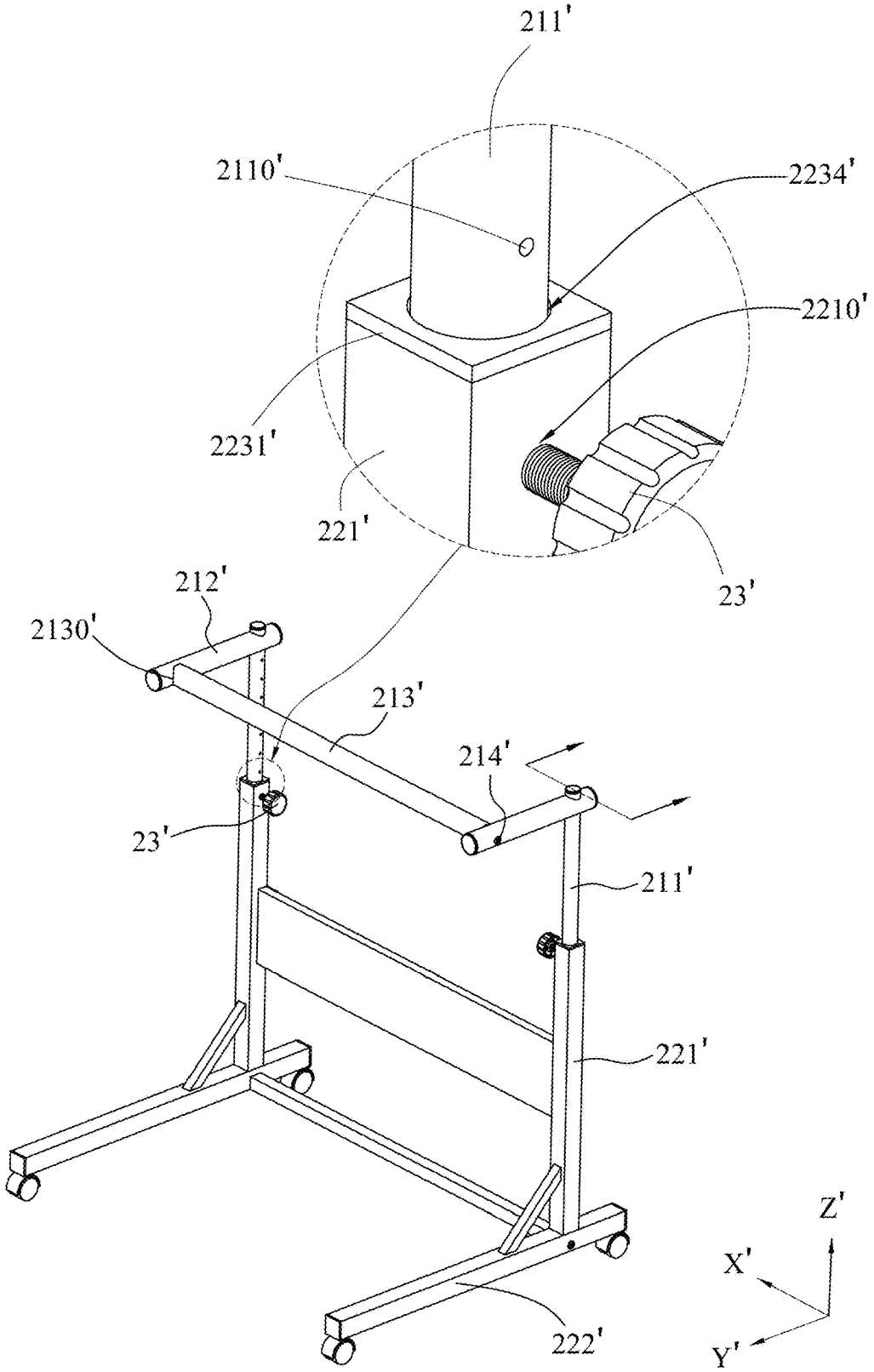
FIG. 77 is an illustrative isometric view of the supporting assembly shown in FIG. 50.
Figure 78:
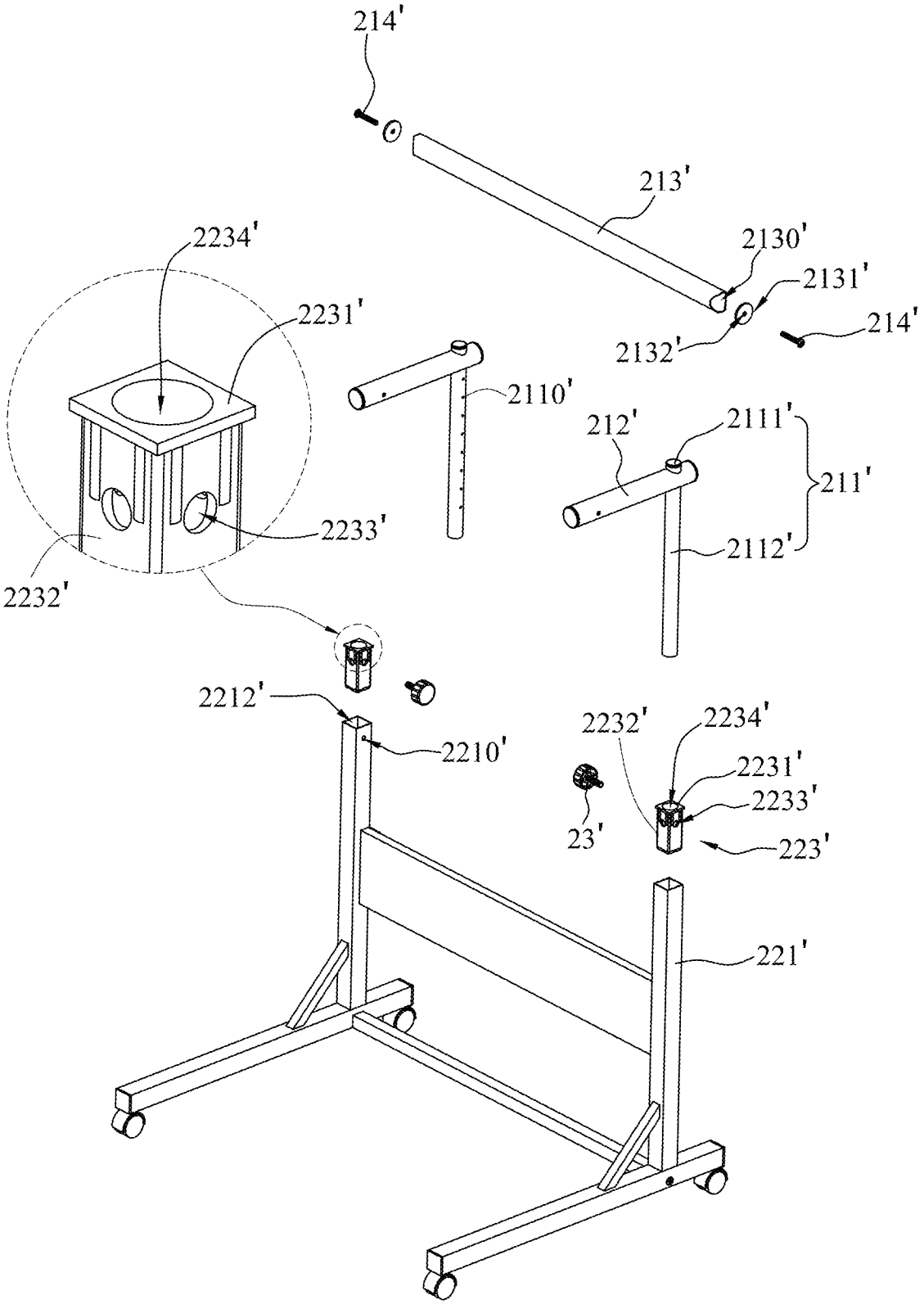
FIG. 78 is an exploded perspective view of the supporting assembly shown in FIG. 50.
Figure 79:
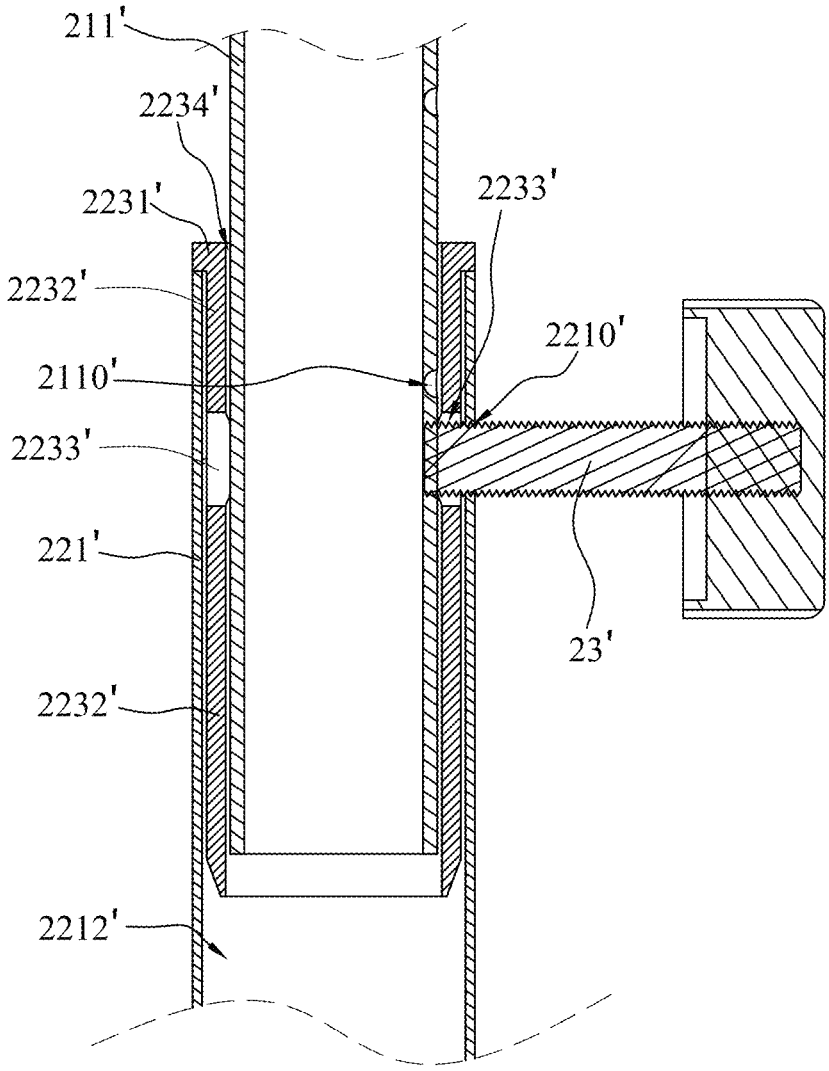
FIG. 79 is an illustrative cross-sectional view shown in FIG. 78.

Referring to FIGS. 56 and 72, the adjusting unit 33' comprises a fastening portion 331', a first connecting hole 332' formed in the first part 3213' and cooperated with the fastening portion 331', and a second connecting hole 333' formed in the second part 3214' and cooperated with the fastening portion 331'. The fastening portion 331' connects the first part 3213' and the second part 3214' to adjust the height of the adjusting gap 3212'. The fastening portion 331' is inserted into the first connecting hole 332', the adjusting gap 3212' and the second connecting hole 333' for adjusting the height of the adjusting gap 3212'. The fastening portion 331' is a screw and comprises a body part 3311' and an operating part 3312' connected to the body part 3311'.

To improve the fastening between the adjusting structure 30' and the connecting shaft 213', this embodiment adjusts the connection method between the fastening portion 331' and the second part 3214'. A hollow area 3215' is provided on the second part 3214', where the second connecting hole 333' communicates with the hollow area 3215'. The hollow area 3215' is open to the outside at both sides along the longitudinal direction X'. Inside the hollow area 3215', a nut 3216' is installed, which matches with the body part 3311' and is connected by threads. The hollow area 3215' is designed to facilitate the installation of nut 3216' on the second part 3214'. By adjusting the position of the nut 3216' on the body part 3311', the second part 3214' may be driven to move closer to or away from the first part 3213', thereby changing the height of the adjusting gap 3212'. The nut 3216' and the second connecting hole 333' cooperate together to secure the fastening portion 331'. Either one of them may be used alone to firmly connect with the fastening portion 331', thus achieving the purpose of adjusting the height of the adjusting gap.

In the first embodiment, the body part 3311' is directly connected to the second connecting hole 333', with the second connecting hole 333' being part of the second part 3214', typically made of plastic. Under prolonged threaded constraints, plastic is prone to deformation, which affects the fastening degree of the connection between the body part 3311' and the second connecting hole 333', thereby failing to securely fasten the board assembly 10' to the connecting shaft 213'. In this embodiment, the nut 3216' serves as a connecting medium between the body part 3311' and the second connecting hole 333', allowing the body part 3311' and the second connecting hole 333' to transmit force not directly through threads, but rather through the nut 3216'. This effectively addresses the deformation issue of the second connecting hole 333'.

Various technical features of the above-described embodiments may be combined arbitrarily. In order to make the description concise, not all possible combinations of the various technical features are described. However, as long as no contradiction occurs, any combination thereof should be included in the scope of the present invention.

The above-described embodiments show only several embodiments of the present invention, which are described in a more specific and detailed manner, but shall not be interpreted as a limitation of the scope of the present invention. To be noted that, any ordinary skilled person in the art may perform various deformations and improvements without departing from the concept of the present invention, all of which shall fall within the scope of the present invention. Therefore, the scope of the present invention shall be subject to the appended claims.

What is claimed is:

1. A jigsaw puzzle table, comprising:

a board assembly comprising a puzzle plate;

a reinforcing portion supporting the puzzle plate and comprising a pair of first reinforcing arms and a second reinforcing arm interlaced with the first reinforcing arms;

at least two puzzle drawers, wherein a pulling direction of the puzzle drawers is the same as an extension direction of the second reinforcing arm;

an adjusting structure coupled with the board assembly for supporting the board assembly and adjusting a posture of the board assembly relative to a user;

a supporting assembly coupled with the adjusting structure;

wherein the adjusting structure is capable of supporting the board assembly in either a horizontal state or an inclined state, and capable of enabling the board assembly to switch between the horizontal state and the inclined state;

wherein the supporting assembly comprises a connecting shaft and a supporting leg supporting the connecting shaft, and the adjusting structure is connected to the connecting shaft for driving the board assembly to switch between the horizontal state and the inclined state;

wherein the adjusting structure comprises:

a mounting hole fitted over an outer circumference of the connecting shaft, thereby allowing the adjusting structure to rotate around the connecting shaft; wherein a size of the mounting hole is adjustable;

an adjusting gap communicated with the mounting hole for dividing the adjusting structure into a first part and a second part; and an adjusting unit connected to both the first part and the second part for adjusting a size of the adjusting gap.

2. The jigsaw puzzle table according to claim 1, wherein the supporting leg is substantially perpendicular to the connecting shaft.

3. The jigsaw puzzle table according to claim 1, wherein the supporting assembly further comprises an extending arm extending from the supporting leg and connected to the connecting shaft, and the connecting shaft is spaced apart from the supporting leg.

4. The jigsaw puzzle table according to claim 3, wherein the supporting leg, the extending arm and the connecting shaft are substantially perpendicular to each other.

5. The jigsaw puzzle table according to claim 1, wherein the adjusting gap extends from an outer circumference of the adjusting structure to the mounting hole.

6. The jigsaw puzzle table according to claim 1, wherein the adjusting unit comprises a fastening portion, a first connecting hole formed in the first part and cooperated with the fastening portion, and a second connecting hole formed in the second part and cooperated with the fastening portion, wherein the fastening portion is inserted into the first connecting hole, the adjusting gap, and the second connecting hole for adjusting the size of the adjusting gap.

7. The jigsaw puzzle table according to claim 1, wherein the adjusting unit comprises a fastening portion, a first connecting hole formed in the first part and cooperated with the fastening portion, and a nut formed on the second part and cooperated with the fastening portion, wherein the fastening portion is inserted into the first connecting hole, the adjusting gap, and the nut for adjusting the size of the adjusting gap.

8. The jigsaw puzzle table according to claim 1, wherein the adjusting structure comprises a supporting portion located below the board assembly for supporting the board assembly and an adjusting portion fixed on the supporting portion, with the mounting hole formed in the adjusting portion.

9. The jigsaw puzzle table according to claim 8, wherein the supporting leg comprises an upper body protruded relative to the connecting shaft, the supporting portion comprises a first side and a second side opposite to the first side, the adjusting portion is fixed to the first side of the supporting portion, and the second side is detachably mounted on the upper body.

10. The jigsaw puzzle table according to claim 8, wherein the adjusting portion comprises a main portion connected to the connecting shaft and a fastening portion located above the main portion and coupled with the supporting portion.

11. The jigsaw puzzle table according to claim 8, wherein the puzzle plate, the reinforcing portion and the puzzle drawers form a puzzle board, and the board assembly comprises a rotating assembly sandwiched between the puzzle board and the supporting portion for driving the puzzle plate to rotate.

12. The jigsaw puzzle table according to claim 11, wherein the supporting portion further comprises an installation opening completely drilled through it; the rotating assembly comprises a coupling unit fixed on the puzzle board; the coupling unit is visible through the installation opening.

13. The jigsaw puzzle table according to claim 1, wherein the puzzle board comprises a lateral locking hole, a longer edge, and a shorter edge connected to the longer edge; the jigsaw puzzle table further comprises a rotating locking portion, wherein when the-rotating locking portion is connected to the lateral locking hole, the shorter edge is positioned in front of the user, and a lateral state is locked and maintained.

14. A jigsaw puzzle table, comprising:

a board assembly comprising a puzzle plate for assembling a plurality of puzzle pieces; and a supporting assembly configured for supporting the board assembly and comprising an upper part having a receiving channel, a supporting leg, and a connecting part connecting the supporting leg and the upper part;

a positioning fastener connected to the upper part to fasten the supporting leg to the upper part, wherein the positioning fastener is configured to secure the supporting leg and the upper part to fix a height of the board assembly supported by the supporting leg and the upper part; the positioning fastener is further configured to release the security between the supporting leg and the upper part to enable the supporting leg and the upper part to be at least partially movable relative to each other to adjust the supported height;

wherein the connecting part comprises a guiding portion inserted into the receiving channel and sandwiched between the upper part and the supporting leg, and an inner channel surrounded by the guiding portion; and the supporting leg is inserted into the inner channel.

15. The jigsaw puzzle table according to claim 14, wherein the inner channel is communicated with the receiving channel, the supporting leg is inserted into the receiving channel via the inner channel.

16. The jigsaw puzzle table according to claim 14, wherein the connecting part further comprises a flanging part extending from the guiding portion and mounted on the upper part for covering the receiving channel, the inner channel is completely drilled through the flanging part.

17. The jigsaw puzzle table, as recited in claim 14, further comprising an adjusting structure coupled with the puzzle board for adjusting a posture of the board assembly relative to a user; the adjusting structure is capable of supporting the board assembly in either a horizontal state or an inclined state, and capable of enabling the board assembly to switch between the horizontal state and the inclined state.

18. The jigsaw puzzle table according to claim 17, wherein the adjusting structure comprises a supporting portion located below the board assembly for supporting the board assembly; and an adjusting portion coupled with the supporting portion and supported by the supporting assembly.

19. The jigsaw puzzle table according to claim 18, wherein the supporting assembly further comprises two supporting legs and a connecting shaft supported by the two supporting legs, and the adjusting structure comprises a mounting hole fitted over an outer circumference of the connecting shaft, thereby allowing the adjusting structure to rotate around the connecting shaft.

20. The jigsaw puzzle table according to claim 18, further comprising a rotating assembly mounted on the supporting portion.

21. The jigsaw puzzle table according to claim 20, wherein the board assembly further comprises at least two puzzle drawers and a reinforcing portion supporting the puzzle plate and comprising a pair of first reinforcing arms and a second reinforcing arm interlaced with one of the first reinforcing arms; wherein a pulling direction of the puzzle drawers is the same as an extension direction of the second reinforcing arm.

22. The jigsaw puzzle table according to claim 20, wherein the supporting portion is a one-piece structure with a substantially flat-plate shape.

23. A jigsaw puzzle table, comprising:

a puzzle board comprising a puzzle plate;

a reinforcing portion supporting the puzzle plate and forming at least two drawer cavities;

at least two puzzle drawers installed within a corresponding drawer cavity and actuated to slide in-and-out relative to the corresponding drawer cavity;

a supporting portion spaced apart from the puzzle board;

a rotating assembly mounted on the supporting portion and comprising a first housing mounted on the supporting portion and a second housing rotatably coupled to the first housing; and a supporting assembly supporting the supporting portion and comprising a pair of supporting legs and a connecting shaft connecting the pair of supporting legs and supporting the supporting portion;

wherein the puzzle board can be rotated relative to the supporting portion through the second housing rotating with respect to the first housing.

24. The jigsaw puzzle table according to claim 23, wherein the supporting assembly further comprises an extending arm extending from the supporting leg and connected to the connecting shaft, and the connecting shaft is spaced apart from the supporting legs.

25. The jigsaw puzzle table according to claim 23, wherein an extending direction of the supporting leg is substantially perpendicular to that of the extending arm.

26. The jigsaw puzzle table according to claim 23, wherein the supporting portion is a one-piece structure with a substantially flat-plate shape.

27. The jigsaw puzzle table according to claim 23, wherein the puzzle board comprises a lateral locking hole, a longer edge and a shorter edge, connected to the longer edge; the jigsaw puzzle table further comprises a rotating locking portion, when the rotating locking portion is connected to the lateral locking hole, the shorter edge is positioned in front of the user and a lateral state is locked and maintained.

28. The jigsaw puzzle table according to claim 1, wherein the board assembly further comprises an extending wall and a main supporting wall extending from the extending wall; the extending wall is integral with the main supporting wall as a whole; and the extending wall cooperates the puzzle plate for forming a game area.

* * * * *